US012690641B2

(12) United States Patent
Markison

(10) Patent No.: US 12,690,641 B2
(45) Date of Patent: Jul. 28, 2026

(54) SHOE WITH FORCE DEFUSING AND/OR FORCE DIRECTING CONSTRUCTS

(71) Applicant: Timothy W. Markison, Mesa, AZ (US)

(72) Inventor: Timothy W. Markison, Mesa, AZ (US)

( * ) Notice: Subject to any disclaimer, the term of this patent is extended or adjusted under 35 U.S.C. 154(b) by 0 days.

(21) Appl. No.: 18/407,626

(22) Filed: Jan. 9, 2024

(65) Prior Publication Data

US 2024/0225180 A1 Jul. 11, 2024

Related U.S. Application Data

(60) Provisional application No. 63/438,223, filed on Jan. 10, 2023.

(51) Int. Cl.
*A43B 13/18* (2006.01)
*A43B 13/12* (2006.01)

(52) U.S. Cl.
CPC ..... *A43B 13/181* (2013.01); *A43B 13/12* (2013.01); *A43B 13/18* (2013.01)

(58) Field of Classification Search
CPC ..... A43B 13/18; A43B 13/181; A43B 13/187; A43B 13/188; A43B 13/12; A43B 13/125; A43B 13/127; B32B 3/30; B32B 2437/02; B32B 3/12; A41D 13/015; A41D 1/04
USPC ..... 36/28
See application file for complete search history.

(56) References Cited

U.S. PATENT DOCUMENTS

| | | | | |
|---|---|---|---|---|
| 4,535,553 | A * | 8/1985 | Derderian | A43B 13/181 36/28 |
| 5,092,060 | A * | 3/1992 | Frachey | A43B 1/0072 36/114 |
| 5,782,014 | A * | 7/1998 | Peterson | A43B 13/18 36/35 B |
| 6,178,662 | B1 * | 1/2001 | Legatzke | A43B 7/146 36/43 |
| 6,200,664 | B1 * | 3/2001 | Figge | F42B 39/16 428/920 |
| 7,401,418 | B2 * | 7/2008 | Wyszynski | B29C 39/025 36/35 R |
| 7,614,163 | B2 * | 11/2009 | Fujii | A43B 7/1445 36/43 |
| 8,938,893 | B2 | 1/2015 | Adair | |
| 10,653,193 | B2 | 5/2020 | Markison | |
| 11,805,843 | B2 * | 11/2023 | Gross | A43B 13/187 |
| 2006/0277788 | A1 * | 12/2006 | Fujii | A43B 17/02 36/28 |
| 2007/0039204 | A1 * | 2/2007 | Wyszynski | B29C 39/10 36/28 |
| 2008/0166524 | A1 * | 7/2008 | Skaja | B32B 3/12 264/210.1 |
| 2012/0291946 | A1 * | 11/2012 | Turner | A43B 17/14 156/264 |

(Continued)

*Primary Examiner* — Marie D Bays
(74) *Attorney, Agent, or Firm* — Garlick & Markison; Timothy W. Markison

(57) ABSTRACT

An apparatus for a shoe that includes an inner layer of defusing cells and an outer layer of defusing cells. The inner layer is towards a foot when the shoe is worn and the and the outer layer is towards ground when the shoe is worn and the wearer is standing. The outer layer of defusing cells is aligned with the inner layer of defusing cells and, as aligned, function to reduce impact pressure of an impact force of the wearer.

15 Claims, 81 Drawing Sheets

(56) References Cited

U.S. PATENT DOCUMENTS

| | | | | |
|---|---|---|---|---|
| 2015/0033577 | A1* | 2/2015 | Dahl | A43B 13/186 12/146 B |
| 2017/0008249 | A1* | 1/2017 | Parsons | A47C 27/085 |
| 2017/0035146 | A1* | 2/2017 | Peyton | A43B 13/20 |
| 2017/0215521 | A1* | 8/2017 | Spiller | A43B 23/027 |
| 2018/0049503 | A1* | 2/2018 | Markison | B32B 27/08 |
| 2020/0340612 | A1* | 10/2020 | Kawamura | B32B 3/266 |
| 2020/0359737 | A1* | 11/2020 | Sung | A43B 13/181 |
| 2021/0186151 | A1* | 6/2021 | Gross | A43B 13/04 |
| 2021/0299310 | A1* | 9/2021 | Smith | B32B 15/14 |
| 2023/0200487 | A1* | 6/2023 | Smotrycz | A43B 13/18 36/28 |

* cited by examiner medial view top view top view anterior to posterior cross cut right foot (AA of FIG. 1B)

top view
cross section cuts anterior to posterior cross cut right foot (AA of FIG. 1B)

cross section G-G

DeFuzer cell 48 w/
square base cross section G-G cross section G-G cross section G-G cross section G-G top view bottom view cross section G-G cross section H-H DeFuzer cell 48 w/ hexagon base cross section EE or FF of FIG. 4 heel view cross section AA of Figure 1B
medial view of left foot top view, right foot top view, right foot medial view of left foot medial view of left foot medial view of left foot medial view of left foot medial view of left foot medial view of left foot medial view of left foot medial view of left foot medial view of left foot medial view of left foot medial view of left foot medial view of left foot top view top view top view cross section K-K isometric exploded view top view top view top view top view red inner layer 52 top view top view top view red inner layer 52 top view top view cross section EE or FF of FIG. 4 heel view cross section AA of Figure 1B medial view of left foot anterior to posterior cross cut right foot (AA of FIG. 1B)

right foot
front view right foot
front view right foot
front view right foot
front view anterior to posterior cross cut right foot (AA of FIG. 1B)

right foot
front view right foot
front view right foot
front view right foot
front view may fill gap with a compressible material outer edge cell 90

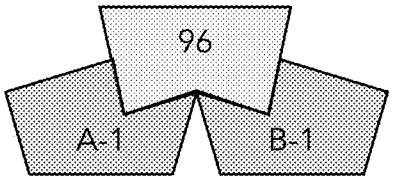
FIG. 52A
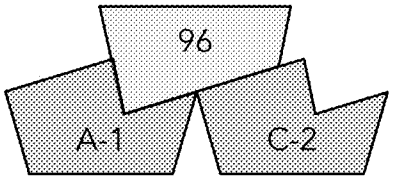
FIG. 52B
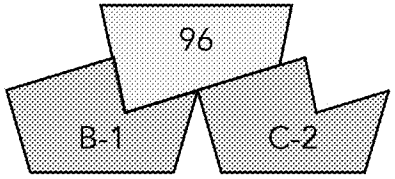
FIG. 52C
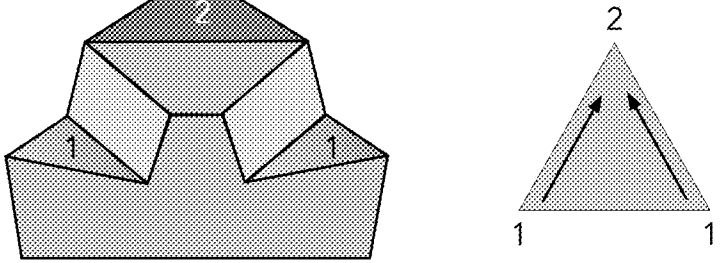
FIG. 50A
FIG. 50B
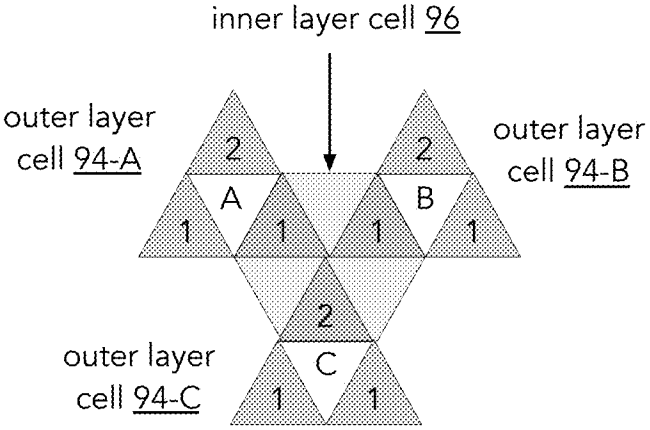
FIG. 51 blue outer layer 54 top view top view top view full midsole-outsole DeFuzer based structure red inner layer 52 full midsole-outsole DeFuzer based structure isometric view cross section N-N
side view isometric view cross section O-O
side view isometric view isometric view no weight with weight

SHOE WITH FORCE DEFUSING AND/OR FORCE DIRECTING CONSTRUCTS

CROSS-REFERENCE TO RELATED APPLICATIONS

The present U.S. Utility patent application claims priority pursuant to 35 U.S.C. § 119(e) to U.S. Provisional Application No. 63/438,223, entitled "Shoe with Force Defusing and/or Force Direction Constructs", filed Jan. 10, 2023, which is hereby incorporated herein by reference in its entirety and made part of the present U.S. Utility Patent Application for all purposes.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

Technical Field of the Invention

An invention relates generally to footwear and more particularly to force defusing and/or force directing within footwear.

Description of Related Art

As is known, a wide variety of footwear is available in today's market. The types, designs, and style of footwear vary greatly depending on their use. For example, dress shoes have a particular design and style based on a more formal use. As another example, athletic shoes have a particular design and style based on their use while playing sports. For instance, each of tennis shoes, golf shoes, running shoes, cross training shoes, hiking shoes, basketball shoes, etcetera have a particular sole pattern, a sole design, an insole design, and/or upper shoe portion design. In addition, each type of shoe may further include, for a variety of health reasons, an arch support design, a pronation compensation design, and/or a supination compensation design.

BRIEF DESCRIPTION OF THE SEVERAL VIEWS OF THE DRAWING(S)

FIG. 50A is an isometric view of another embodiment of a cell of a blue outer layer of a DeFuzer section of a shoe;

FIG. 50B is a diagram of another example of force direction for a cell of a blue outer layer of a DeFuzer section of FIG. 50A;

FIG. 51 is a diagram of another example of a cell of the red inner layer overlapping three cells a blue outer layer of a DeFuzer section of a shoe;

FIG. 52A is a first crosscut section view of an example a cell of the red inner layer overlapping two cells a blue outer layer of a DeFuzer section of FIG. 51;

FIG. 52B is a first crosscut section view of an example a cell of the red inner layer overlapping two cells a blue outer layer of a DeFuzer section of FIG. 51;

FIG. 52C is a third crosscut section view of an example a cell of the red inner layer overlapping two cells a blue outer layer of a DeFuzer section of FIG. 51;

DETAILED DESCRIPTION OF THE INVENTION

Figure 1A:
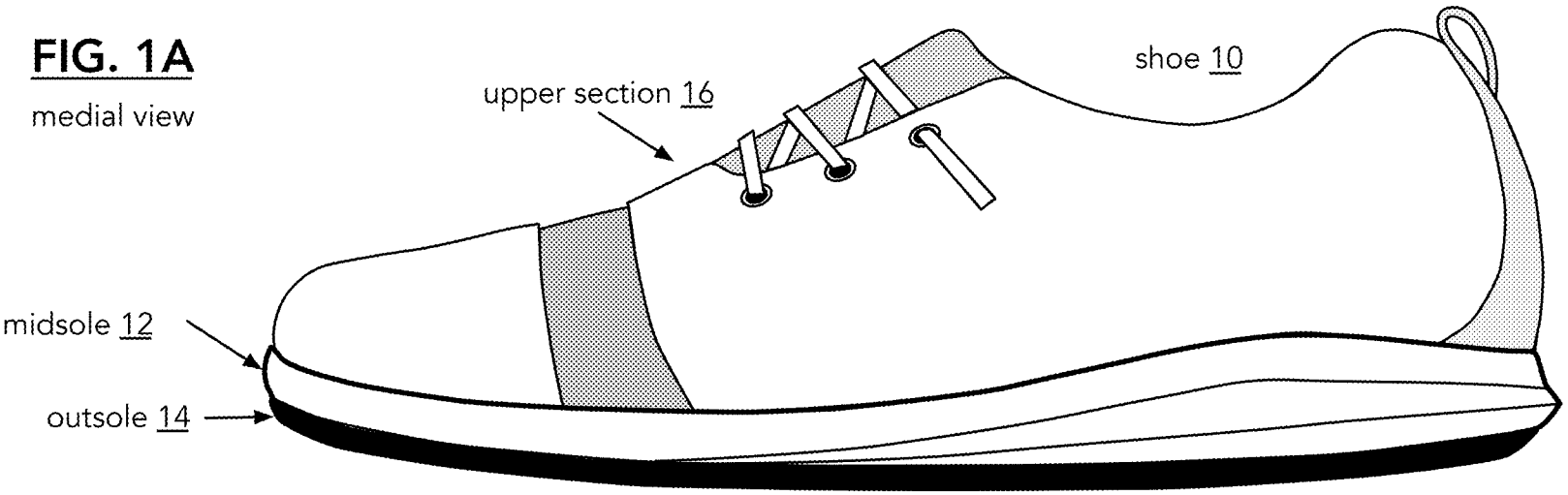
FIG. 1A is a medial view of an embodiment of a shoe.
Figure 1B:
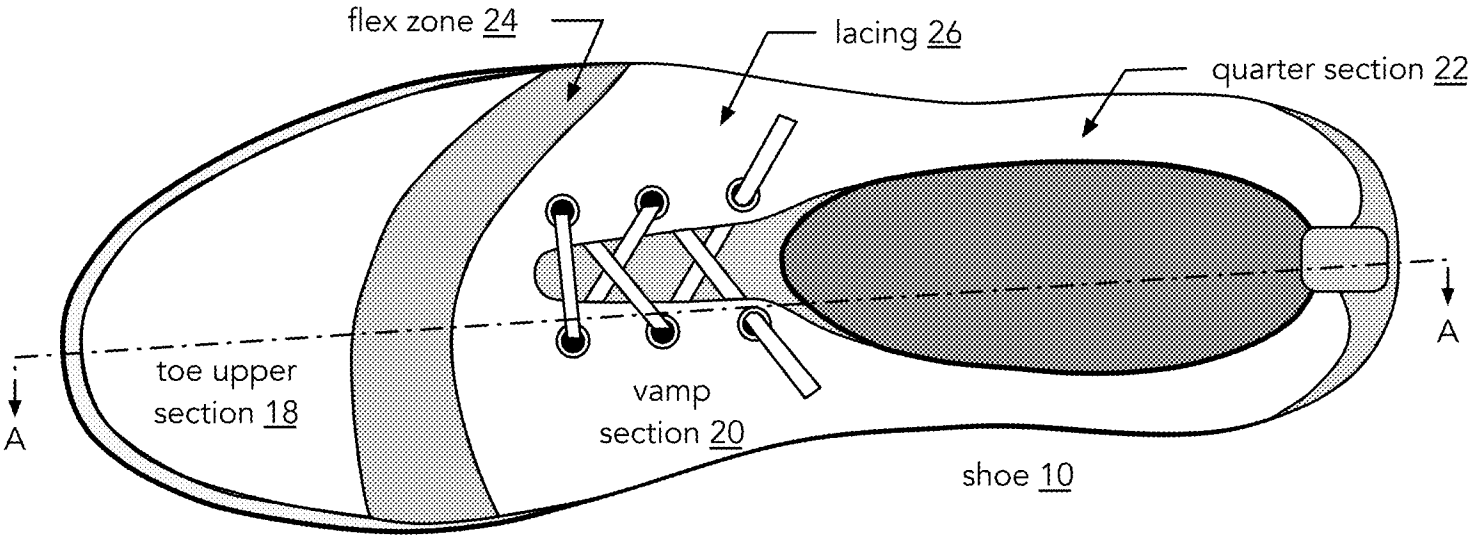
FIG. 1B is a top view of an embodiment of a shoe.

FIG. 1A is a medial view of an embodiment of a shoe and FIG. 1B is a top view of an embodiment of the shoe. The shoe is shown as an athletic shoe but could be any type of footwear including ski boots, ice skates, snowboard boots, and hiking boots. The shoe 10 includes a midsole 12, an outsole 14, and an upper section 16. The upper section 16 includes a toe upper section 18, a vamp section 20, a quarter section 22, a flex zone 24, and lacing 26. In another embodiment, the upper section 16 does not include a flex zone. In yet another embodiment, upper section 16 includes an alternate form of securing the shoe to a foot instead of the lacing 26.

Various embodiments of the midsole 12 and/or outsole 14 are provided in the following figures. In addition, the midsole 12 and/or the outsole 14 are formed of one or more materials. Such materials include, but are not limited to, EVA, TPU, plastic, rubber, fiberglass, one or more types of metal (e.g., sheet metal), and foam padding. The midsole 12 and/or outsole 14 are formed using one or more manufacturing techniques, which include, but are not limited to, injection molding, 3D printing, milling, CNC machining, and conventional molds.

Figure 2:
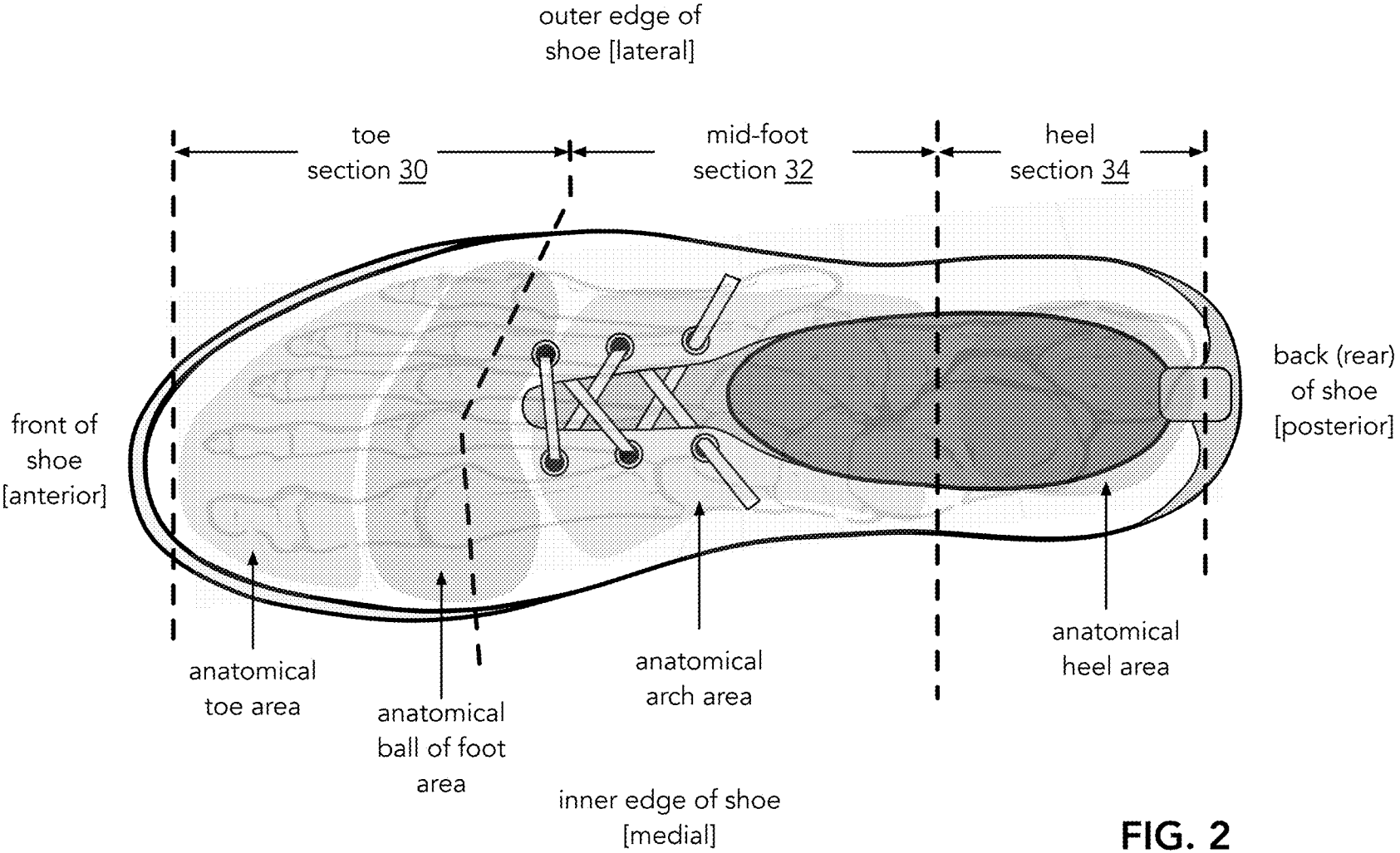
FIG. 2 is a top view of an embodiment of a shoe having shoe sections and corresponding anatomical foot sections.

FIG. 2 is a top view of an embodiment of a shoe having shoe sections and corresponding anatomical foot sections. A shoe include three primary sections: a toe section 30, a mid-foot section 32, and a heel section 34 to support the anatomical nature of a foot. The anatomical sections includes a light blue toe area, a light red ball of foot area, a light blue arch area, and a light red heel area that collectively span from the front of the shoe (anterior side) to the back, or rear, of the shoe (posterior side) and from the inner edge (medial side) to the outer edge (lateral side).

Figure 3:
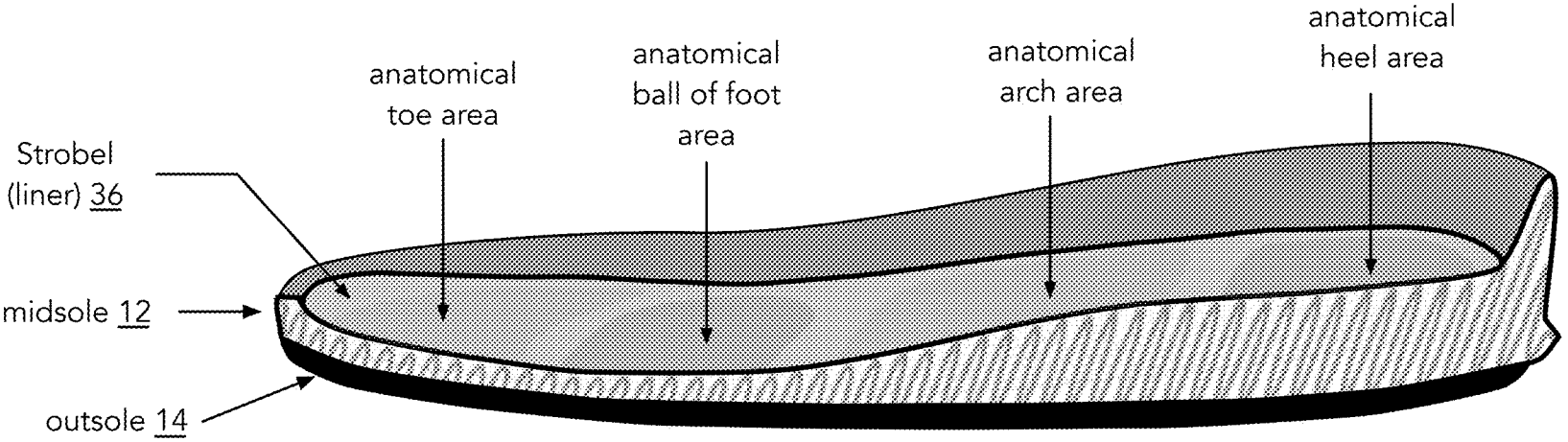
FIG. 3 is a cross section view of an embodiment of a shoe and its corresponding anatomical foot sections.

FIG. 3 is a cross section view of an embodiment of a shoe and its corresponding anatomical foot sections. The crosscut reveals the outsole 14, the midsole 12, and a Strobel or liner 36. The midsole 14 is illustrated with blue shading to distinguish it from the other parts of the sole and to illustrate that it has a lip section that at least partially encircles the shoe and provide a surface for connecting the upper to the sole.

FIG. 3 also illustrates the anatomical sections of the light blue toe area, the light red ball of foot area, the light blue arch area, and the light red heel area. The height (or thickness) of the midsole 12 varies from anterior to posterior. For example and with respect to the blue anatomical toe area, the midsole height ranges from a millimeter to 10 or more millimeters. As another example and with respect to the red anatomical ball of foot area, the midsole height ranges from a millimeter to 10 or more millimeters. As another example and with respect to the blue anatomical arch area, the midsole height ranges from a few millimeters to 15 or more millimeters. As another example and with respect to the red anatomical heel area, the midsole height ranges from a 8 millimeters to 25 or more millimeters.

In each of the anatomical sections, the midsole height may be constant from anterior to posterior of the section, may angle up or down from anterior to posterior, or may different heights in different portions or an anatomical area. Note that many shoes include an insole, which sits upon the Strobel 36.

Figure 4:
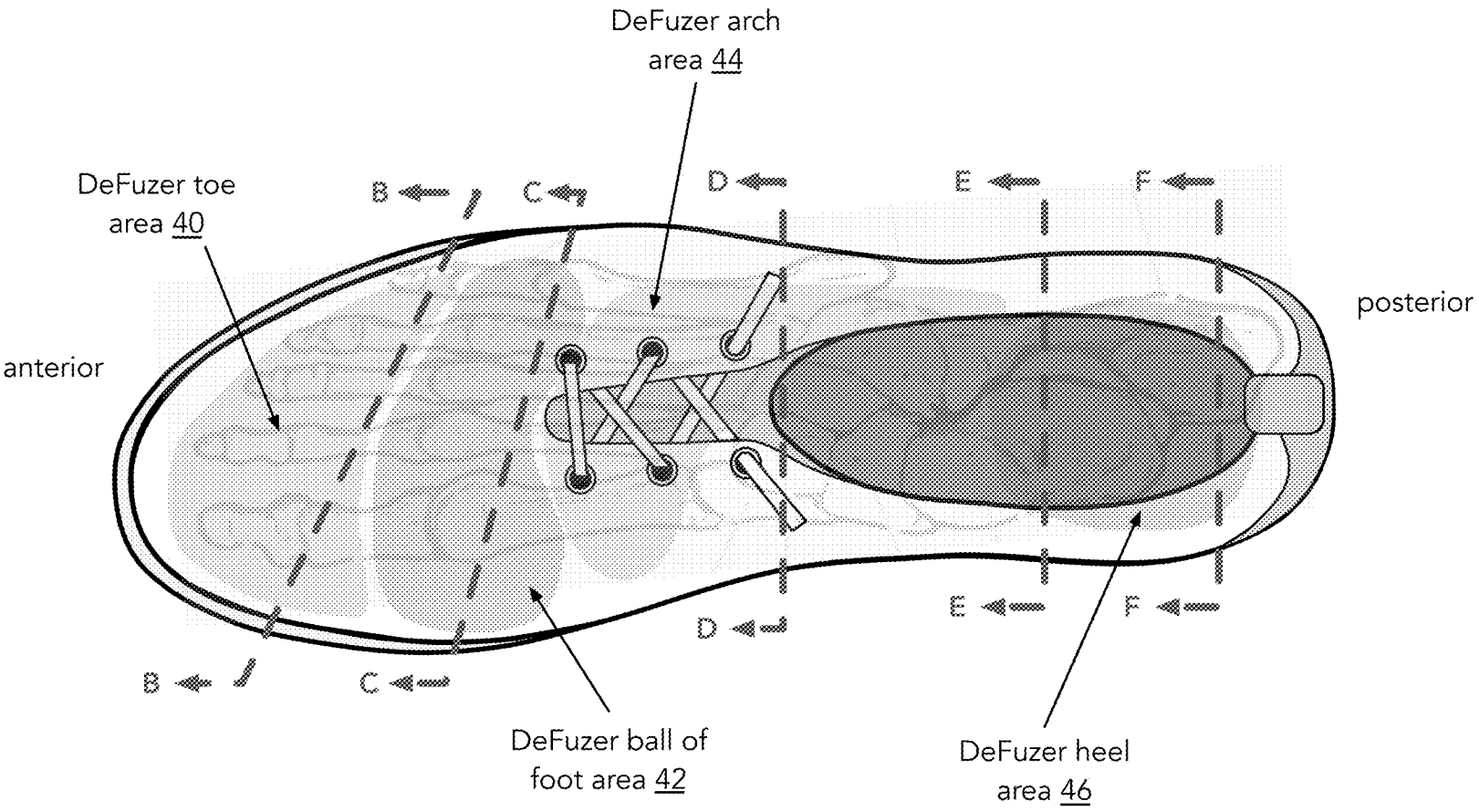
FIG. 4 is a top view of an embodiment of a shoe having DeFuzer sections and corresponding crosscut lines.

FIG. 4 is a top view of an embodiment of a shoe having DeFuzer sections and corresponding crosscut lines. In this figure, each of the anatomical sections of the light blue toe area, the light red ball of foot area, the light blue arch area, and the light red heel area includes one or more cross section cuts. For instance, the light blue toe area includes a cross cut on the anterior side of the metatarsi phalanges joints; the light red ball of foot area includes a cross cut on the posterior side of the metatarsi phalanges joints; the light blue area includes a cross cut approximately at a midline from anterior to posterior; and the light red heel area includes two cross cuts: one at the heel's anterior side and the other at the heel's posterior side.

Figure 5:
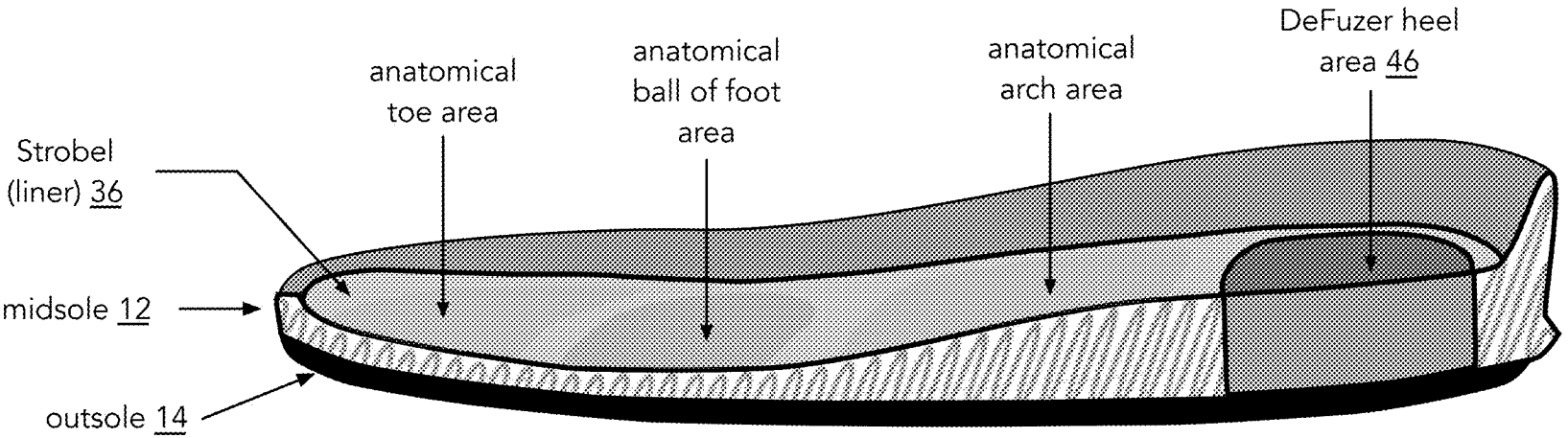
FIG. 5 is a cross section view of an embodiment of a shoe having a DeFuzer heel area.

FIG. 5 is a cross section view of an embodiment of a shoe having a red DeFuzer heel area 46, which includes an inner layer of cells and an outer layer of cells. The cells have a geometric shape that is substantially maintained when forces (e.g., body weight, muscle contraction, and/or ground reaction force) are applied to the DeFuzer heel section 46. The cells work collectively to primarily distribute the forces over a larger area to reduce impact pressure on the heel and efficiently transfer the forces between the body and the ground. The cells may have one or more shapes as described below with reference to FIGS. 6A through 8C.

With a DeFuzer heel section 46, the heel portion of any type of shoe can have a thickness in the range of a quarter of an inch to about an inch or more. The DeFuzer heel section 46 provides comparable comfort to shoes having thicker heel sections, which include thick compressible material to absorb impact forces due to the spreading of the forces over a larger area (i.e., defusing the forces). The DeFuzer heel section 46 decreases the pressure with minimal loss of force in comparison to shoes that have thick compressible material to absorb impact forces. This makes shoes that include a DeFuzer heel section 46 more efficient than conventional shoes, which will aid wearers of the shoe in athletic performance, endurance, and/or mitigation the risk of injury.

In an embodiment, the midsole 12 includes a hollow section in the heel area. A heel DeFuzer piece is fitted into the hollow section. In this embodiment, the heel DeFuzer piece can be used with multiple pairs of shoes. In a further embodiment, the heel DeFuzer piece includes circuitry to measure foot force, body temperature, heart rate, perspiration, and/or biometrics. In an alternative embodiment, the DeFuzer structure is integrated into the midsole. In another embodiment, the midsole is comprised of sections of DeFuzer structures. In yet another embodiment, the midsole and outsole are comprised of sections DeFuzer structures.

Figure 6B:
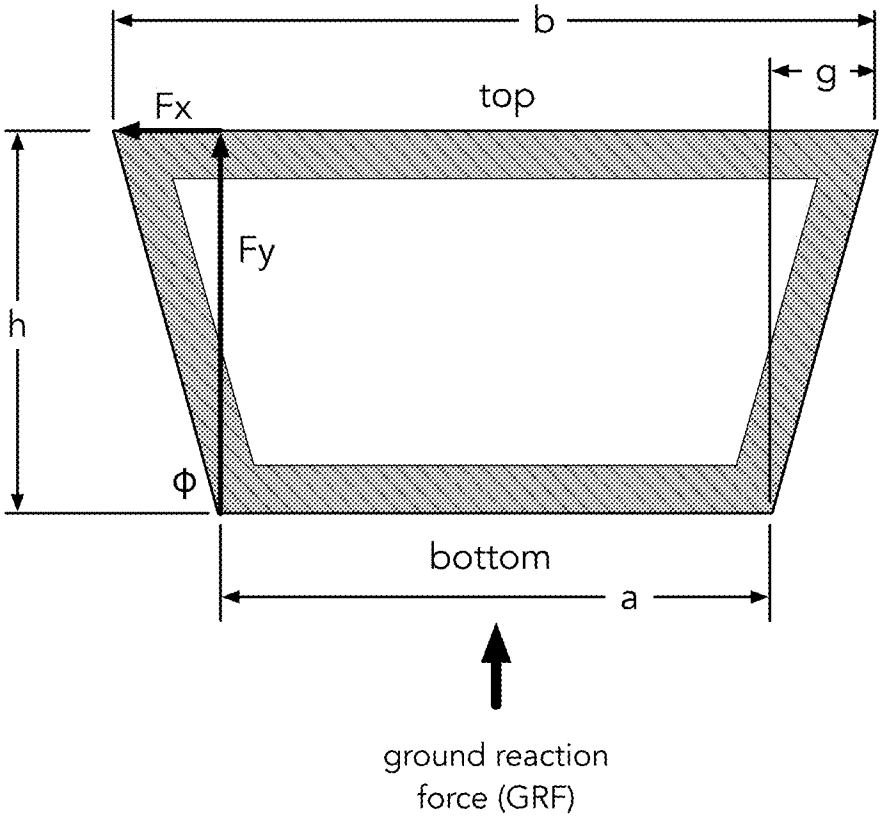
FIG. 6B is a crosscut section view of an embodiment of the DeFuzer cell of FIG. 6A.
Figure 6A:
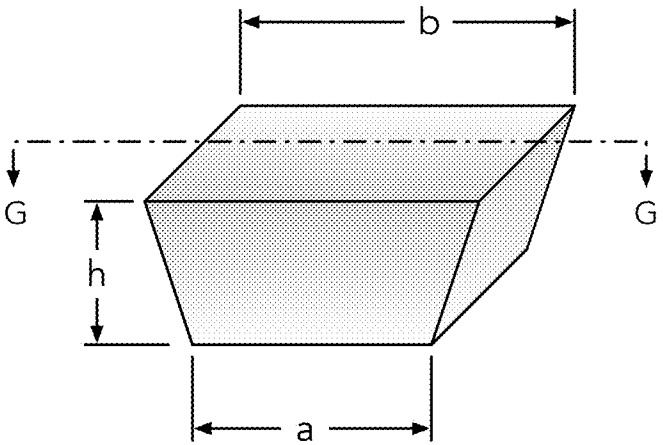
FIG. 6A is an isometric view of an embodiment of a DeFuzer cell.

FIG. 6A is an isometric view of an embodiment of a DeFuzer cell that has an inverted and truncated pyramid shape. The cell has a thickness of "h", which ranges from a millimeter to 7 millimeters or more; an upper surface length and width of "b", which ranges from a millimeter to 7 millimeters or more; and a lower surface length and width of "a", which ranges from 40% to 98% of "b". Note that a DeFuzer cell is analogous to a defusing cell, which are used interchangeably herein.

FIG. 6B is a crosscut section view of an embodiment of the DeFuzer cell of FIG. 6A. In this figure, the lower surface is in the direction of the ground and receives a ground reaction force. Within the cell, the ground reaction force (GRF) includes a y-force component (Fy) and an x-force component (Fx). In equation form, $Fy=GRF*\sin(\varphi)$ and $Fx=GRF*\cos(\varphi)$, where $\varphi$ is the side angle of the cell. As shown, $\varphi=\tan(g/h)$.

Note that the upper and lower surface may have other shapes than a square as shown. For example, the upper and lower surfaces have a rectangular shape. Further note that the perimeter of the top surface is larger than the perimeter of the bottom surface. The surface area of the top surface and bottom surface regarding less of whether it is open or enclosed, is the area within the perimeter of the top or bottom surface. Still further note that the perimeter of the top surface for the defusing cell of FIG. 6B is 4 times the dimension b and the perimeter for the bottom surface is 4 times dimension a. Still further note that the area of the top surface for the defusing cell of FIG. 6B is dimension b squared and the area for the bottom surface is dimension a squared.

Figure 6D:
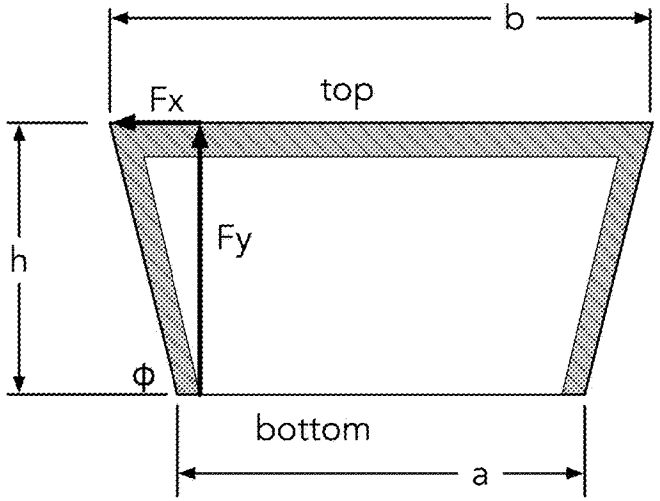
FIG. 6D is a crosscut section view of another embodiment of the DeFuzer cell of FIG. 6A.
Figure 6C:
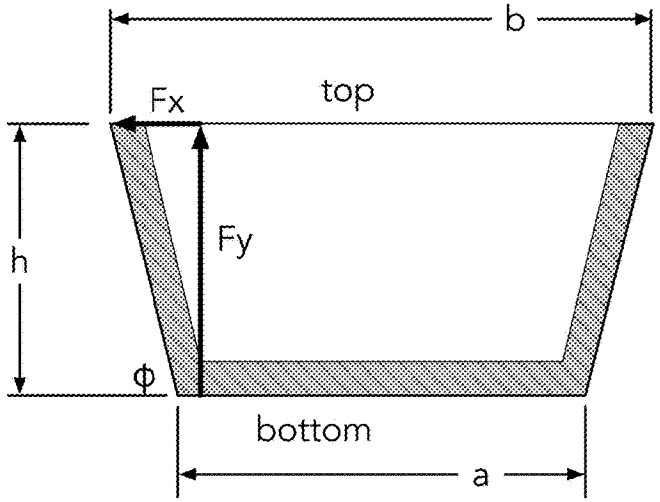
FIG. 6C is a crosscut section view of another embodiment of the DeFuzer cell of FIG. 6A.

FIG. 6C is a crosscut section view of another embodiment of the DeFuzer cell of FIG. 6A. In this embodiment of a cell, the upper surface is open, where, in FIG. 6B it was enclosed.

Note that, for all of the DeFuzer cells discussed herein, the thickness of the walls, upper, and/or lower level depends on the overall size of the DeFuzer cell and the material of the DeFuzer cell. For example, the thickness ranges from a fraction of a millimeter to one or more millimeters. For further description of DeFuzer cells refer to U.S. Pat. No. 10,653,193.

FIG. 6D is a crosscut section view of another embodiment of the DeFuzer cell of FIG. 6A. In this embodiment of a cell, the lower surface is open (i.e., the bottom side).

Figure 6E:
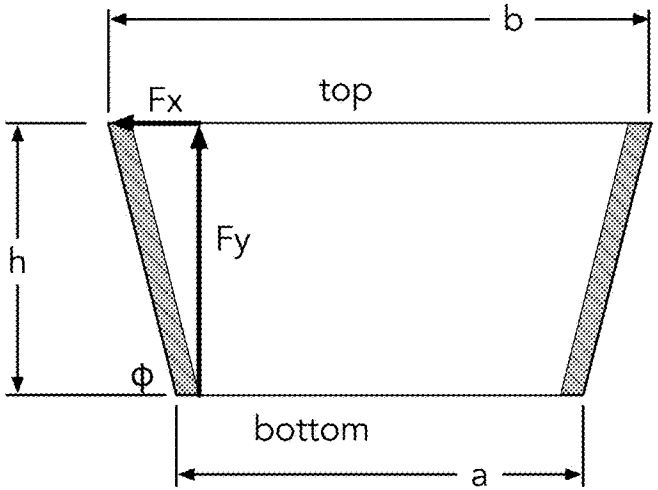
FIG. 6E is a crosscut section view of another embodiment of the DeFuzer cell of FIG. 6A.

FIG. 6E is a crosscut section view of another embodiment of the DeFuzer cell of FIG. 6A. In this embodiment of a cell, the upper surface and the lower surface are open.

Figure 7D:
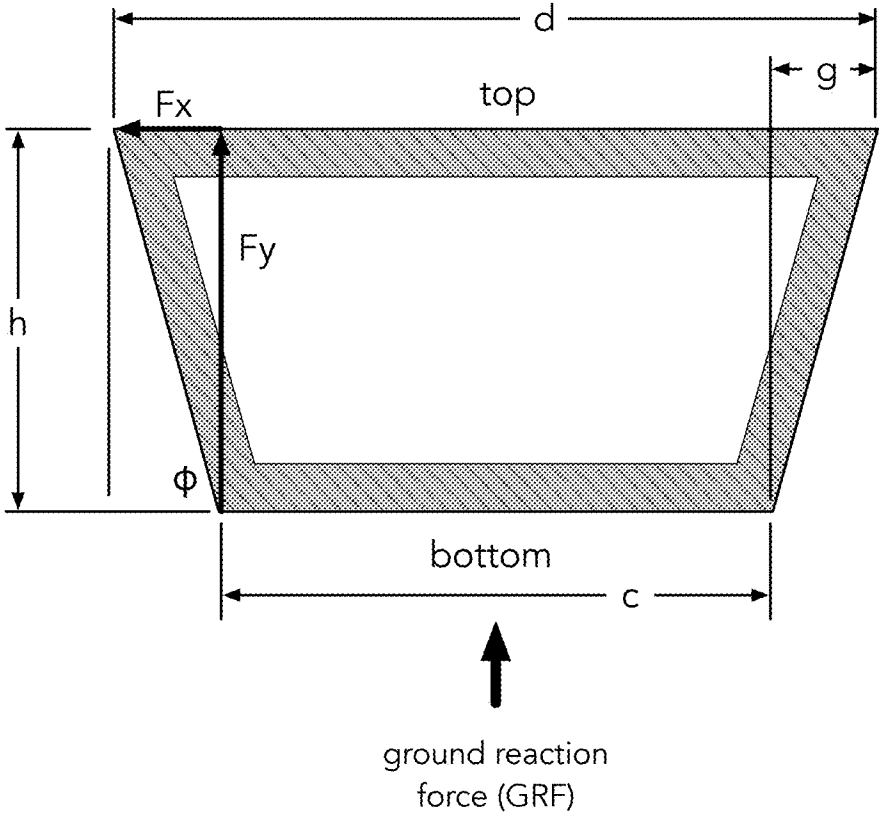
FIG. 7D is a crosscut section view of an embodiment of the DeFuzer cell of FIG. 7A.
Figure 7A:
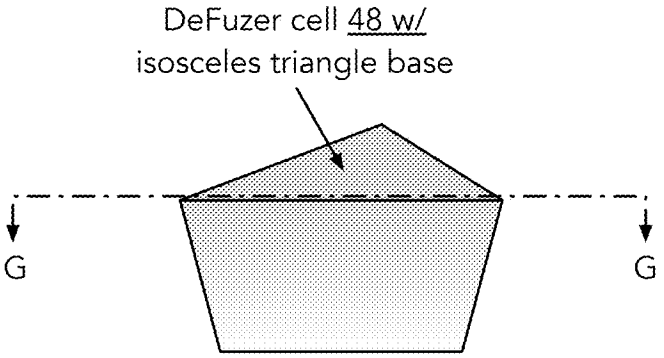
FIG. 7A is an isometric view of another embodiment of a DeFuzer cell.

FIG. 7A is an isometric view of another embodiment of a DeFuzer cell. This DeFuzer cell has a triangular shape for the upper and lower surfaces.

Figure 7C:
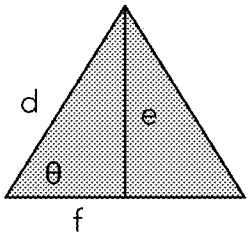
FIG. 7C is a top view of the DeFuzer cell of FIG. 7A.
Figure 7B:
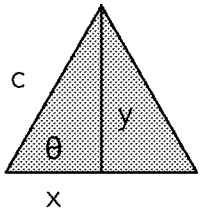
FIG. 7B is a bottom view of the DeFuzer cell of FIG. 7A.

FIG. 7B is a bottom view of the DeFuzer cell of FIG. 7A. The lower surface triangle has a side length of "c", an angle of "θ", a base of "2*x", and a height of "y". In equation form $c^2=x^2+y^2$; and $\theta=\cos^{-1}(x/c)$.

FIG. 7C is a top view of the DeFuzer cell of FIG. 7A. The upper surface triangle has a side length of "d", an angle of "θ", a base of "2*f", and a height of "e". In equation form $d^2=e^2+f^2$; and $\theta=\cos^{-1}(f/d)$.

FIG. 7D is a crosscut section view of an embodiment of the DeFuzer cell of FIG. 7A, which has the upper and lower surfaces enclosed. In this figure, the lower surface is in the direction of the ground and receives a ground reaction force. Within the cell, the ground reaction force (GRF) includes a y-force component (Fy) and an x-force component (Fx). In equation form, $Fy=GRF*\cos(\varphi)$ and $Fx=GRF*\sin(\varphi)$, where φ is the side angle of the cell. As shown, $\varphi=\tan^{-1}(g/h)$. Note that one or more of the upper and lower surfaces may be open as shown in FIGS. 6C-6E.

Figure 7E:
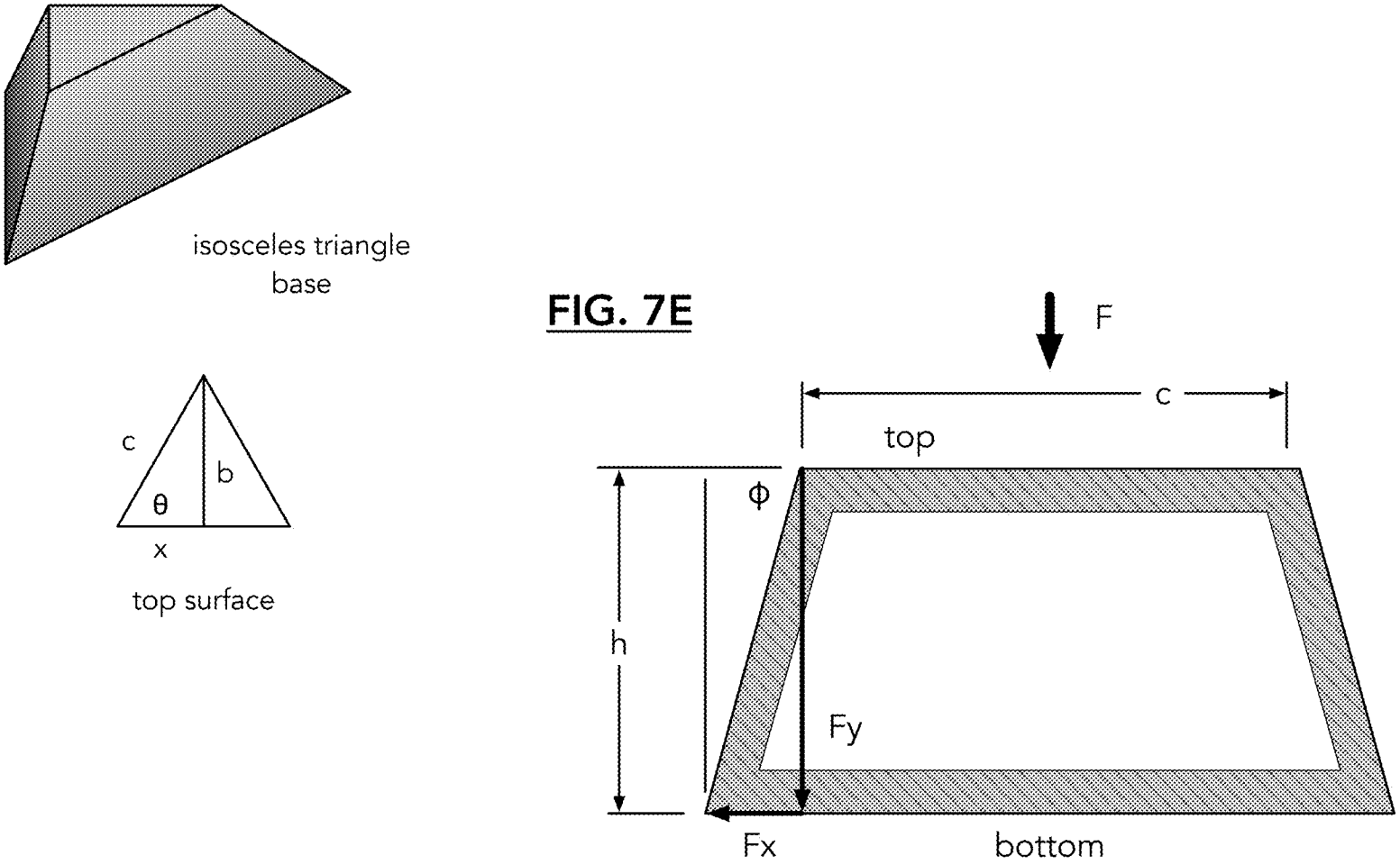
FIG. 7E is a diagram illustrating geometry properties and/or trigonometry properties of an embodiment of a DeFuzer cell.

FIG. 7E is a diagram illustrating geometry properties and/or trigonometry properties of an embodiment of a DeFuzer cell. In this embodiment, the top and bottom surface shape is an Isosceles triangle. The force F is applied to the top surface and is represented by a y-component Fy and an x-component Fx.

Figure 8B:
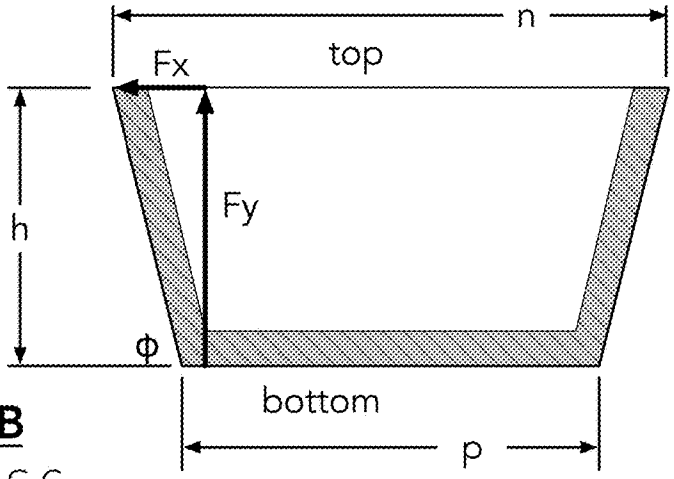
FIG. 8B is a crosscut section view of an embodiment of the DeFuzer cell of FIG. 8A.
Figure 8C:
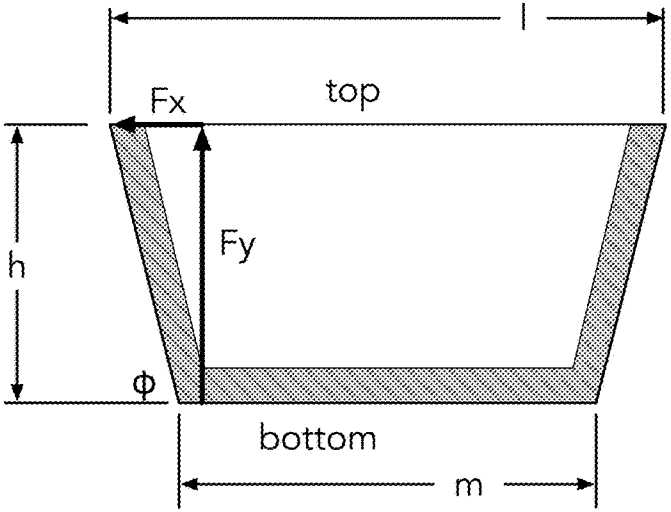
FIG. 8C is another crosscut section view of an embodiment of the DeFuzer cell of FIG. 8A.
Figure 8A:
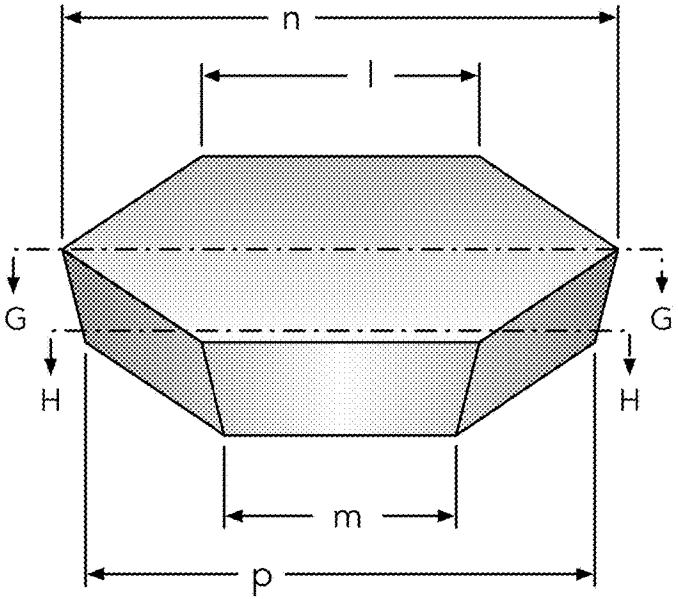
FIG. 8A is an isometric view of another embodiment of a DeFuzer cell.

FIG. 8A is an isometric view of another embodiment of a DeFuzer cell. In this embodiment, the upper and lower surfaces have a hexagon shape. The upper surface has a side length of "l" and an overall width of "n". The lower surface has a side length of "m" and an overall width of "p".

FIG. 8B is a crosscut section view of an embodiment of the DeFuzer cell of FIG. 8A. This crosscut is regarding the overall width of the cell, where the upper surface has the width of "n" and the lower surface has a width of "p". The height of the cell is "h" and the angle of the side walls is θ. When a ground reaction force is applied to the lower surface, the force traverses through the cell as represented by the y-component Fy and the x-component Fx.

FIG. 8C is another crosscut section view of an embodiment of the DeFuzer cell of FIG. 8A. This crosscut is regarding the width of a cell at its edge, where the upper surface has the width of "l" and the lower surface has a width of "m". The height of the cell is "h" and the angle of the side walls is θ. When a ground reaction force is applied to the lower surface, the force traverses through the cell as represented by the y-component Fy and the x-component Fx. Note the cell may be fully enclosed as shown in FIG. 6B, or with both surfaces open as shown in FIG. 6E.

Figure 9:
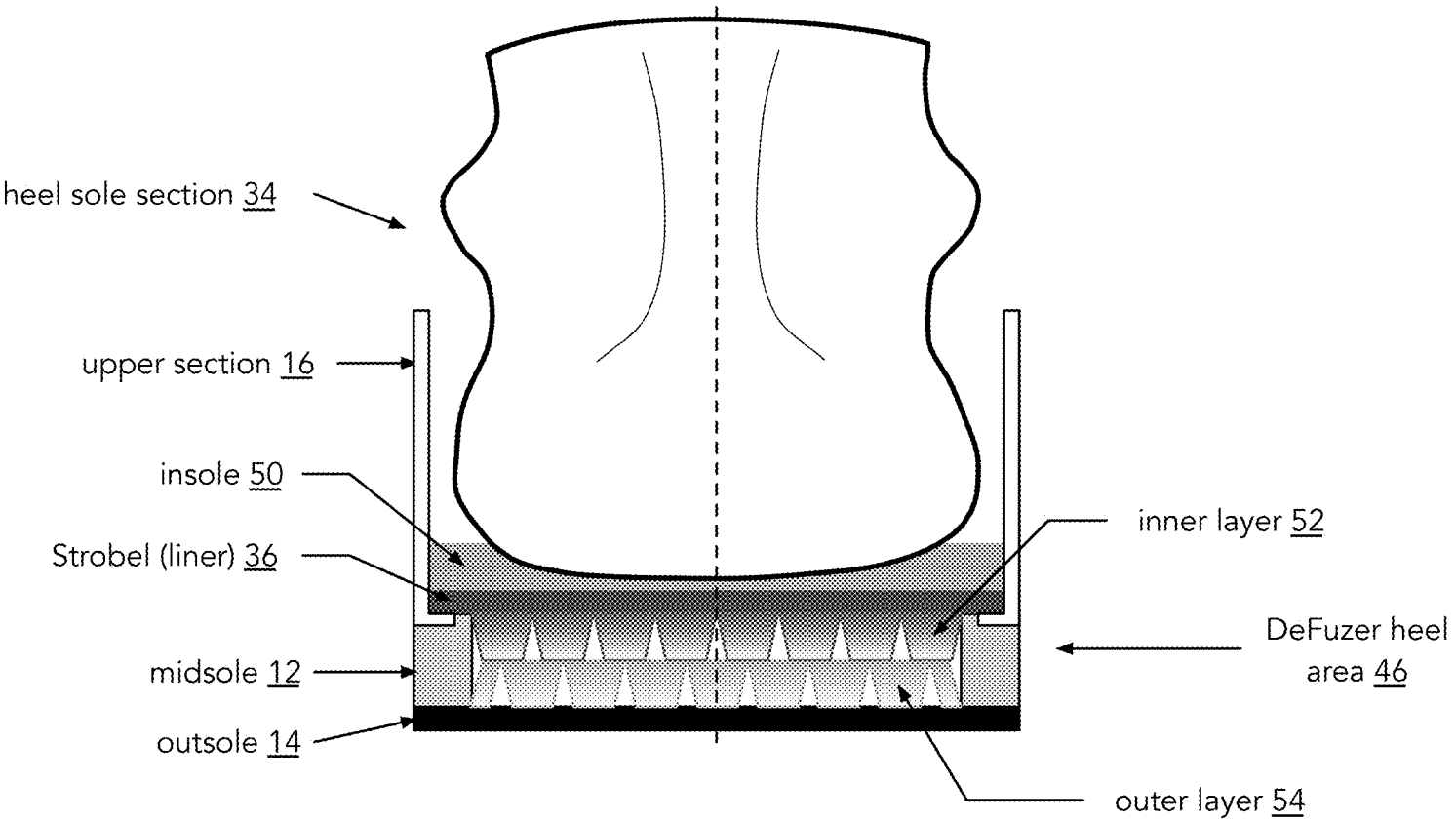
FIG. 9 is a crosscut section view of an embodiment of a heel sole section of a shoe.

FIG. 9 is a crosscut section view of an embodiment of a heel sole section 34 of a shoe from a heel view. The heel sole section 34 includes a DeFuzer heel section 46, the heel portion of the upper section 16, the heel portion of an insole 50, the heel portion of a liner (Strobel) 36, a heel portion of the midsole 12, and a heel portion of the outsole 14. The DeFuzer heel section 46 includes a red inner layer 52 of cells (closest to the foot) and a blue outer layer 54 of cells (furthest from the foot).

The cells of each layer 52 and 54 has a shape described in one or more of FIGS. 6A through 8C. In an embodiment, the size and shapes of the cells of each layer are the same. For example, the cells have an Isosceles triangle shape, a height of 7 millimeters, a side wall angle of 75 degrees, and an upper width of 12 millimeters. In other embodiments, the dimensions of the cells may significantly vary from the dimensions in this embodiment; from cell to cell, the shapes and/or dimensions may be different; and/or the cells of one layer may be different shapes and/or sizes than the cells in the other layer.

With an angle of 75 degrees, the y force component Fy is GRF*sin(75), which equals 0.966*GRF. As such, in two layers, Fy is 0.93*GRF, which is only a reduction of force transfer in the y-direction by only 6.7%. Thus, a majority of the ground reaction force interacts with the body of the wearer of the shoes.

With the dimensions of this example of an Isosceles triangle, the upper surface of a cell has an area of is about 62 $mm^2$ and the lower surface of a cell has an area of about 51 $mm^2$. As such, the upper surface is about 120% larger than the lower surface. For two layers, the effective upper surface is about 144% larger than the effective lower surface. With these values, the pressure on the foot (which is the Force divided by area) is reduce by 0.96/1.44, which equals 0.64. Thus, the pressure is reduced by 36%, with only loss of 6.7% of the force.

By adjusting the angle and height, a desired balance of reduction in pressure to force transfer loss in the y-direction can be achieved. For example, decreasing the angle or increasing the height of the above example, reduces pressure and increases the loss in the y-direction. For high performance athletic shoes, it would be desirable to reduce the loss and accept less pressure reduce. For more causal athletic shoes, comfort is enhanced by reducing pressure and accepting more force transfer loss.

Figure 10:
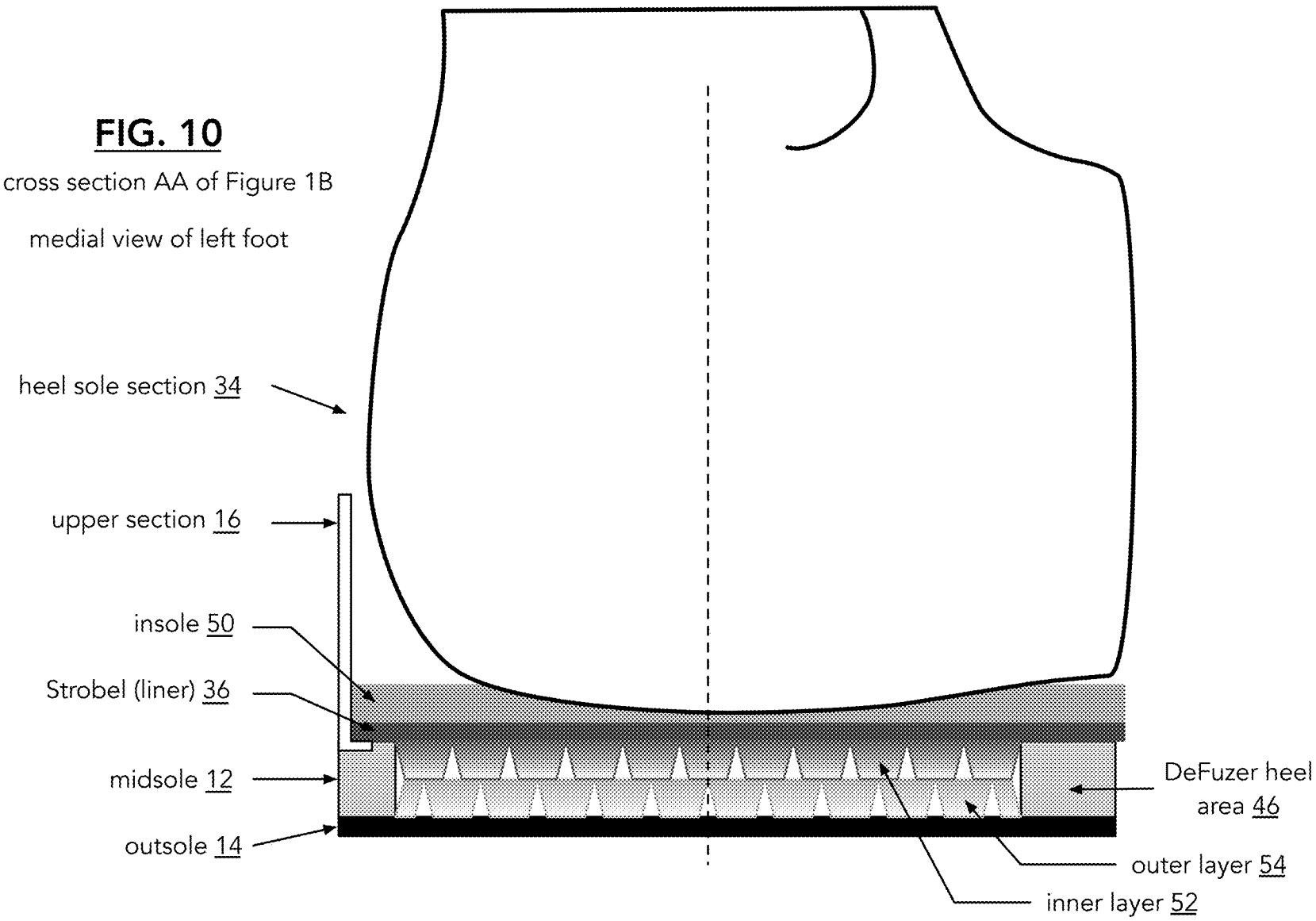
FIG. 10 is another crosscut section view of an embodiment of a heel sole section of a shoe.

FIG. 10 is another crosscut section view of an embodiment of a heel sole section of a shoe from a side view. The heel sole section 34 includes a DeFuzer heel section 46, the heel portion of the upper section 16, the heel portion of an insole 50, the heel portion of a liner (Strobel) 36, a heel portion of the midsole 12, and a heel portion of the outsole 14. The DeFuzer heel section 46 includes a red inner layer 52 of cells (closest to the foot) and a blue outer layer 54 of cells (furthest from the foot).

Figures 11A, 11B:
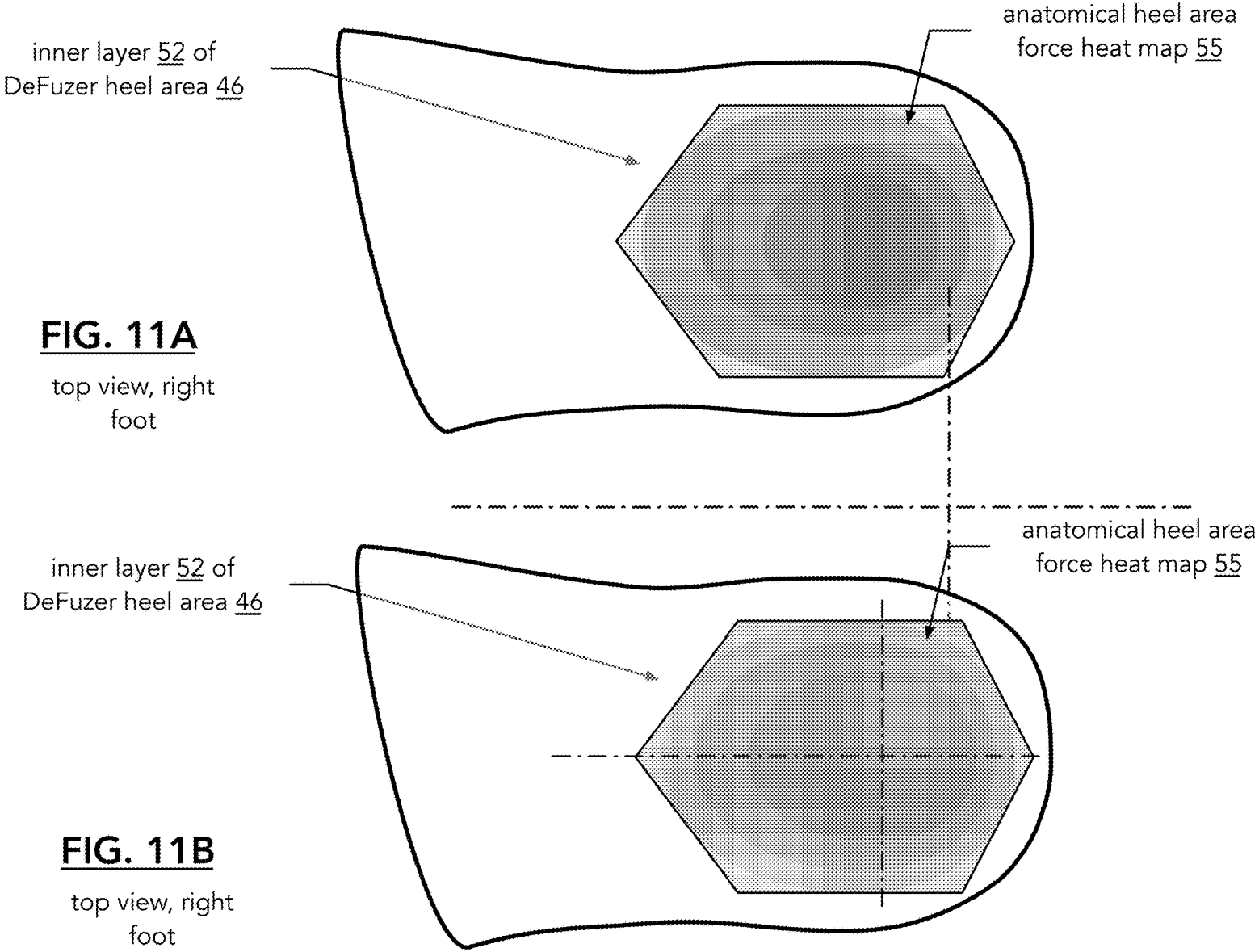
FIG. 11A is a diagram of an example of a heel area force heat map of a heel sole section of a shoe.
FIG. 11B is a diagram of another example of a heel area force heat map of a heel sole section of a shoe.

FIG. 11A is a diagram of an example of a heel area force heat map of a heel sole section of a shoe regarding impact forces applied by the body just as the foot is making contact with the ground. As the foot (through the shoe) makes contact with the ground, the ground reaction force pushes back on the shoe. Through the DeFuzer heel section 46, pressure is reduced with minimal loss of force. FIG. 11B illustrates a heel area force heat map as result of the force manipulations through the DeFuzer heel section.

Figure 12A:
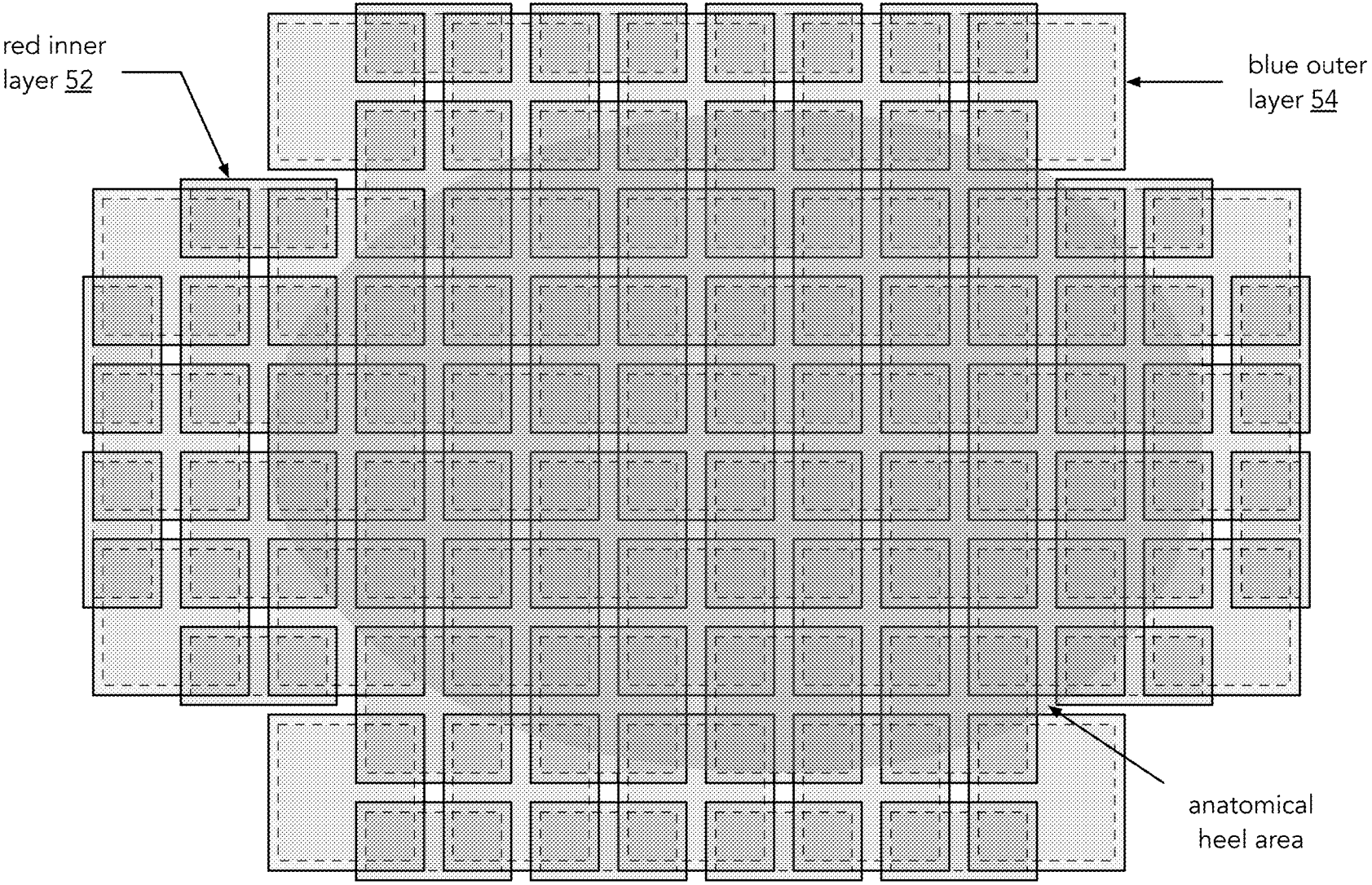
FIG. 12A is a top view diagram of an embodiment of a heel sole section that includes a red inner layer of DeFuzer cells and a blue outer layer of DeFuzer cells.

FIG. 12A is a top view diagram of an embodiment of a heel sole section that includes a red inner layer of DeFuzer cells 52 (closer to the foot) and a blue outer layer of DeFuzer cells 54 (closer to the ground). The anatomical heel area is centered within the heel DeFuzer section 46, which includes the inner layer 52 and outer layer 54.

As shown, a cell of the inner layer within the anatomical heel area interacts with four cells of the lower layer. As such, pressure from the ground reaction force is distributed among the cells of the layer as will described in greater detail with reference to one or more subsequent figures.

Figure 12B:
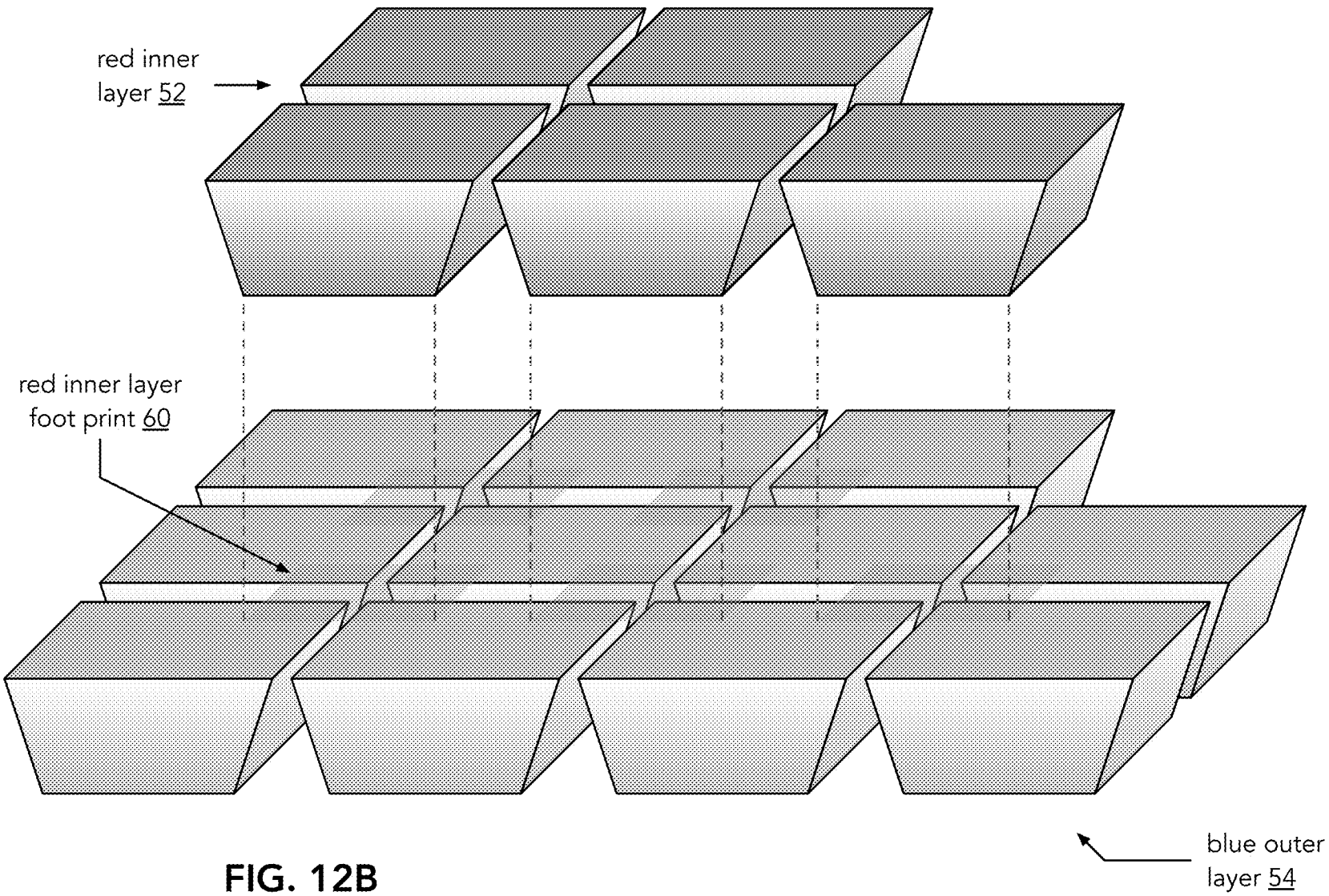
FIG. 12B is an isometric view diagram of an embodiment of a heel sole section that includes a red inner layer of DeFuzer cells and a blue outer layer of DeFuzer cells.

FIG. 12B is an isometric view diagram of an embodiment of a heel sole section 46 that includes a red inner layer of DeFuzer cells and a blue outer layer of DeFuzer cells. The figure further illustrates how one cell from the inner layer interacts with four cells of the outer layer 54 as represented by the inner layer foot print 60.

Figure 13:
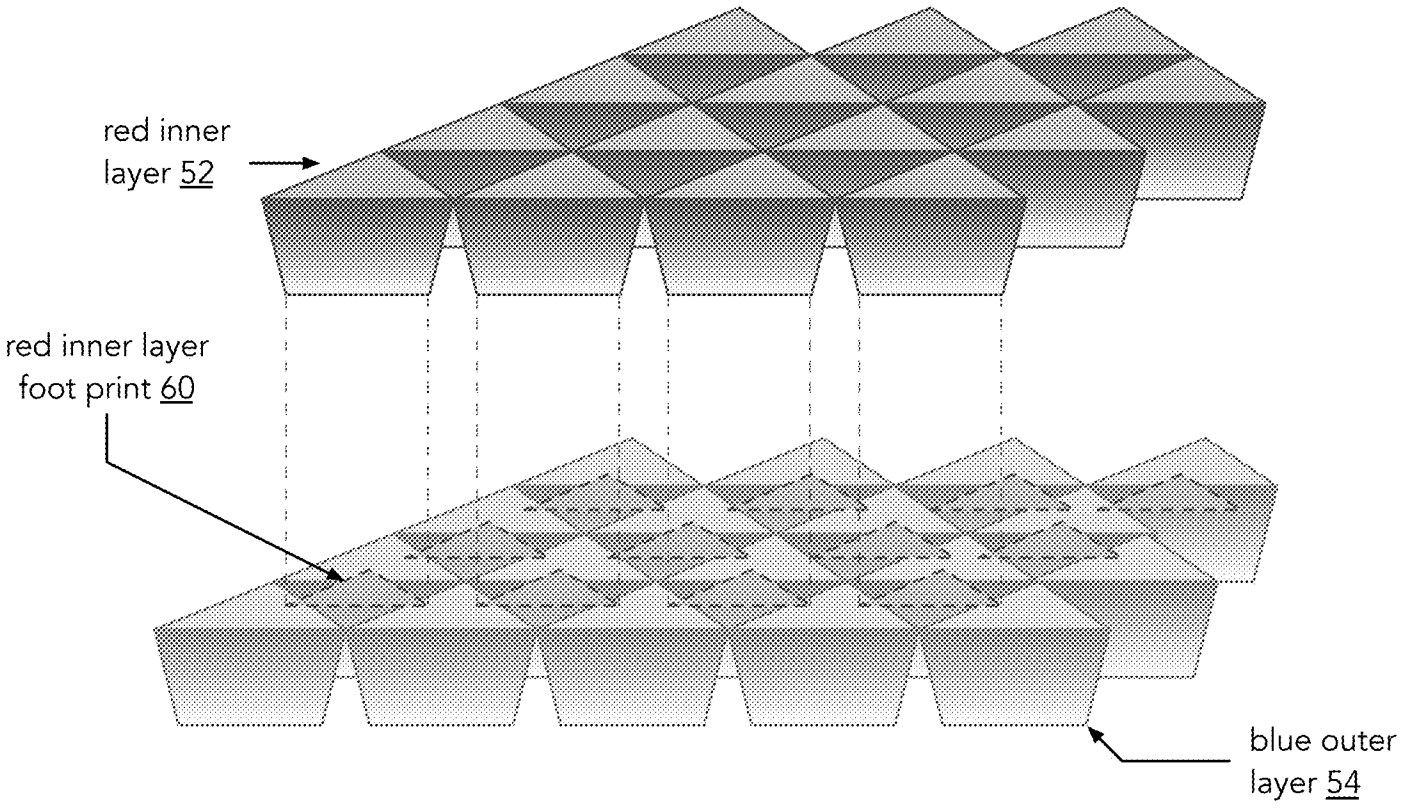
FIG. 13 is an isometric view diagram of another embodiment of a heel sole section that includes a red inner layer of DeFuzer cells and a blue outer layer of DeFuzer cells.

FIG. 13 is an isometric view diagram of another embodiment of a heel sole section that includes a red inner layer of DeFuzer cells and a blue outer layer of DeFuzer cells. In this embodiment, the cells of both layers have a triangular base shape. In this example, a cell from the inner layer 52 interacts with three cells of the outer layer 54 as represented by the inner layer foot print 60.

Figure 14A:
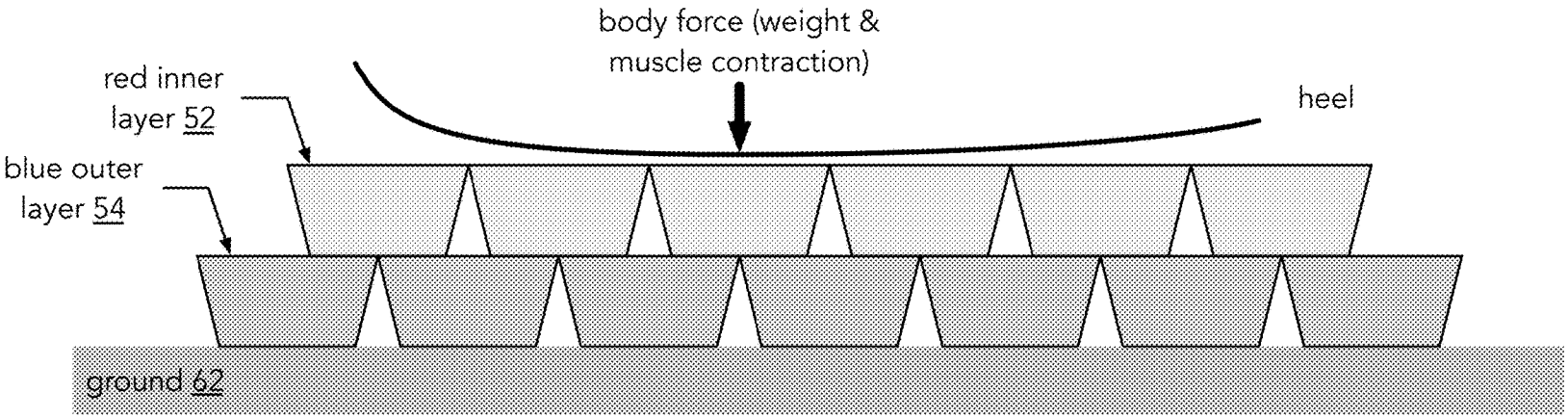
FIG. 14A is medial side view of an example of a heel sole section that includes a red inner layer of DeFuzer cells and a blue outer layer of DeFuzer cells as a body force is applied.

FIG. 14A is medial side view of an example of a heel sole section that includes a red inner layer of DeFuzer cells 52 and a blue outer layer of DeFuzer cells 54 as a body force is applied via the ground 62.

Figure 14B:
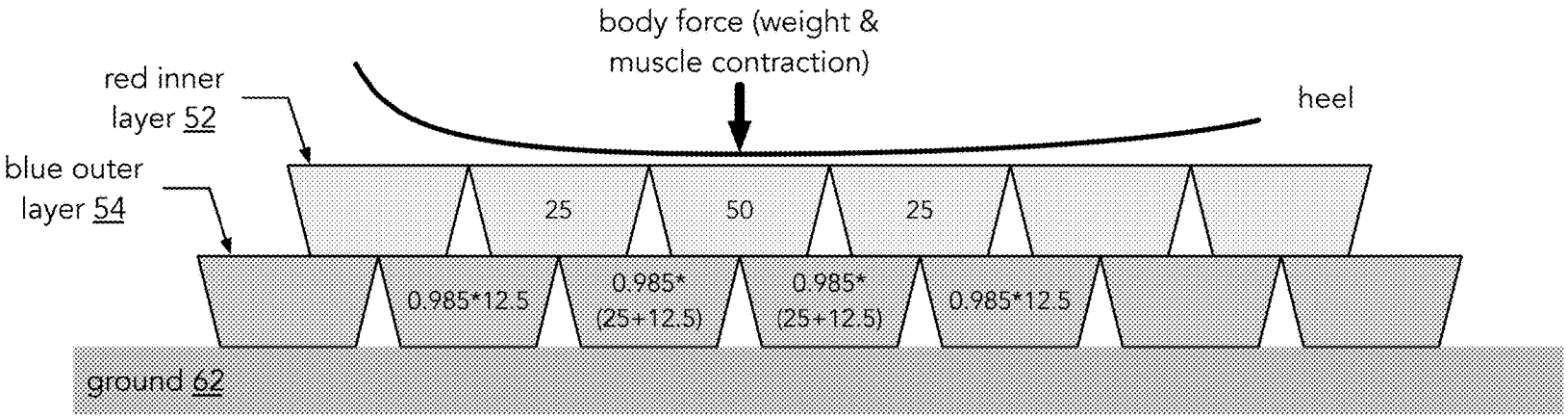
FIG. 14B is medial side view of a heel sole section in furtherance of the example of FIG. 14A.

FIG. 14B is medial side view of a heel sole section in furtherance of the example of FIG. 14A. In this example, the body force is just being applied as the shoe makes contact with the ground. The example assumes that 50% of the body force is applied to the center cell of the inner layer; 25% of the body force is applied to a cell to the left of the center cell; and 25% of the body force is applied to a cell to the right of the center cell. This example also assumes that the angle of the sides of the cells is 80 degrees. This means that 98.5% of the body force applied to a cell is coupled in the Y-direction (e.g., from foot to ground, which is perpendicular to the ground).

As shown, half of 98.5% impact force of the center cell of the inner layer is provided to two outer level cells below it. Similarly, half of 98.5% impact force of each of the other impacted is provided to two outer level cells below it.

Figure 14C:
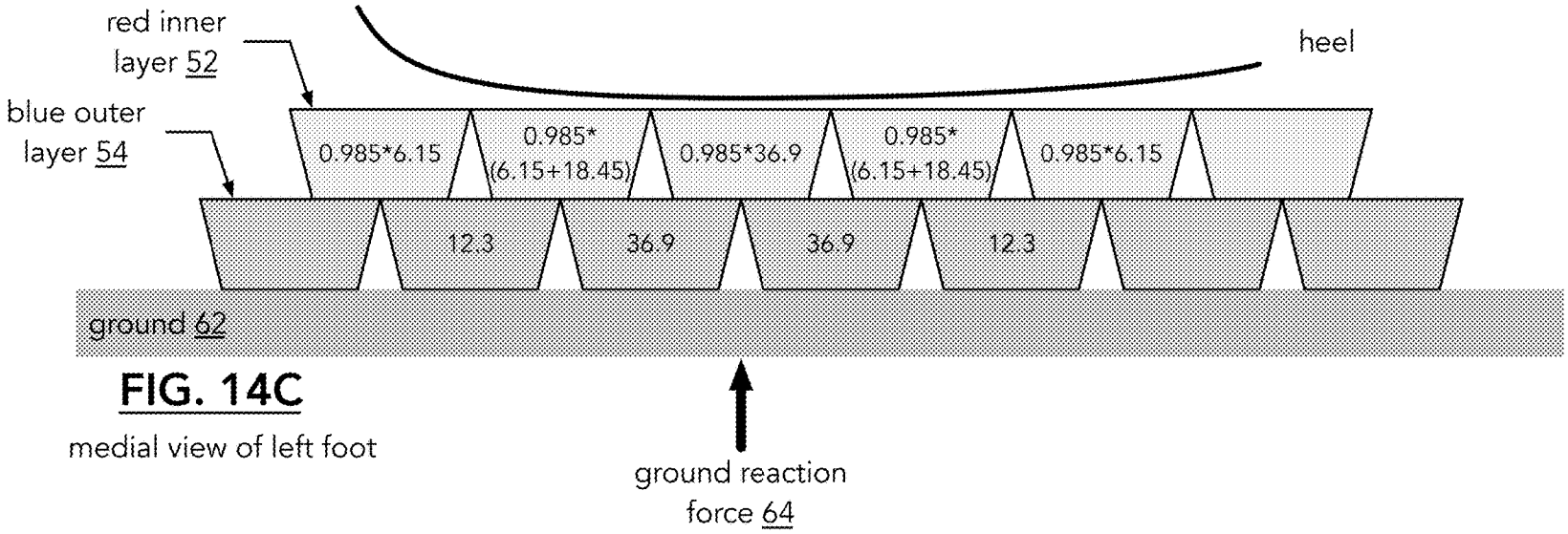
FIG. 14C is medial side view of a heel sole section in furtherance of the example of FIG. 14A.

FIG. 14C is medial side view of a heel sole section in furtherance of the example of FIG. 14A. In this figure, the ground is pushing back (i.e., the ground reaction force is applied back onto the shoe). In the four outer layer cells effected by the cells of the inner layer, their respective percentages of forces is written within the cell. Each of the four outer layer cells pushes on two inner layer cells. Five inner layer cells are now affected by forces based on the equations written within each of the cells.

Figure 14D:
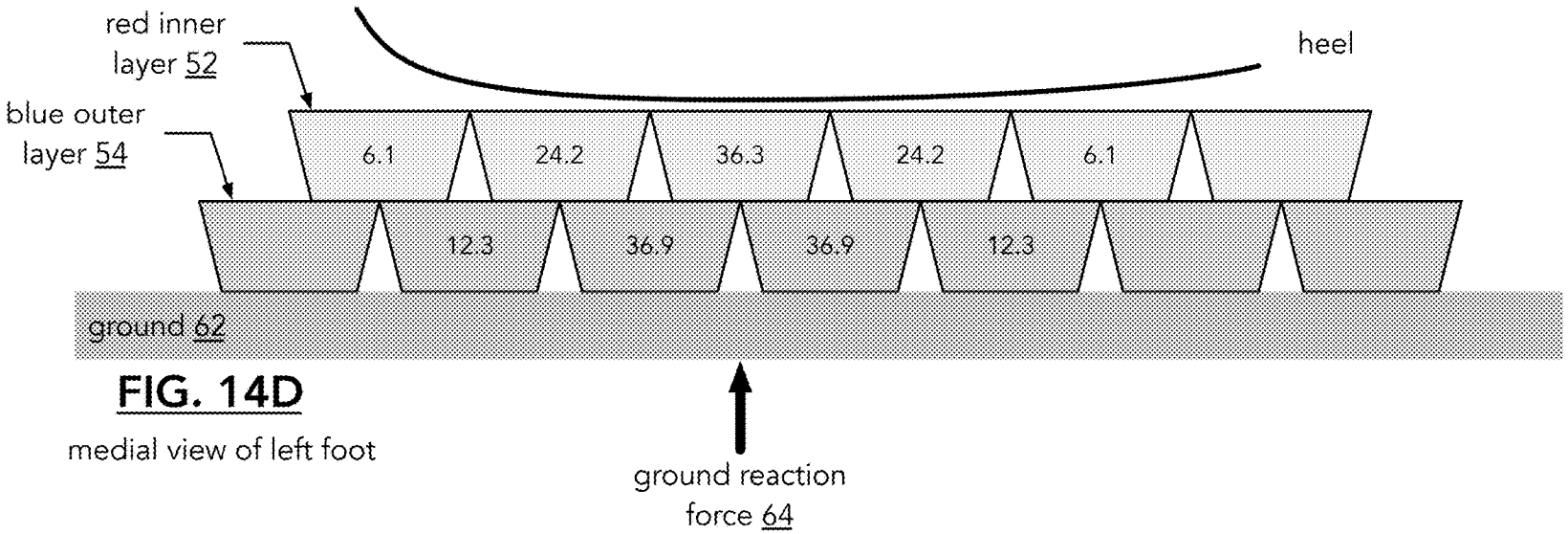
FIG. 14D is medial side view of a heel sole section in furtherance of the example of FIG. 14A.

FIG. 14D is medial side view of a heel sole section in furtherance of the example of FIG. 14A. In this example, the resulting force applied on the foot via the ground-body connection through the shoe with a DeFuzer heel section is shown in the cells. As shown, the center cell's force went from 50% to 36.3% and 12.2% of the force is now supported by two additional inner layer cells. As such, the impact pressure is reduced by about 40% in comparison to a rigid midsole/outsole combination.

Figure 15A:
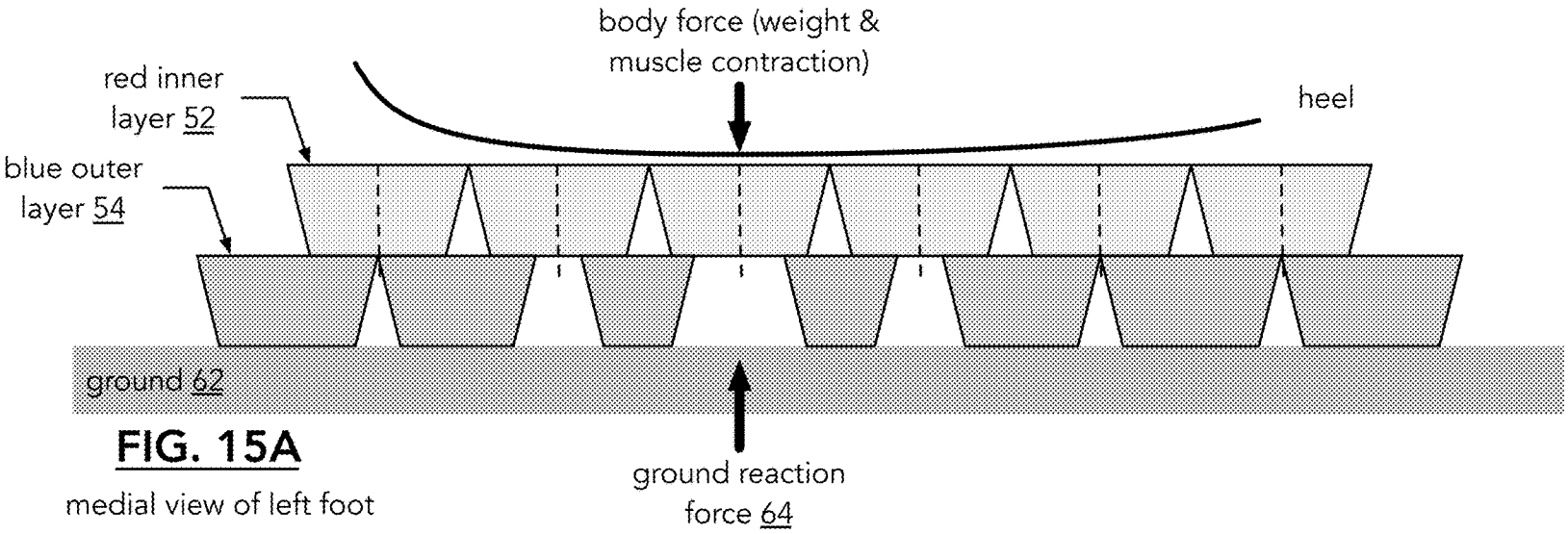
FIG. 15A is medial side view of another example of a heel sole section that includes a red inner layer of DeFuzer cells and a blue outer layer of DeFuzer cells as a body force is applied.

FIG. 15A is medial side view of another example of a heel sole section 46 that includes a red inner layer of DeFuzer cells 52 and a blue outer layer of DeFuzer cells 54 as a body force is applied via the ground 62. In this example, there is a gap between the cells of the outer layer below the center inner layer cell and a smaller gap between the next two cells of the outer layer.

Figure 15B:
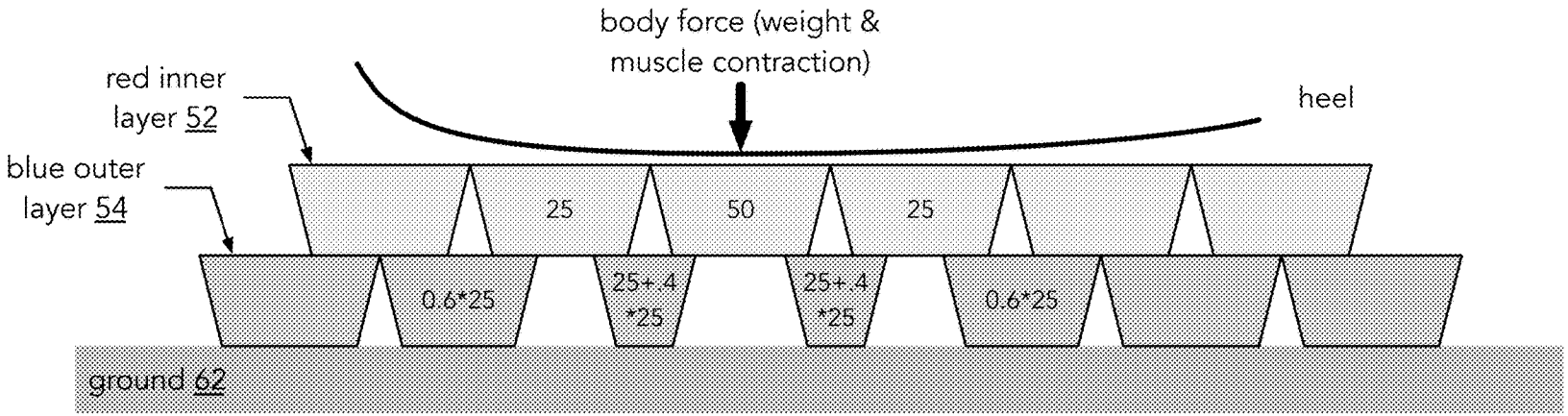
FIG. 15B is medial side view of a heel sole section in furtherance of the example of FIG. 15A.

FIG. 15B is medial side view of a heel sole section in furtherance of the example of FIG. 15A. This example assumes that 50% of the body force (e.g., body weight+force applied through muscle contraction) is applied to the center inner layer cell and 15% of the body force is applied to the two adjacent cells. As the force is applied to the outer layer, it is distributed among the cells of the outer layer. Each of the two center cells of the lower layer receives half of the 50% of the body force from the center inner layer cell and receives 40% of body force from the other two inner layer cells, respectively.

The two next cells in the outer layer receive 60% of the body force from the adjacent cells of the inner layer. As such, each of these cells receive 60% of 25% of the body force.

Figure 15C:
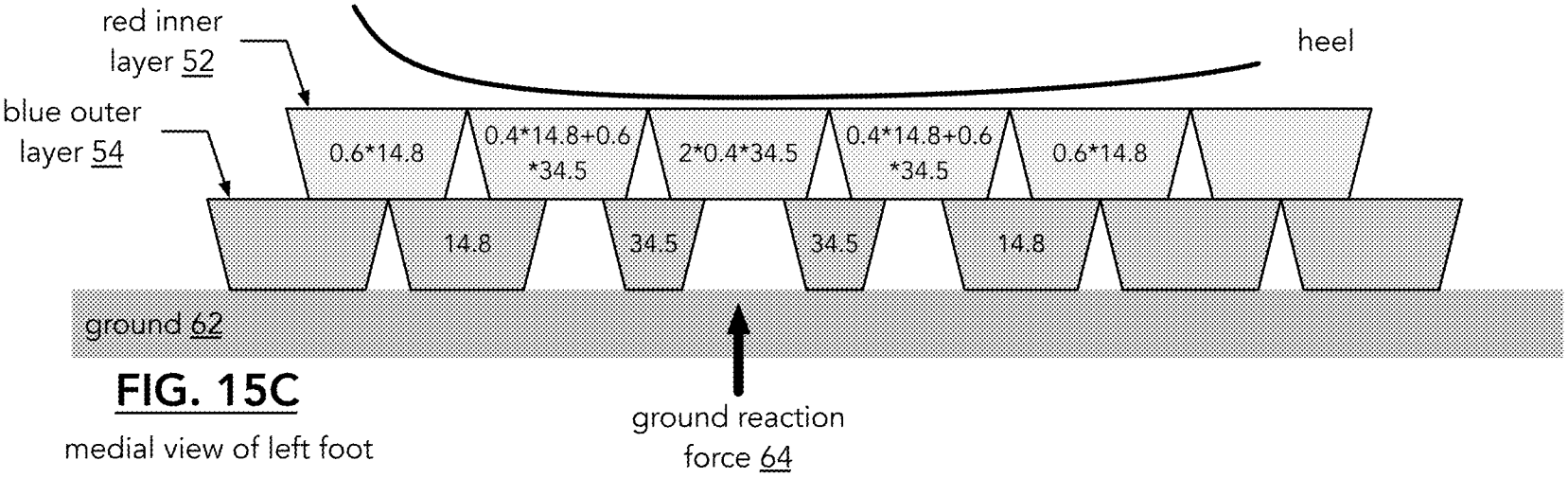
FIG. 15C is medial side view of a heel sole section in furtherance of the example of FIG. 15A.

FIG. 15C is medial side view of a heel sole section in furtherance of the example of FIG. 15A. In this figure, the ground is pushing back (i.e., the ground reaction force is applied back onto the shoe). In the four outer layer cells effected by the cells of the inner layer, their respective percentages of forces is written within the cell. Each of the four outer layer cells pushes on two inner layer cells. Five inner layer cells are now affected by forces based on the equations written within each of the cells.

Figure 15D:
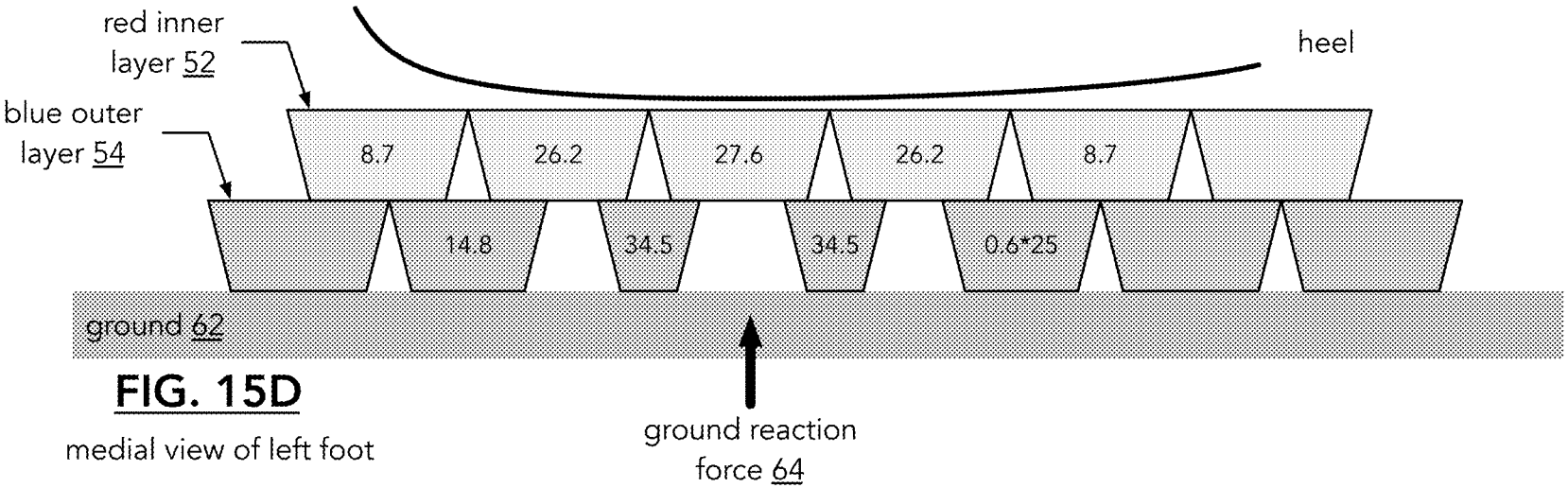
FIG. 15D is medial side view of a heel sole section in furtherance of the example of FIG. 15A.

FIG. 15D is medial side view of a heel sole section in furtherance of the example of FIG. 15A. In this example, the resulting force applied on the foot via the ground-body connection through the shoe with a DeFuzer heel section is shown in the cells. As shown, the center cell's force went from 50% to 27.6% and $1^{7}$0.4% of the force is now supported by two additional inner layer cells. As such, the impact pressure is reduced by about 45% in comparison to a rigid midsole/outsole combination.

Figure 16A:
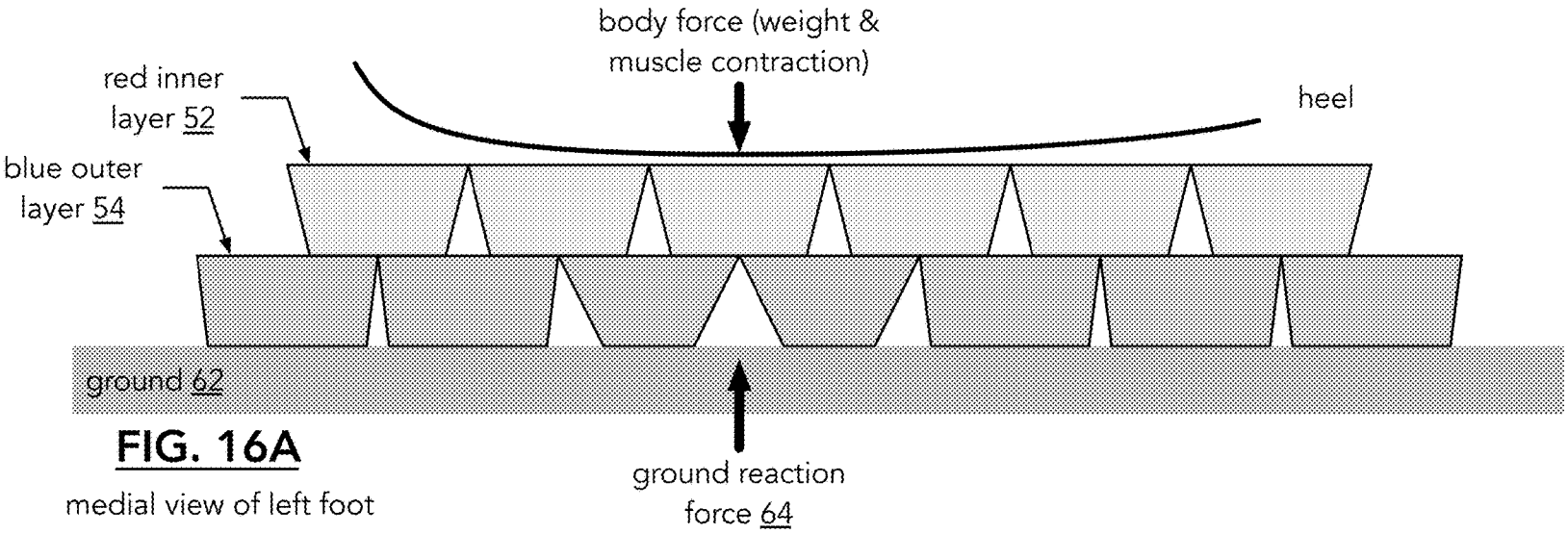
FIG. 16A is medial side view of another example of a heel sole section that includes a red inner layer of DeFuzer cells and a blue outer layer of DeFuzer cells as a body force is applied.

FIG. 16A is medial side view of another example of a heel sole section 46 that includes a red inner layer of DeFuzer cells 52 and a blue outer layer of DeFuzer cells 54 as a body force is applied via the ground 62. In this example, the angles of the two cells of the outer layer below the center cell of the inner layer and the angles of the center inner layer cell are different. For example, the cells under the center inner layer cell has an angle of 60 degrees and the other cells of the outer layer have an angle of 80 degrees. This reduces the force transferred between the cells and to the ground.

Figure 16B:
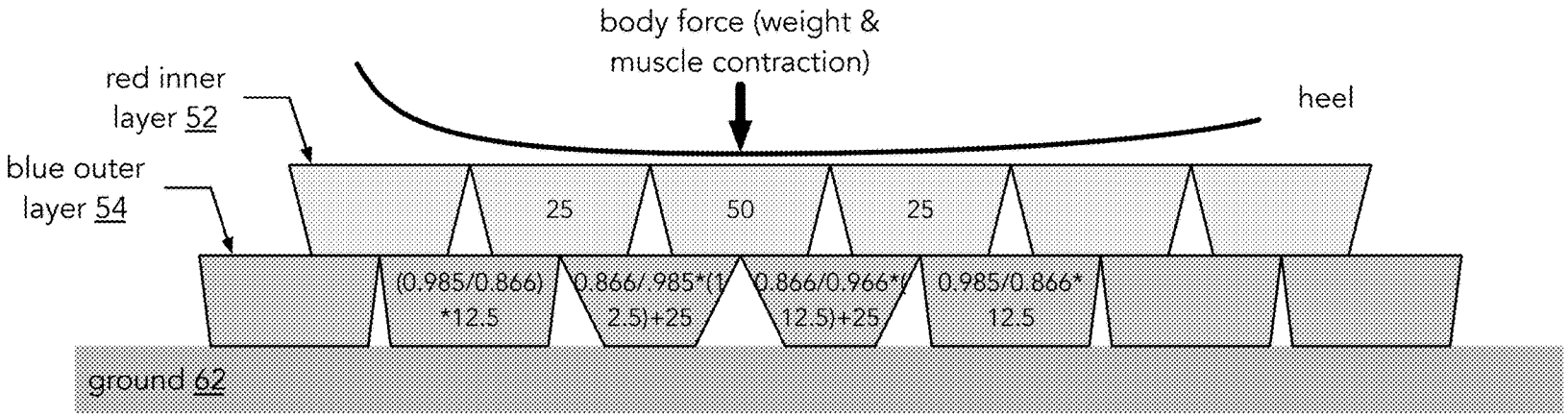
FIG. 16B is medial side view of a heel sole section in furtherance of the example of FIG. 16A.

FIG. 16B is medial side view of a heel sole section in furtherance of the example of FIG. 16A. This example assumes that 50% of the body force (e.g., body weight+force applied through muscle contraction) is applied to the center inner layer cell and 15% of the body force is applied to the two adjacent cells. As the force is applied to the outer layer, it is distributed among the cells of the outer layer. Each of the two center cells of the lower layer receives half of the 50% of the body force from the center inner layer cell and receives 44% of body force from the other two inner layer cells, respectively.

The two next cells in the outer layer receive 56% of the body force from the adjacent cells of the inner layer. As such, each of these cells receive 56% of 25% of the body force.

Figure 16C:
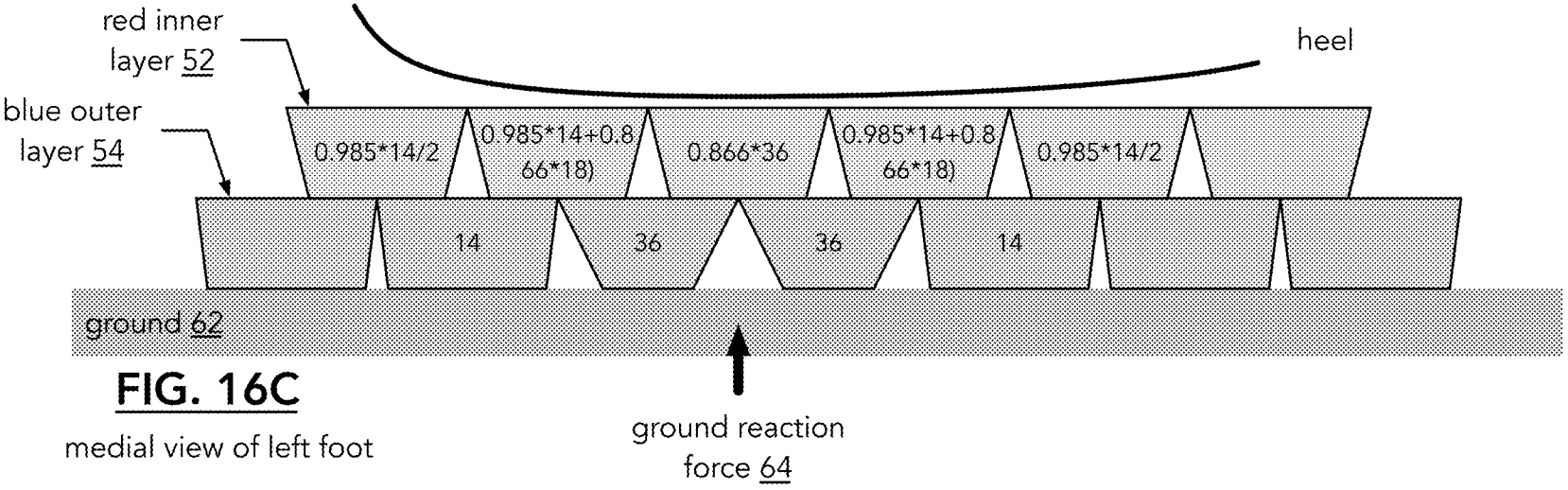
FIG. 16C is medial side view of a heel sole section in furtherance of the example of FIG. 16A.

FIG. 16C is medial side view of a heel sole section in furtherance of the example of FIG. 16A. In this figure, the ground is pushing back (i.e., the ground reaction force is applied back onto the shoe). In the four outer layer cells effected by the cells of the inner layer, their respective percentages of forces is written within the cell. Each of the four outer layer cells pushes on two inner layer cells. Five inner layer cells are now affected by forces based on the equations written within each of the cells.

Figure 16D:
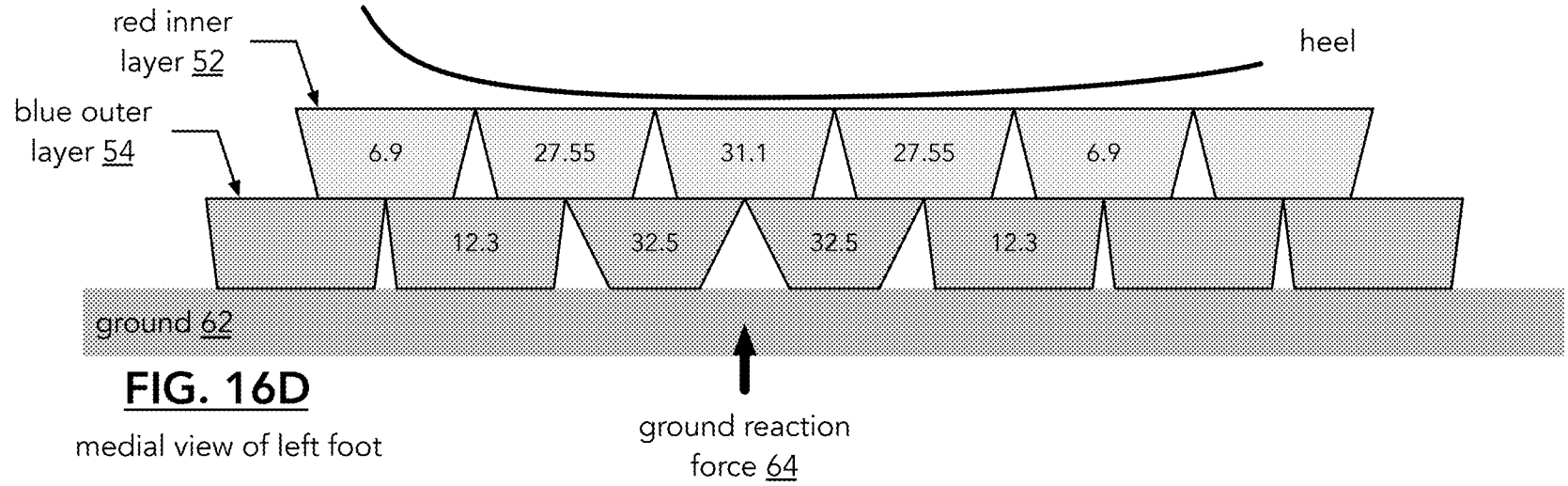
FIG. 16D is medial side view of a heel sole section in furtherance of the example of FIG. 16A.

FIG. 16D is medial side view of a heel sole section in furtherance of the example of FIG. 16A. In this example, the resulting force applied on the foot via the ground-body connection through the shoe with a DeFuzer heel section is shown in the cells. As shown, the center cell's force went from 50% to 31.1% and 13.8% of the force is now supported by two additional inner layer cells. As such, the impact pressure is reduced by about 40% in comparison to a rigid midsole/outsole combination.

One or more other embodiments of a DeFuzer heel section includes one or more combinations of the examples provided in FIGS. 14A through 16D.

Figure 17A:
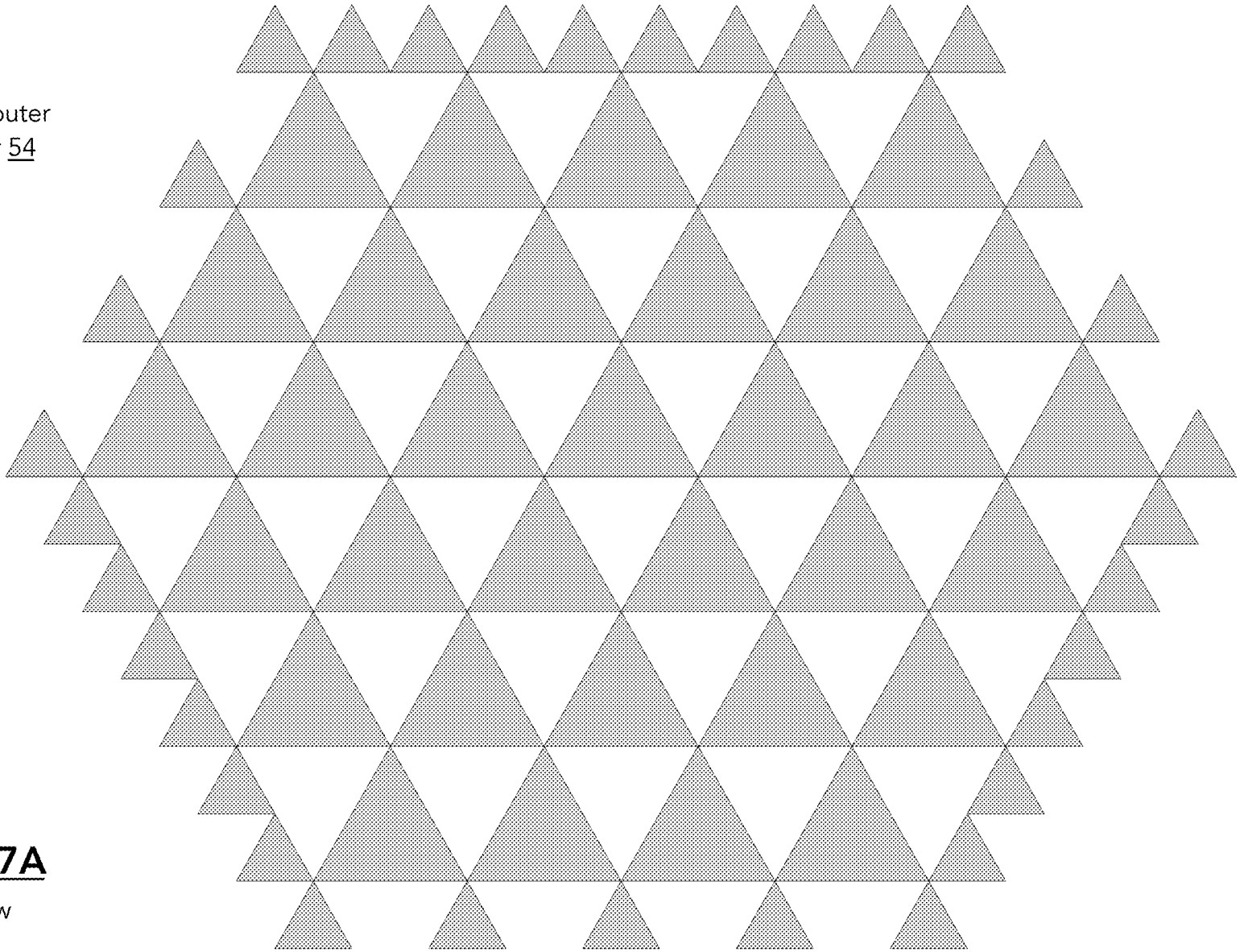
FIG. 17A is top view of an embodiment of a blue outer layer of a heel sole section.

FIG. 17A is top view of an embodiment of a blue outer layer 54 of a heel sole section 46, which includes a plurality of triangled shaped cells.

Figure 17B:
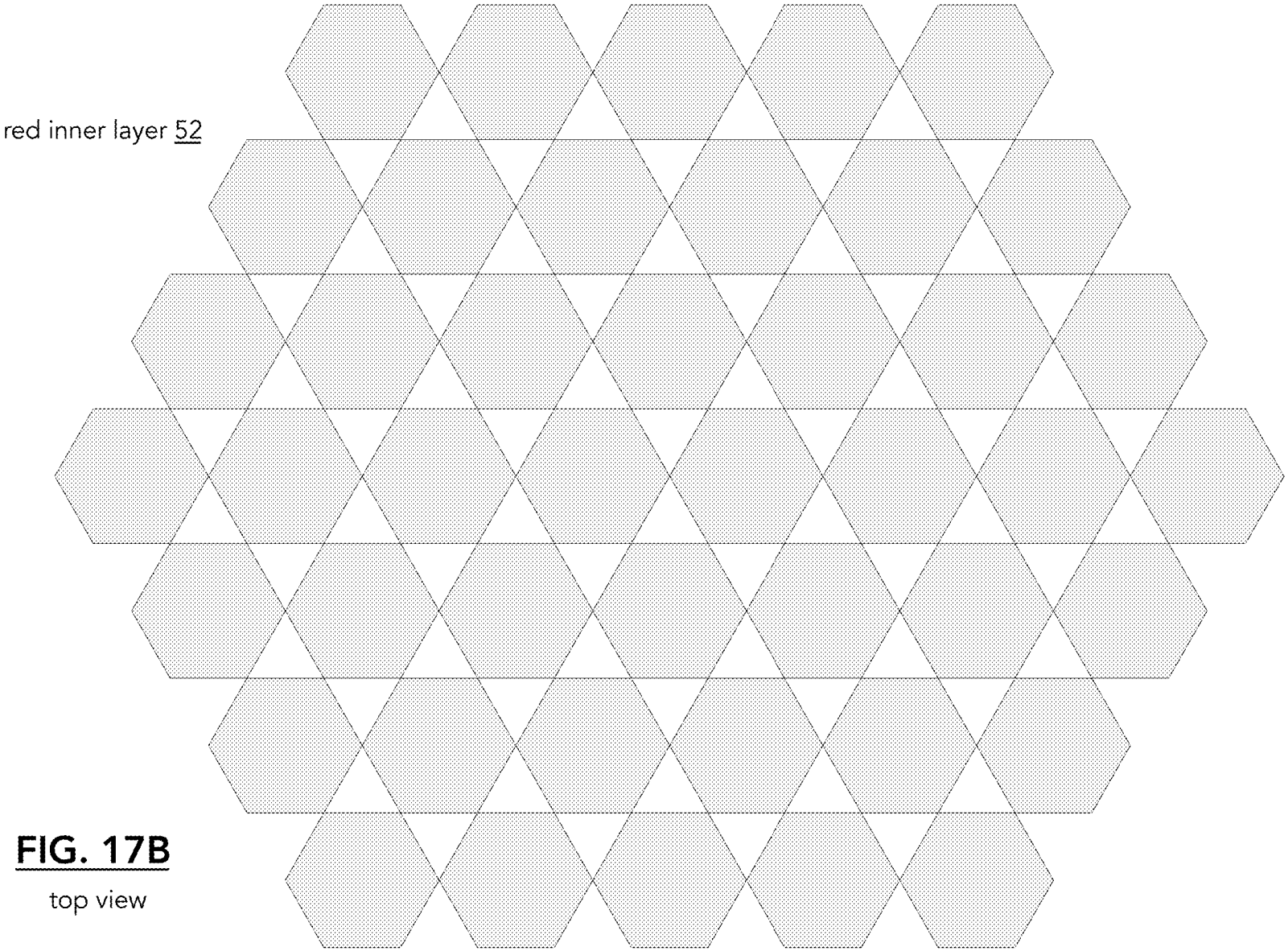
FIG. 17B is top view of an embodiment of a red inner layer of a heel sole section.

FIG. 17B is top view of an embodiment of a red inner layer 52 of a heel sole section 46, which includes a plurality of hexagon shaped cells. Note that the width and height of hexagon cell is similar to a larger triangular shaped outer layer cell.

Figure 17C:
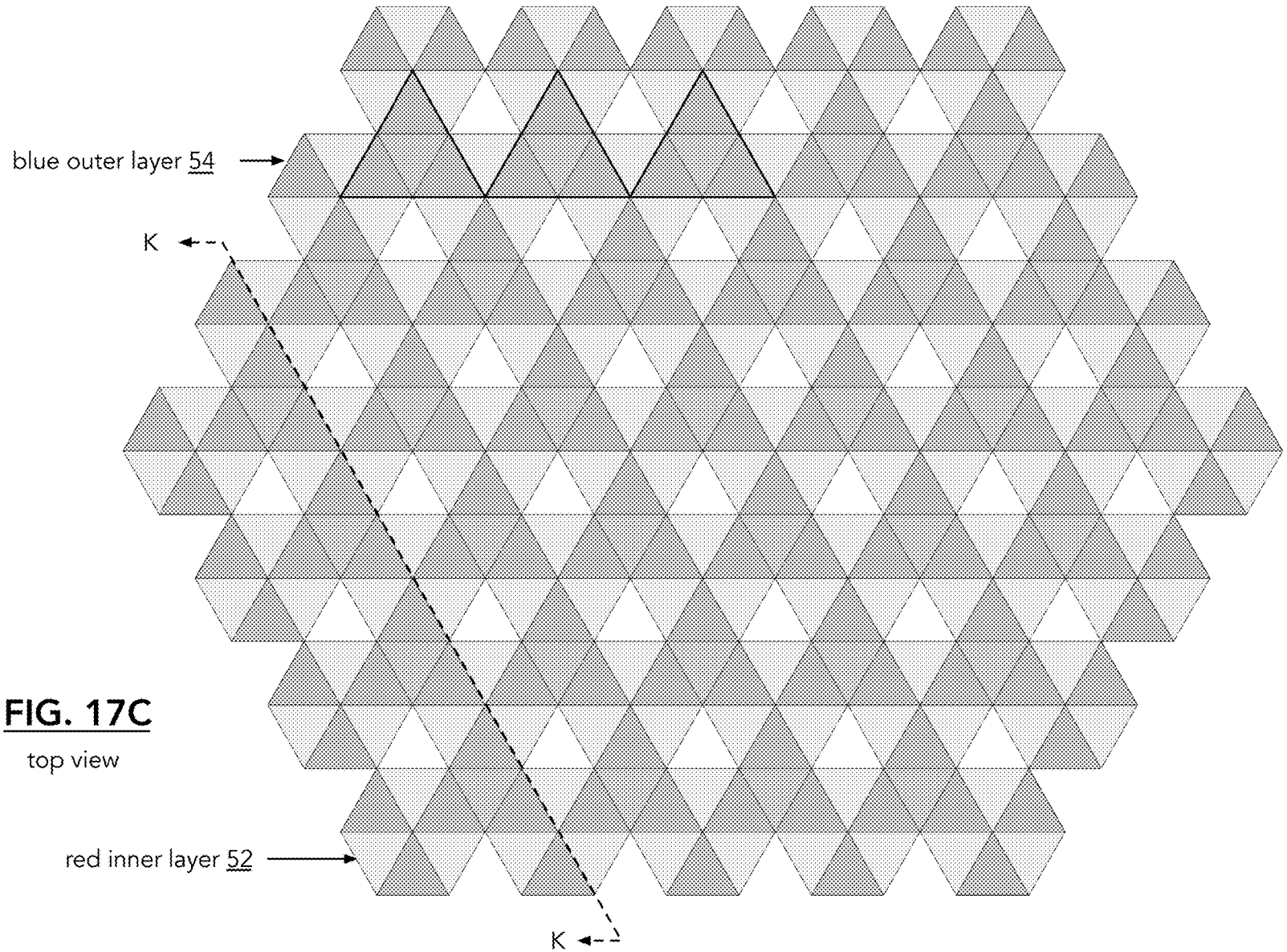
FIG. 17C is top view of an embodiment of a red inner layer positioned over a blue outer layer of a heel sole section.

FIG. 17C is top view of an embodiment of a red inner layer 52 positioned over a blue outer layer 54 of a heel sole section 46. In this example, one interior inner layer hexagon cell is in contact with three triangular shaped outer layer cells. The three triangular shaped outer layer cells are in contact with seven inner layer hexagon cells (the first one and the six surrounding cells).

Figure 17E:
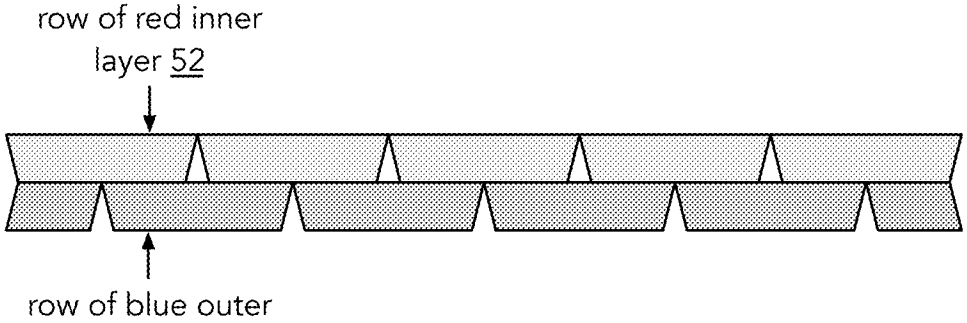
FIG. 17E is crosscut section view of an embodiment of a row of cells of a red inner layer positioned over a row of cells of a blue outer layer of a heel sole section of FIG. 17D.
Figure 17D:
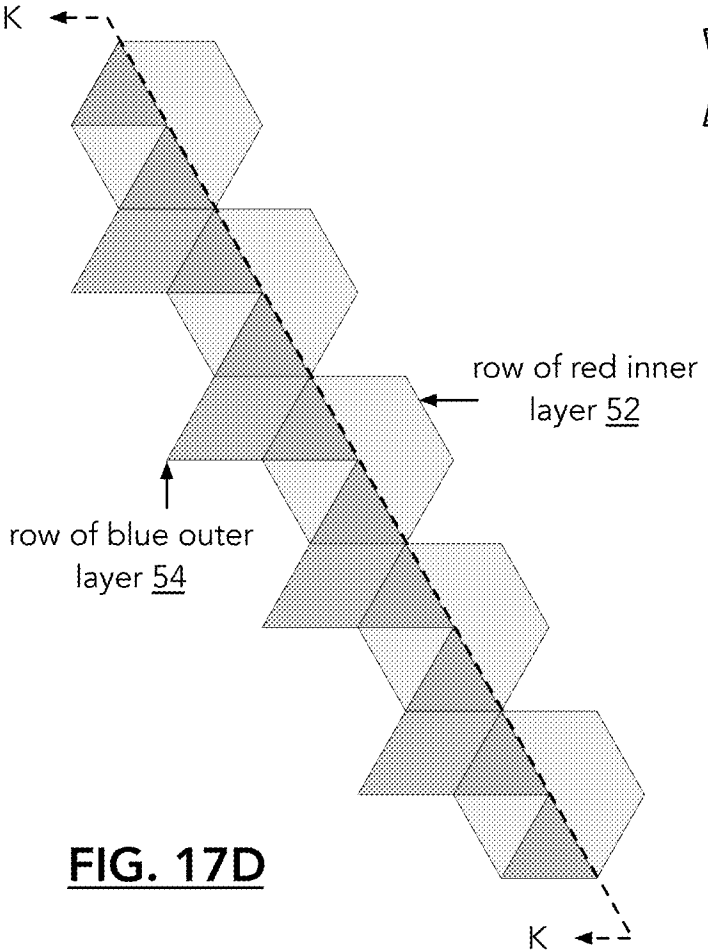
FIG. 17D is diagram of an embodiment of a row of cells of a red inner layer positioned over a row of cells of a blue outer layer of a heel sole section.

FIG. 17D is diagram of an embodiment of a row of cells of a red inner layer 52 positioned over a row of cells of a blue outer layer 54 of a heel sole section.

FIG. 17E is crosscut section view of an embodiment of a row of cells of a red inner layer 52 positioned over a row of cells of a blue outer layer 54 of a heel sole section of FIG. 17D.

Figure 17F:
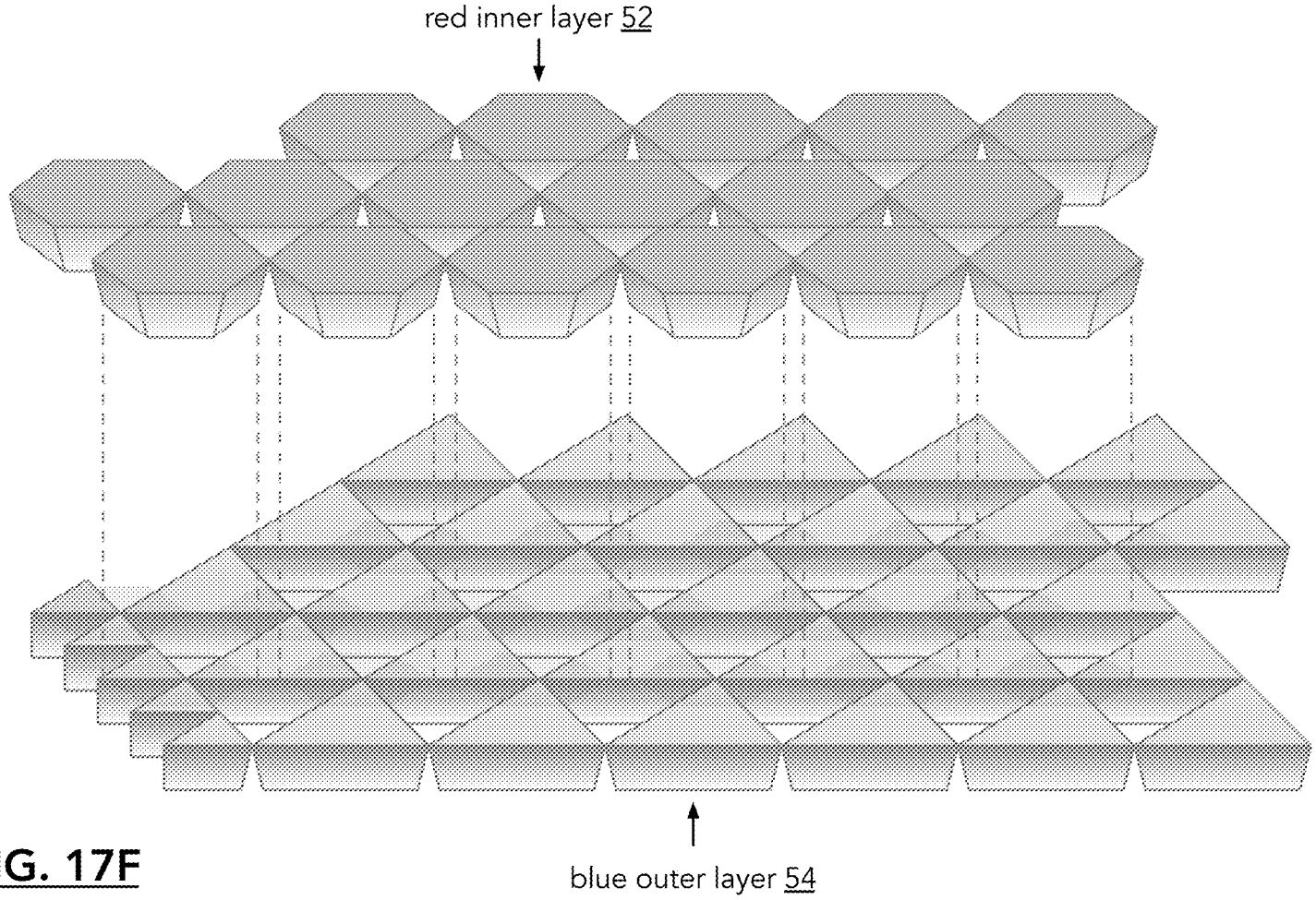
FIG. 17F is an isometric exploded view of an embodiment of a red inner layer positioned over a blue outer layer of a heel sole section.

FIG. 17F is an isometric exploded view of an embodiment of a red inner layer positioned over a blue outer layer of a heel sole section.

Figure 18A:
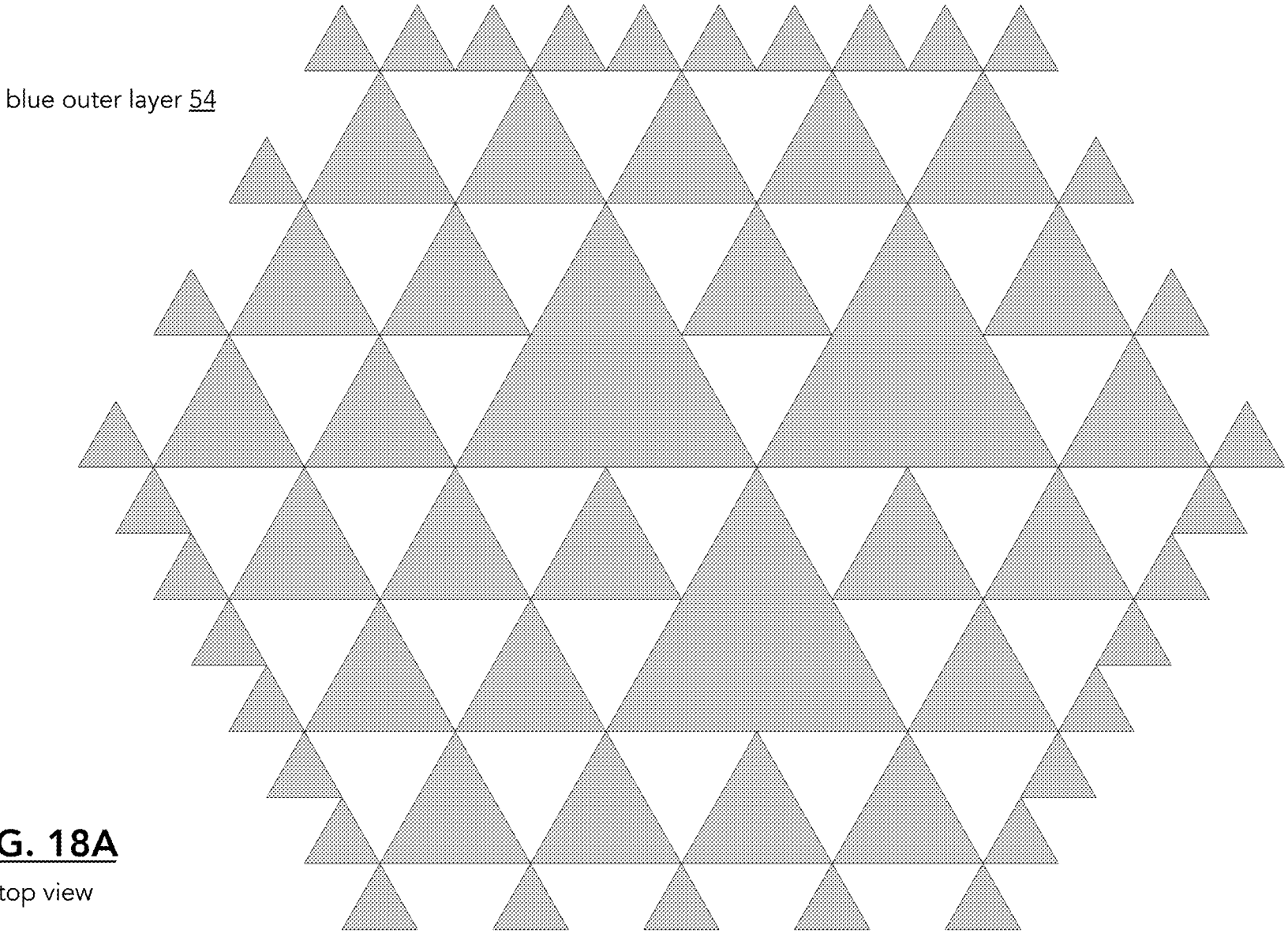
FIG. 18A is top view of another embodiment of a blue outer layer of a heel sole section.

FIG. 18A is top view of another embodiment of a blue outer layer 54 of a heel sole section.

Figure 18B:
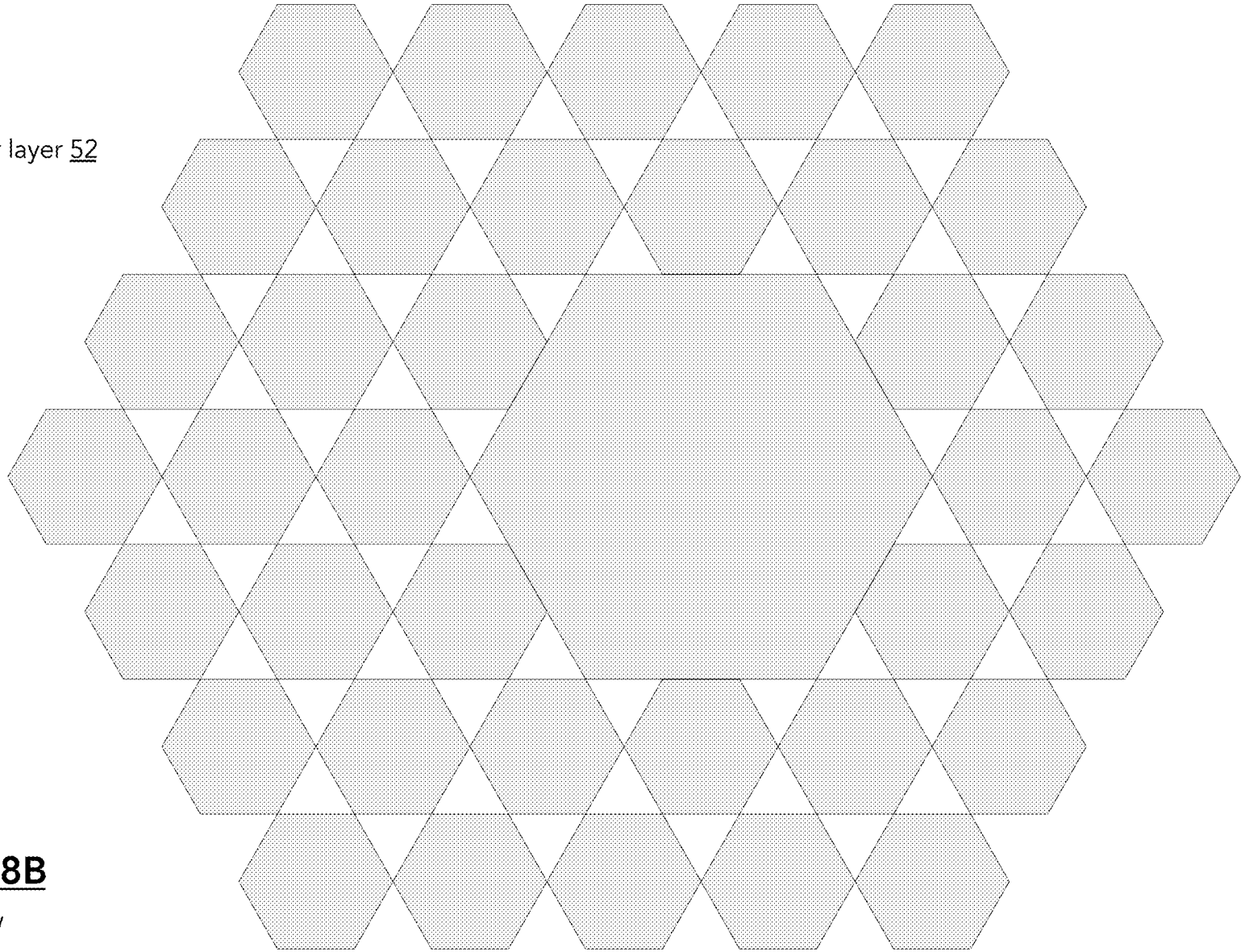
FIG. 18B is top view of another embodiment of a red inner layer of a heel sole section.

FIG. 18B is top view of another embodiment of a red inner layer 52 of a heel sole section.

Figure 18C:
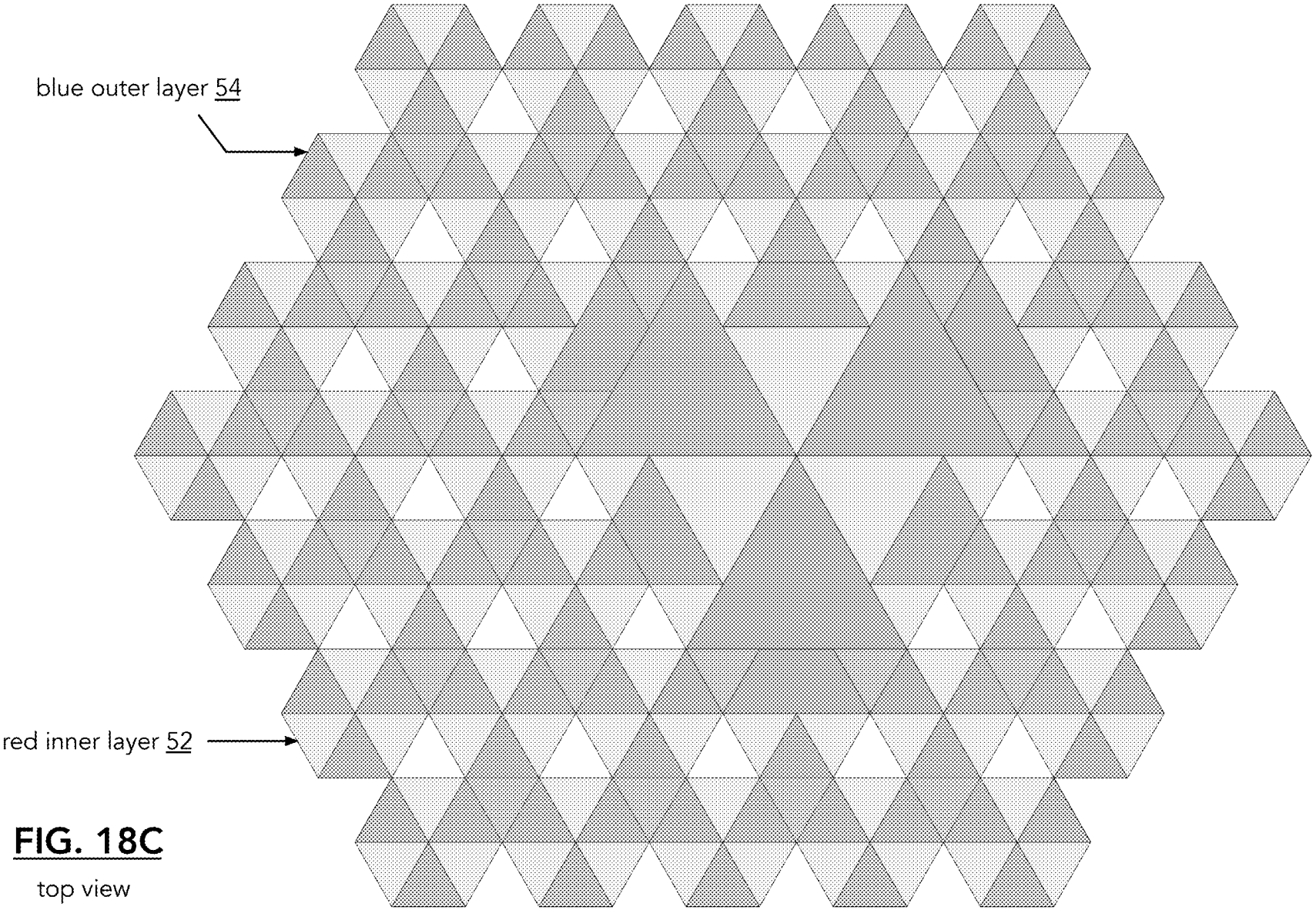
FIG. 18C is top view of another embodiment of a red inner layer positioned over a blue outer layer of a heel sole section.

FIG. 18C is top view of another embodiment of a red inner layer 52 of FIG. 18B positioned over a blue outer layer 54 of FIG. 18A. In this embodiment, the center inner layer cell is larger than the other inner layer cells.

Figure 19A:
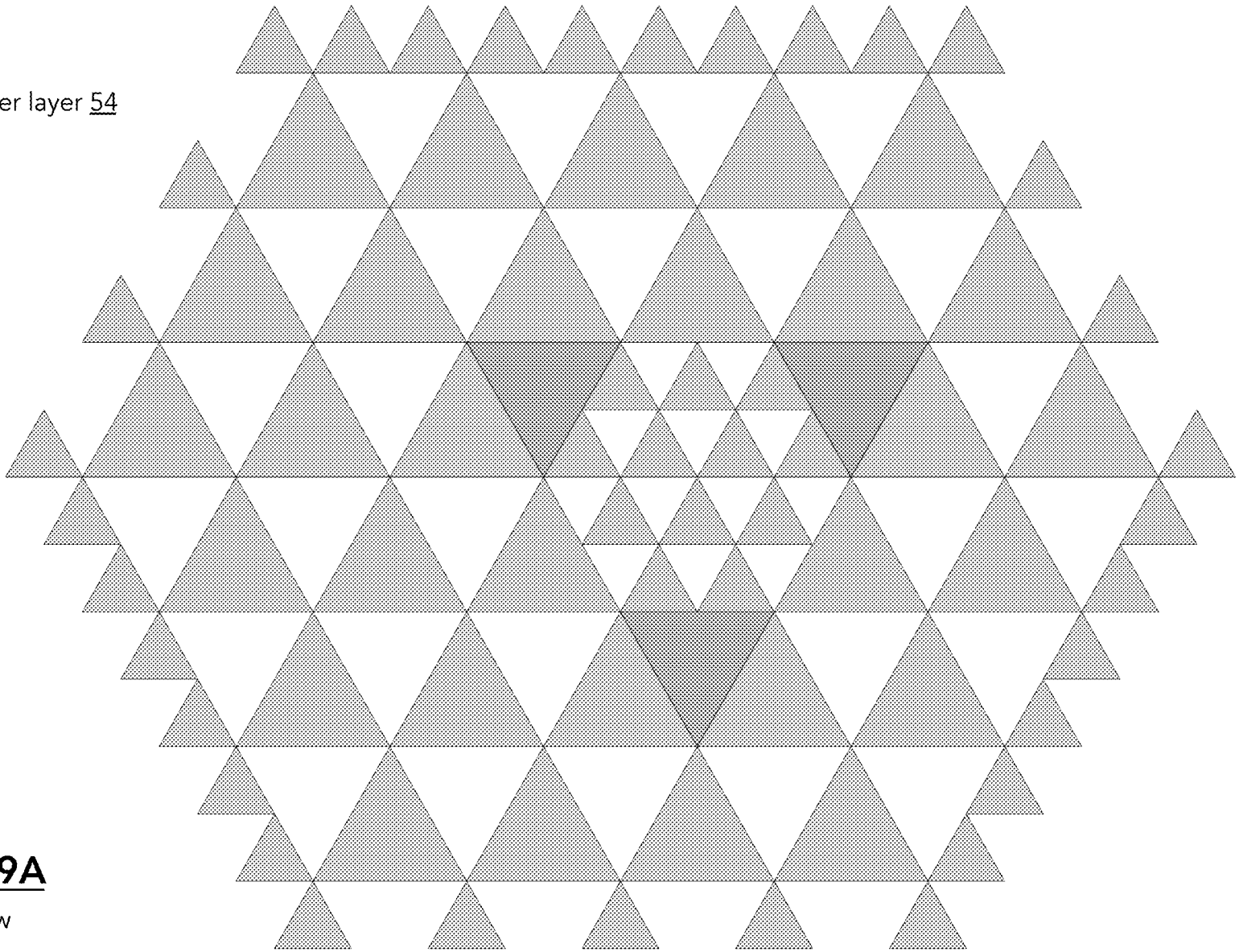
FIG. 19A is top view of an embodiment of a blue outer layer of a heel sole section.

FIG. 19A is top view of an embodiment of a blue outer layer 54 of a heel sole section. In this embodiment, the blue other layer includes a few green cells to fill in gaps around the center of the anatomical heel. As shown, the cells are a smaller in the area corresponding to the center of the anatomical heel.

Figure 19B:
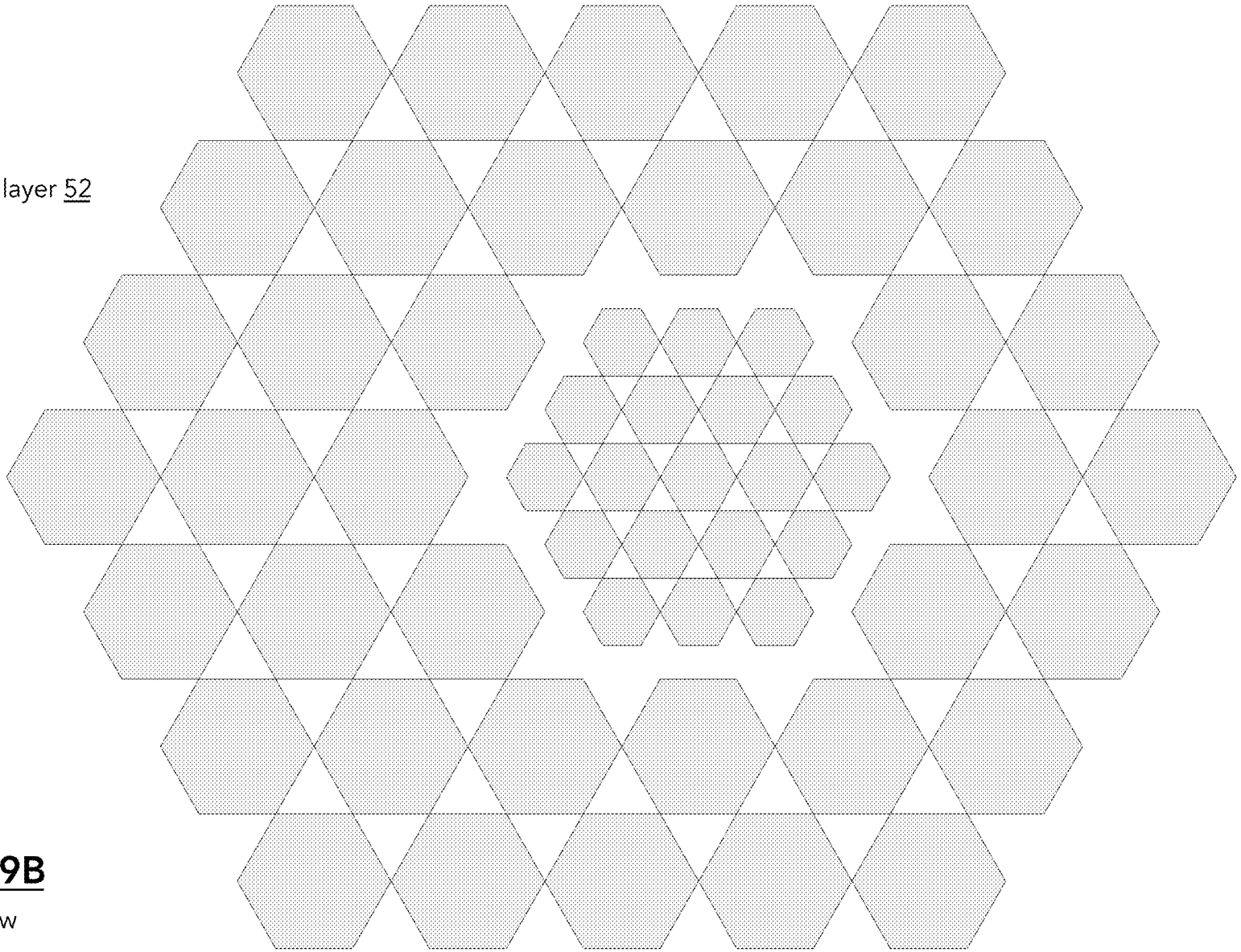
FIG. 19B is top view of an embodiment of a red inner layer of a heel sole section.

FIG. 19B is top view of an embodiment of a red inner layer 52 of a heel sole section.

Figure 19C:
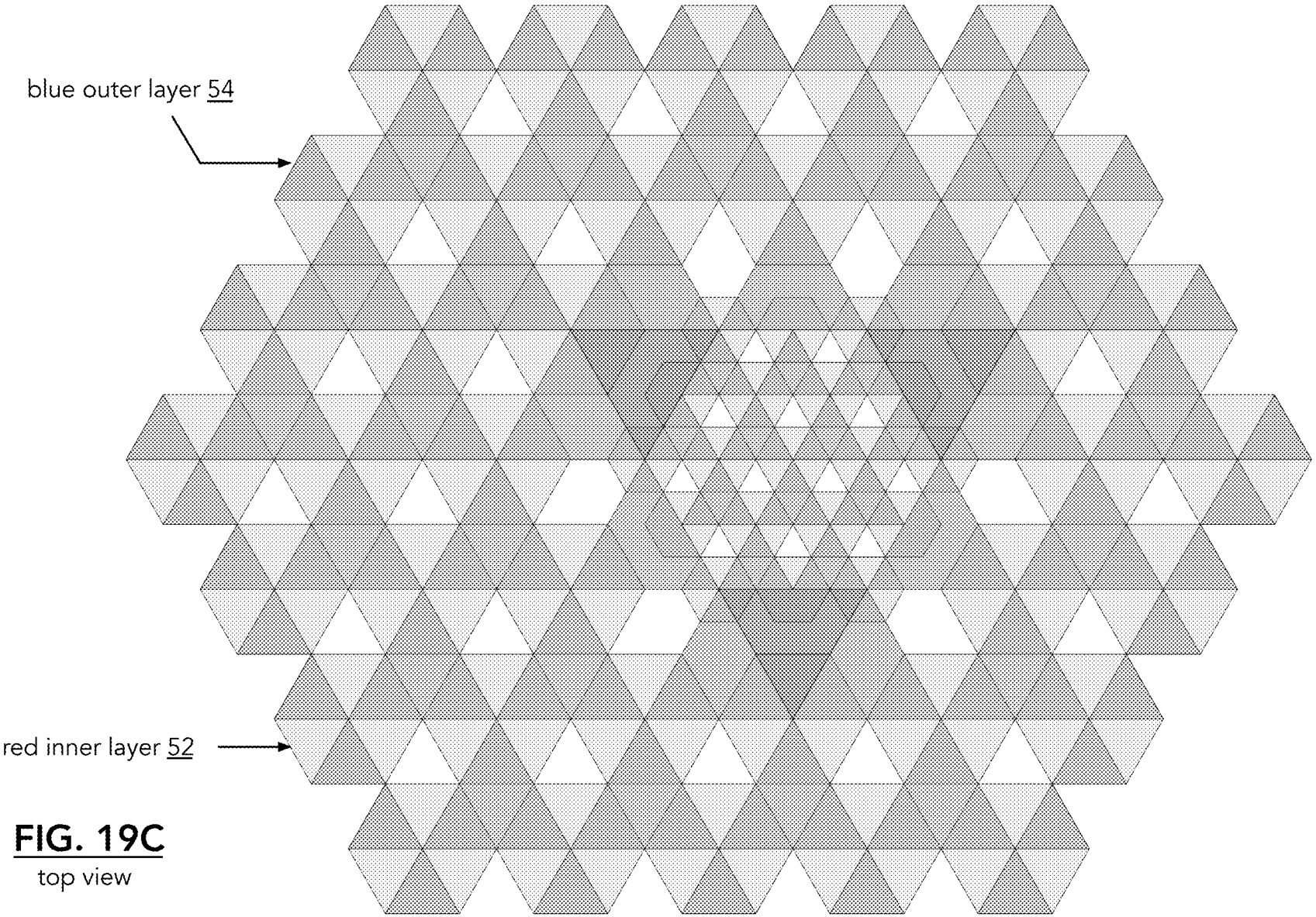
FIG. 19C is top view of an embodiment of a red inner layer positioned over a blue outer layer of a heel sole section.

FIG. 19C is top view of an embodiment of a red inner layer 52 of FIG. 19B positioned over a blue outer layer 54 of FIG. 19A. In this embodiment, the center of the inner layer includes smaller cells than the perimeter cells of the inner layer.

Figure 20A:
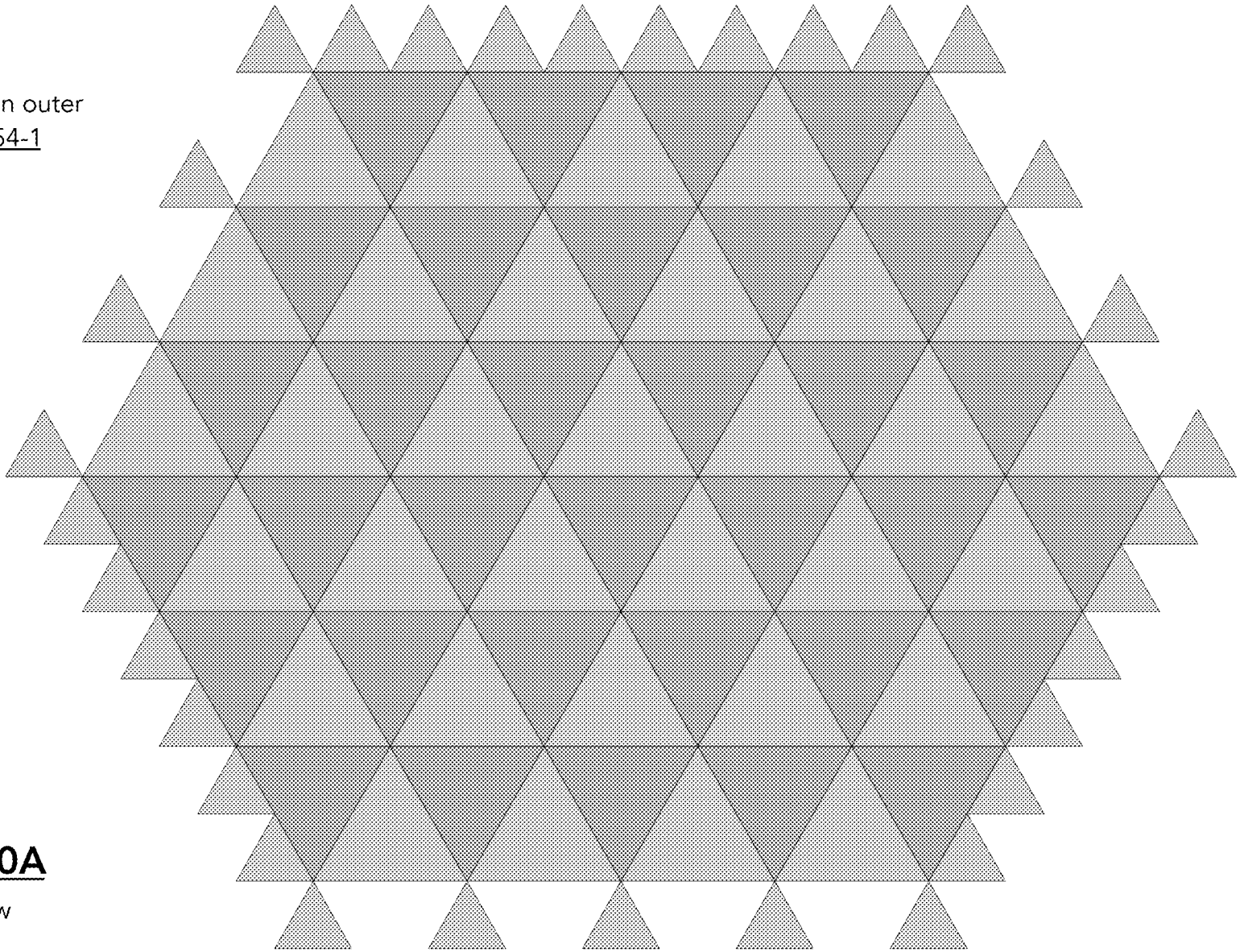
FIG. 20A is top view of an embodiment of a blue-green outer layer of a heel sole section.

FIG. 20A is top view of an embodiment of a blue-green outer layer 54-1 of a heel sole section 46.

Figure 20B:
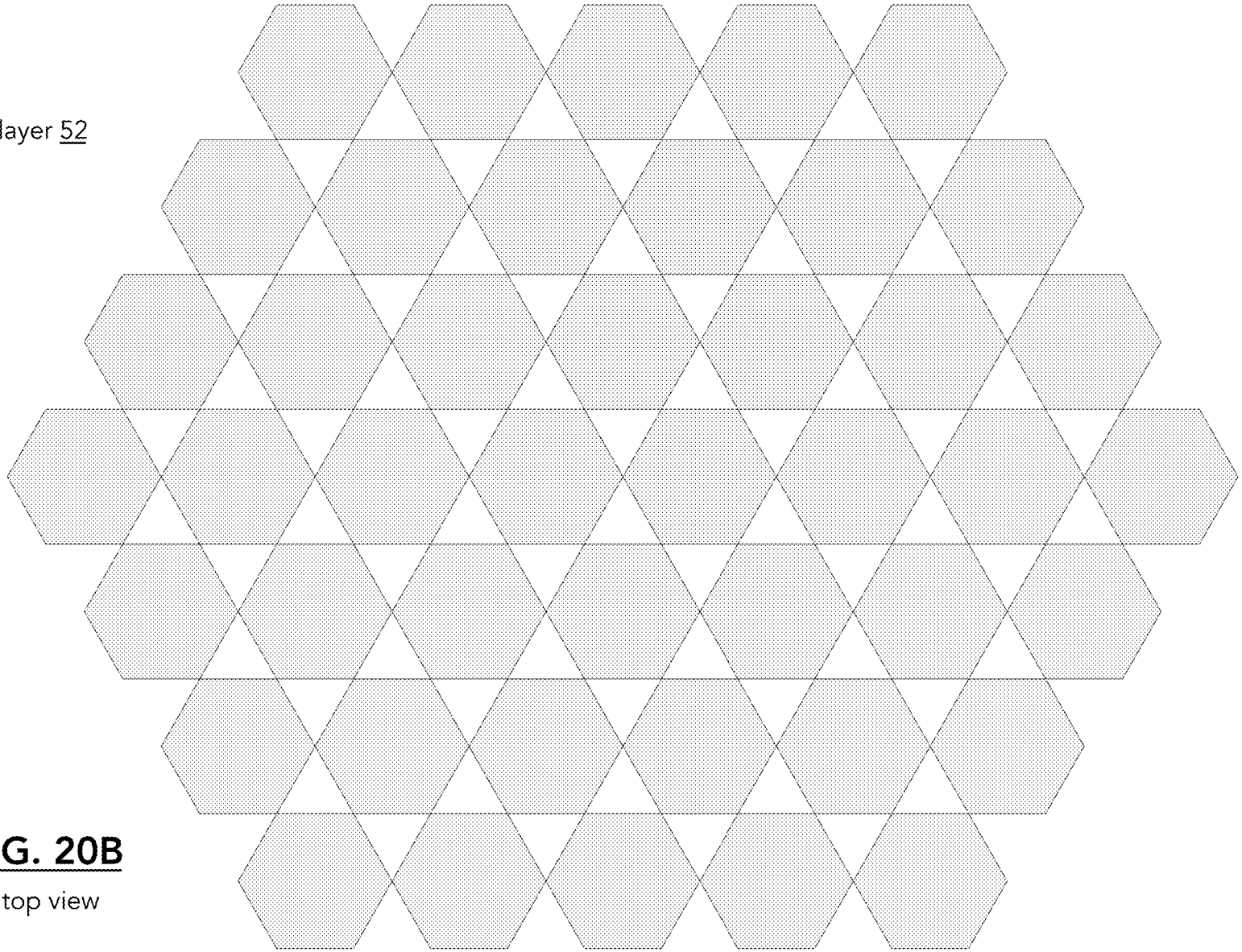
FIG. 20B is top view of an embodiment of a red inner layer of a heel sole section.

FIG. 20B is top view of an embodiment of a red inner layer 52 of a heel sole section 46.

Figure 20C:
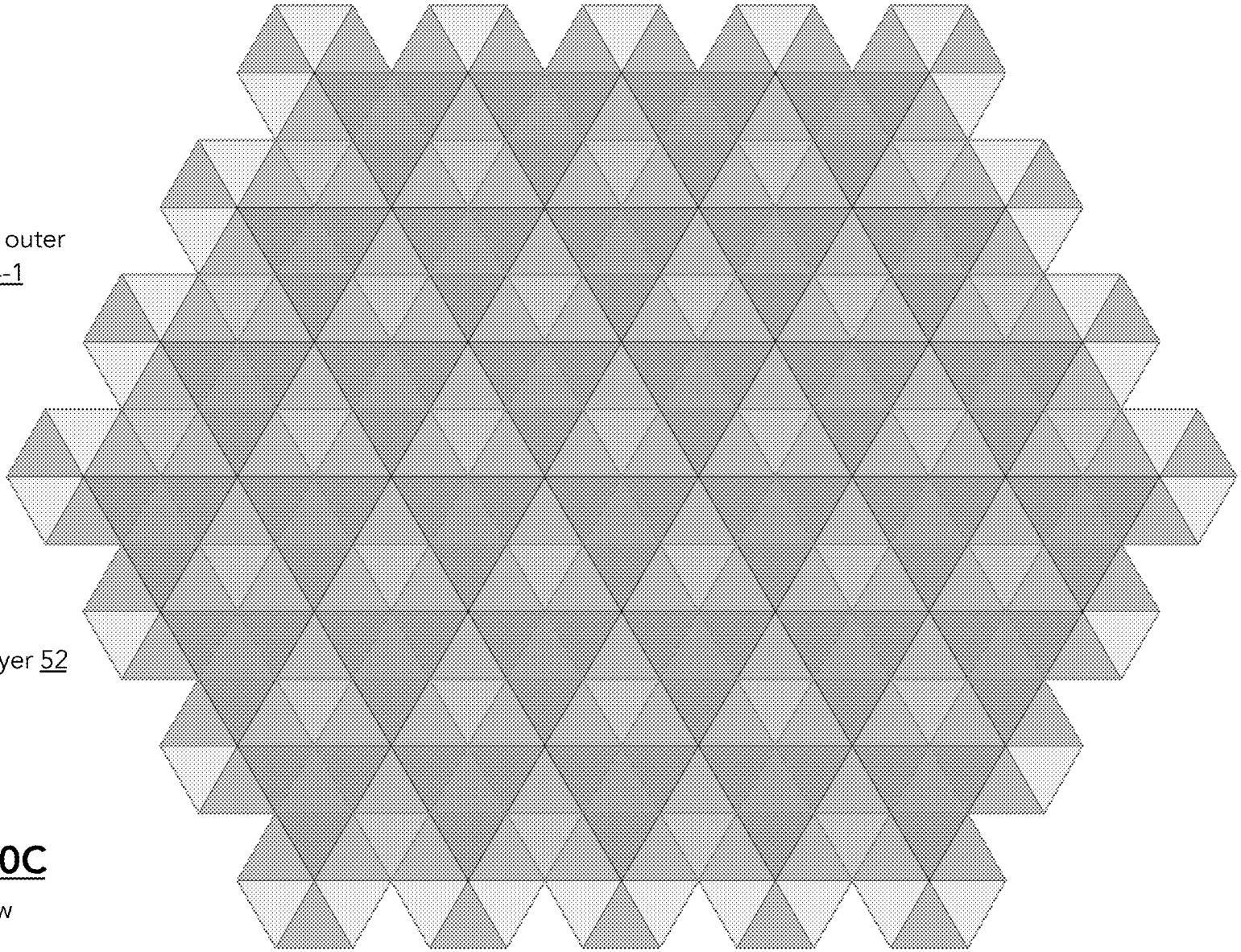
FIG. 20C is top view of an embodiment of a red inner layer positioned over a blue-green outer layer of a heel sole section.

FIG. 20C is top view of an embodiment of a red inner layer 52 of FIG. 20B positioned over a blue-green outer layer of FIG. 20A.

Figure 20D:
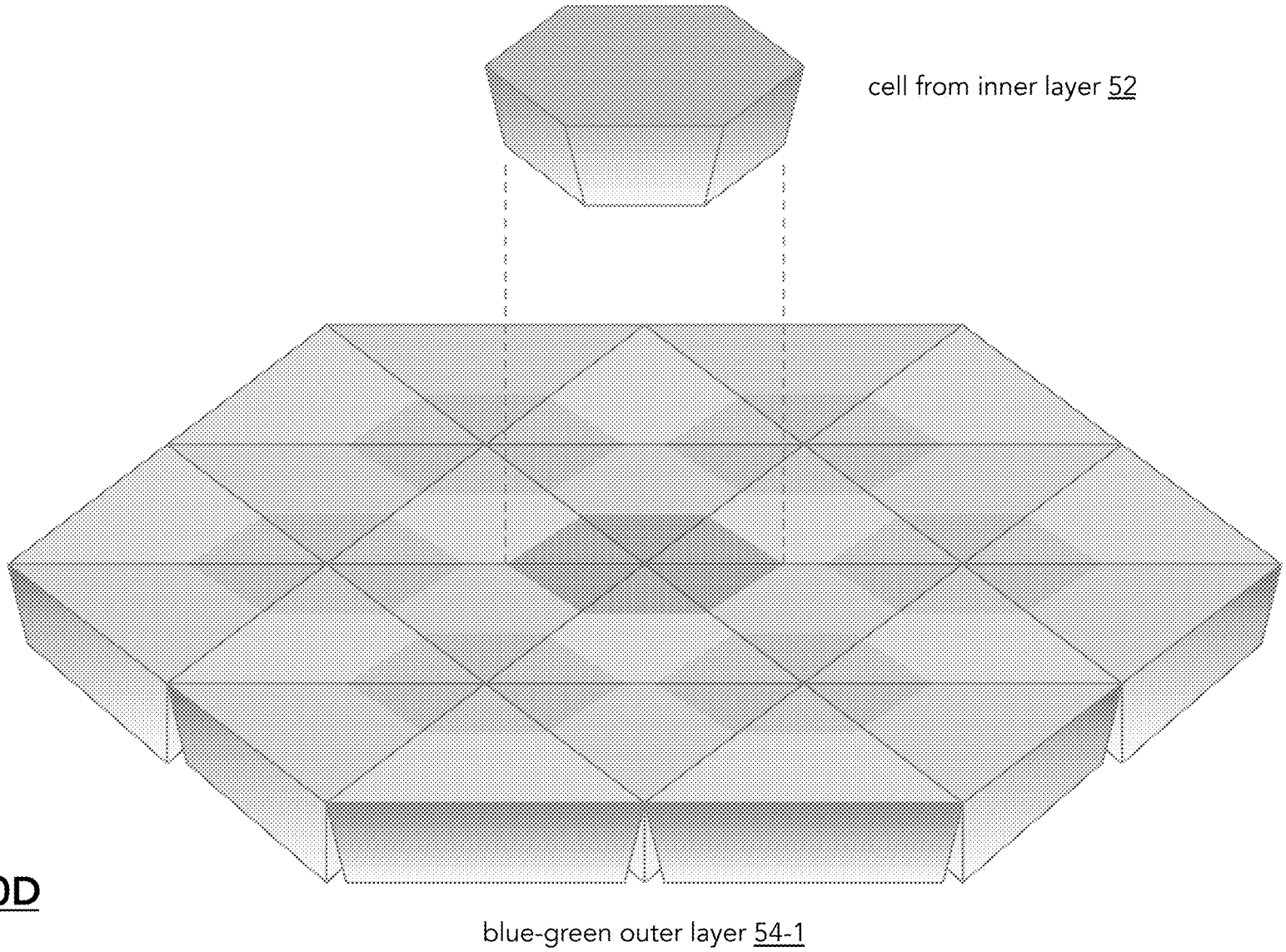
FIG. 20D is an isometric exploded view of an embodiment of a red inner layer positioned over a blue outer layer of a heel sole section.

FIG. 20D is an isometric exploded view of an embodiment of a cell of a red inner layer 52 positioned over a blue-green outer layer 54-1 of a heel sole section. In this illustrates, the cell of the inner layer 54 interacts with 6 cells of the outer layer 54.

Figure 20E:
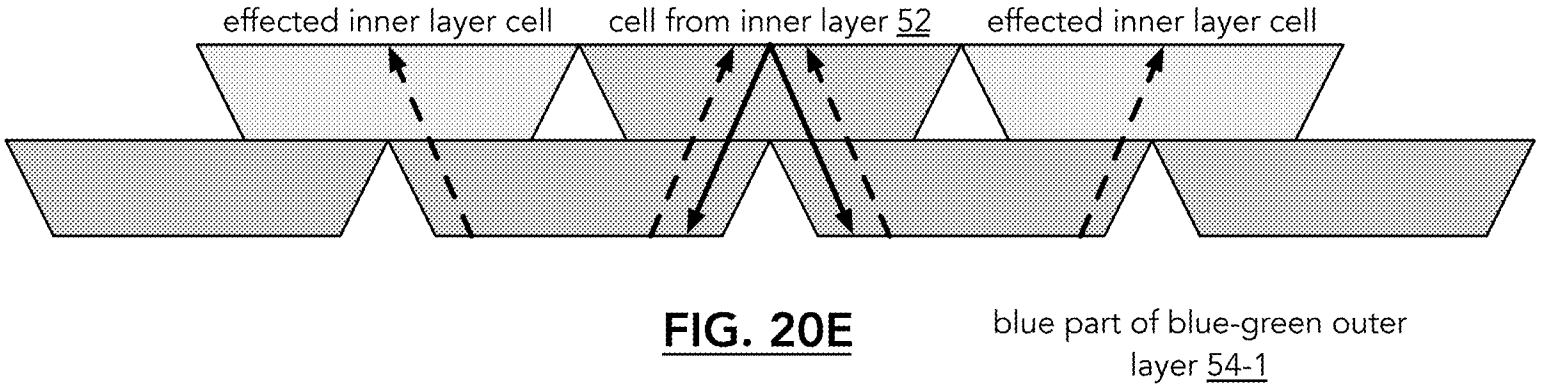
FIG. 20E is a diagram of an example of forces traversing through cells of a red inner layer and blue cells a blue-green outer layer of a heel sole section.

FIG. 20E is a diagram of an example of forces traversing through cells of a red inner layer 52 and blue cells a blue-green outer layer 54-1 of a heel sole section. In this illustration, the solid lines represent the body force applied by the body. The dashed lines represent the distribution of ground reaction force.

Figure 20F:
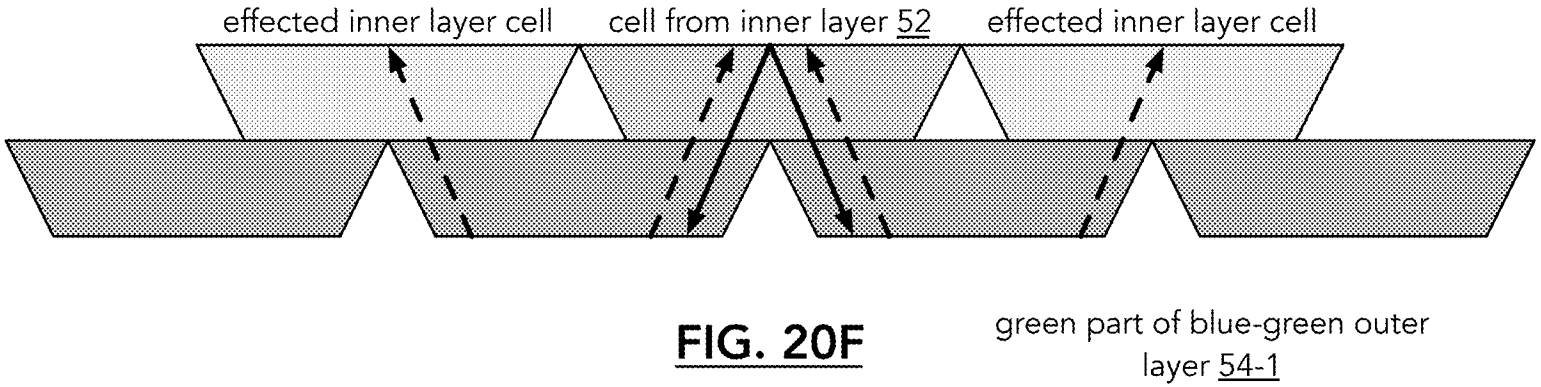
FIG. 20F is a diagram of an example of forces traversing through cells of a red inner layer and green cells a blue-green outer layer of a heel sole section.

FIG. 20F is a diagram of an example of forces traversing through cells of a red inner layer 52 and green cells a blue-green outer layer 54-1 of a heel sole section. In this illustration, the solid lines represent the body force applied by the body. The dashed lines represent the distribution of ground reaction force.

Figure 21:
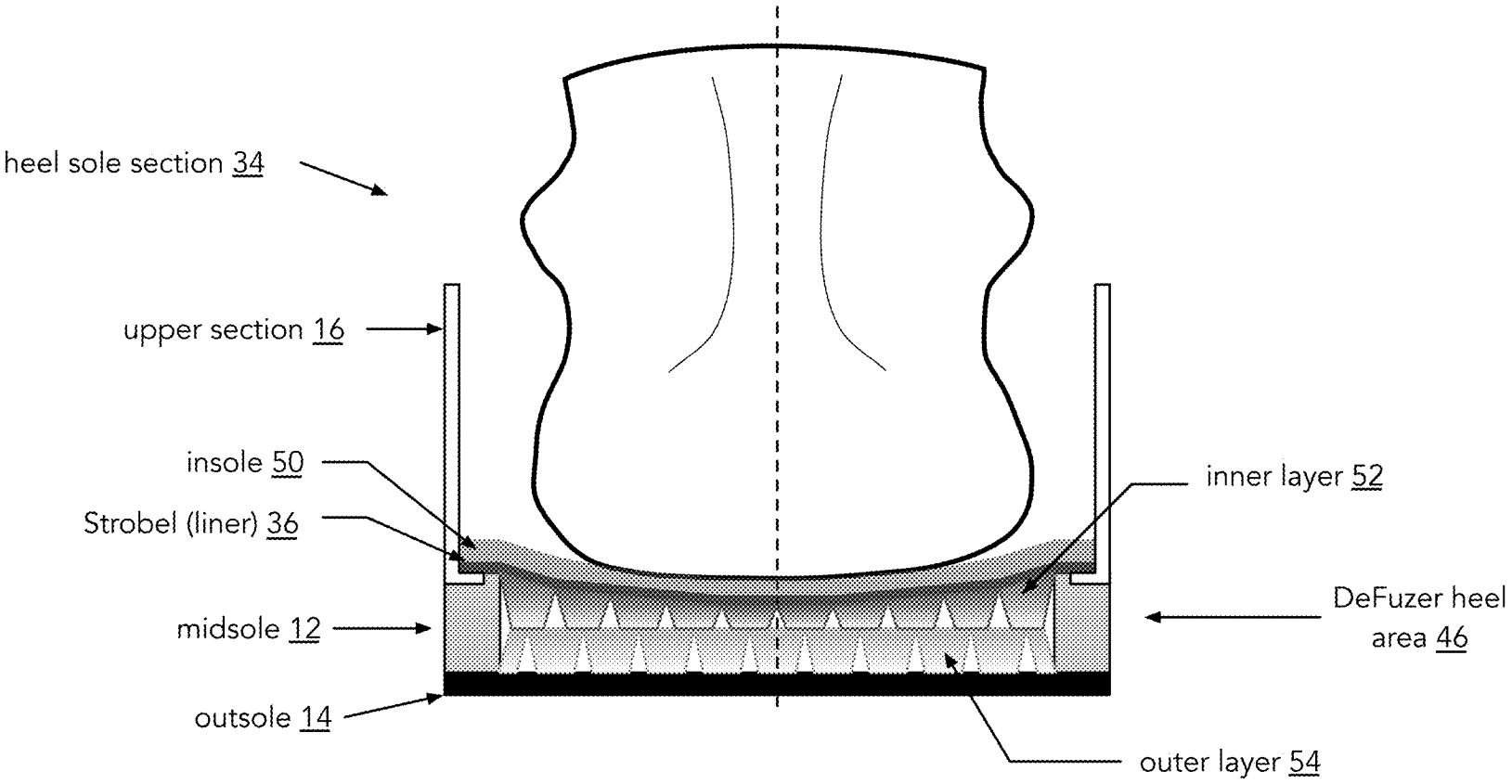
FIG. 21 is a crosscut section view of another embodiment of a heel sole section of a shoe.

FIG. 21 is a crosscut section view of another embodiment of a heel sole section of a shoe. This embodiment is similar to the embodiment of FIG. 9, but this embodiment includes a heel cup to better cradle the heel. The heel cup is created via the inner layer 52, where the height of the cells is smaller in the center of the anatomical heel section. The height of the cells increase from the center of the anatomical heel section to its outer edges. The difference is height ranges from a millimeter to 5 or more millimeters.

Figure 22:
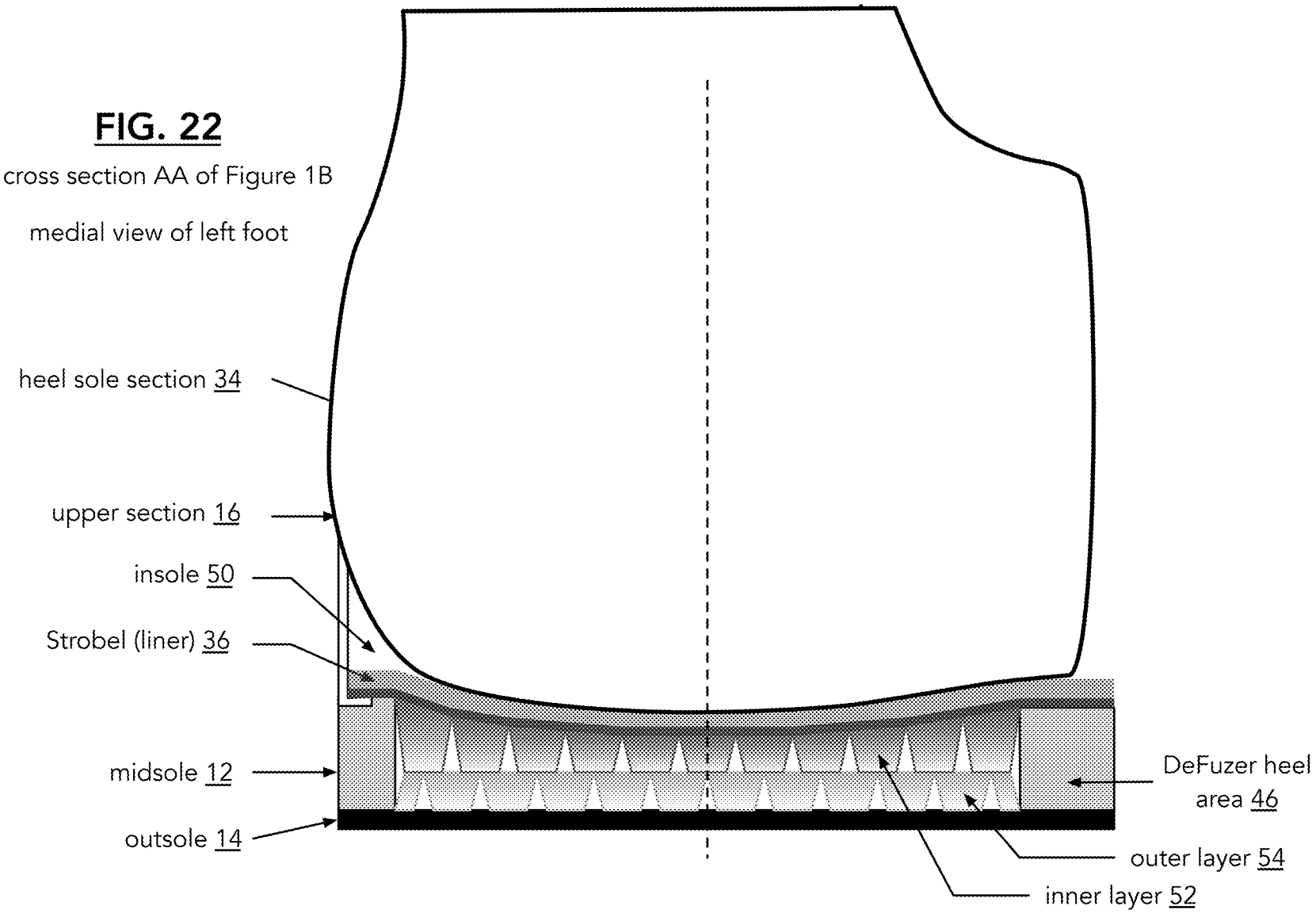
FIG. 22 is another crosscut section view of another embodiment of a heel sole section of a shoe.

FIG. 22 is another crosscut section view of another embodiment of a heel sole section of a shoe. This embodiment is similar to the embodiment of FIG. 10, but this embodiment includes a heel cup to better cradle the heel. The heel cup is created via the inner layer 52, where the height of the cells is smaller in the center of the anatomical heel section. The height of the cells increase from the center of the anatomical heel section to its outer edges. The difference is height ranges from a millimeter to 5 or more millimeters.

Figure 23:
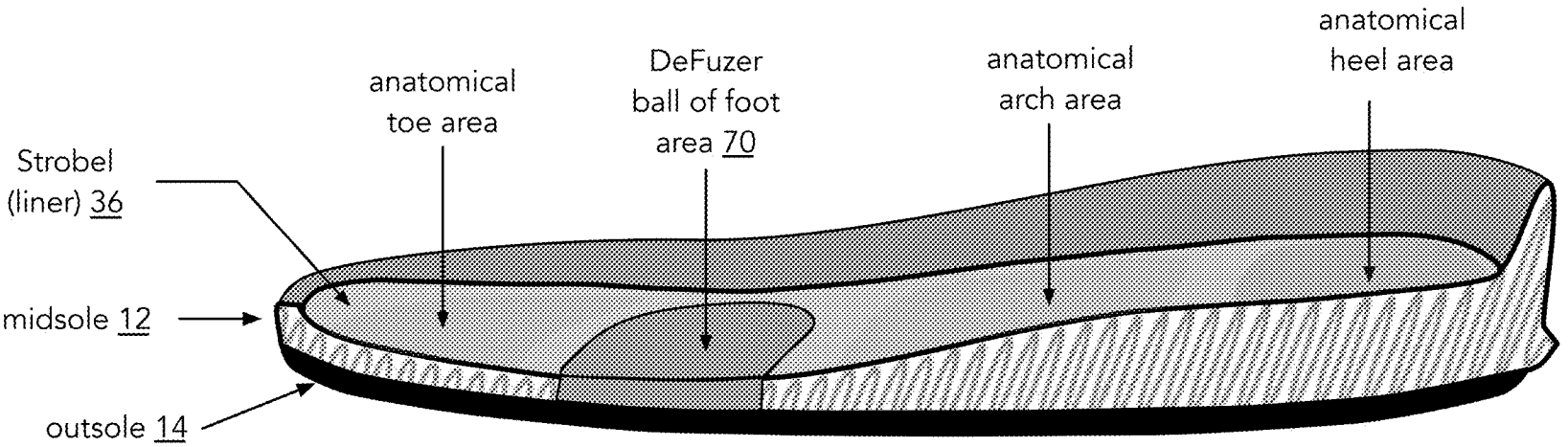
FIG. 23 is a crosscut section view of an embodiment of a ball of foot section of a shoe.

FIG. 23 is a crosscut section view of an embodiment of a shoe. In this embodiment, the anatomical ball of foot area includes a DeFuzer structure 70 in the midsole 12. The DeFuzer structure 70 (i.e., DeFuzer ball of foot area) may extend into the Strobel 36 and/or into the outsole 14.

Figure 24:
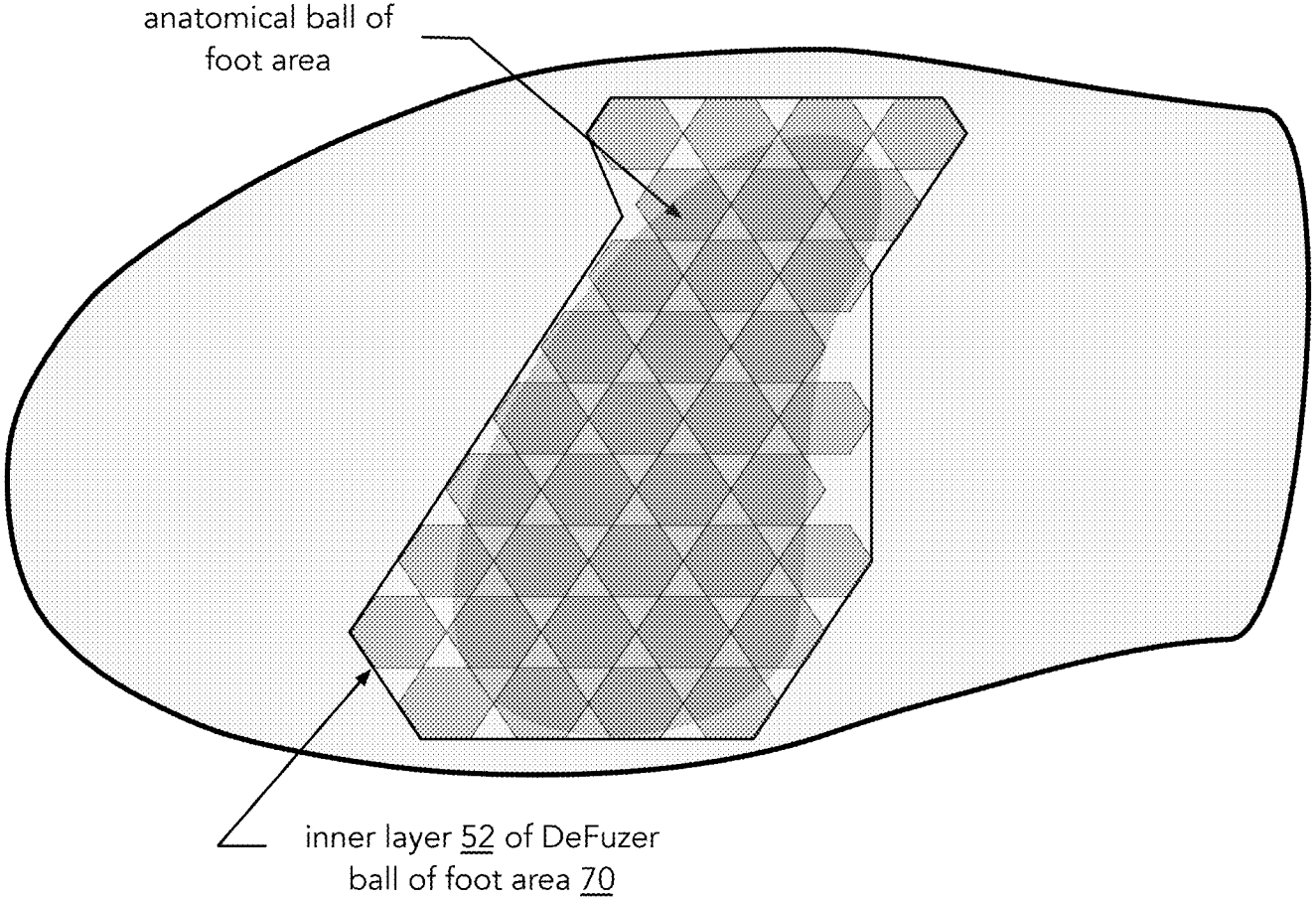
FIG. 24 is top section view of an embodiment of a ball of foot section of a shoe.

FIG. 24 is top section view of an embodiment of an inner layer 52 of a DeFuzer ball of foot section 70 of a shoe. In this example, the inner layer includes hexagon shaped cells of equal size.

Figure 25A:
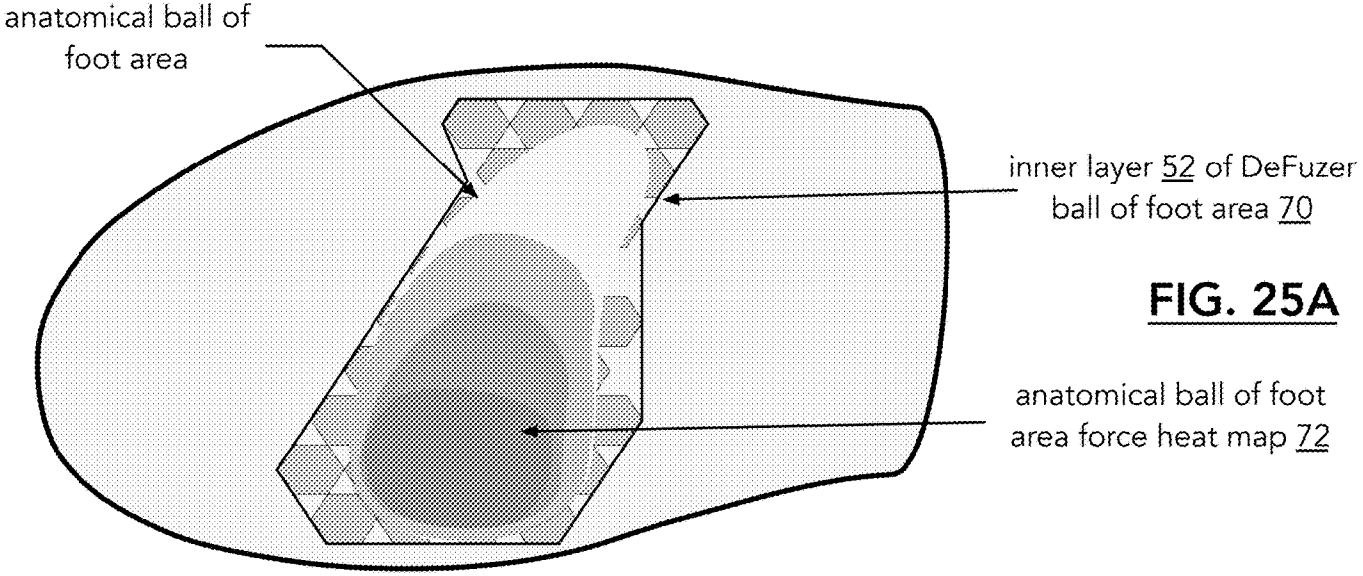
FIG. 25A is top section view of an example of a force heat map for a ball of foot section of a shoe.

FIG. 25A is top section view of an example of a force heat map for a ball of foot section 70 of a right shoe, which corresponds to the anatomical ball of foot area, before the forces traverse through the DeFuzer ball of foot section. In this example, the foot is applying a majority of the force to the medial side of the shoe, which may result from an athletic movement (e.g., hit a ball, throw a ball, lateral movements, rotational movements, etc.). As used herein, the color red of the force heat map indicates a large pressure and yellow represents a moderate pressure for the wearer of the shoes.

Figure 25B:
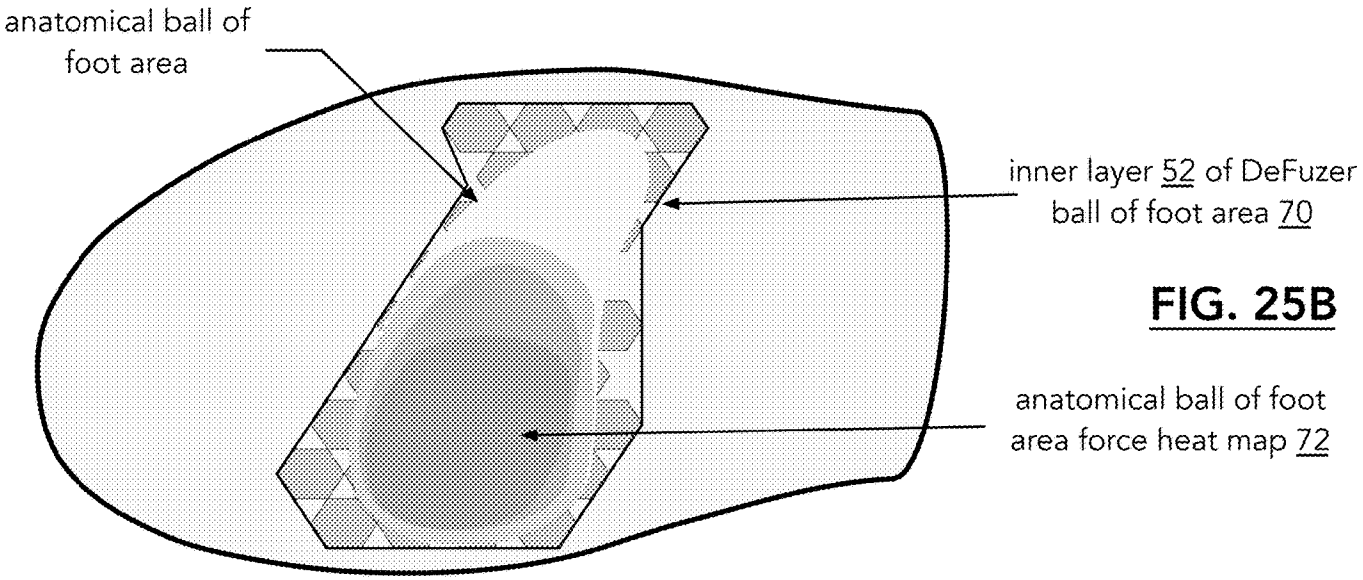
FIG. 25B is top section view of an example of a force heat map for a ball of foot section of a shoe.

FIG. 25B is top section view of an example of a force heat map for a ball of foot section 70 of a right shoe after the forces traverse through the DeFuzer ball of foot section.

Figure 26A:
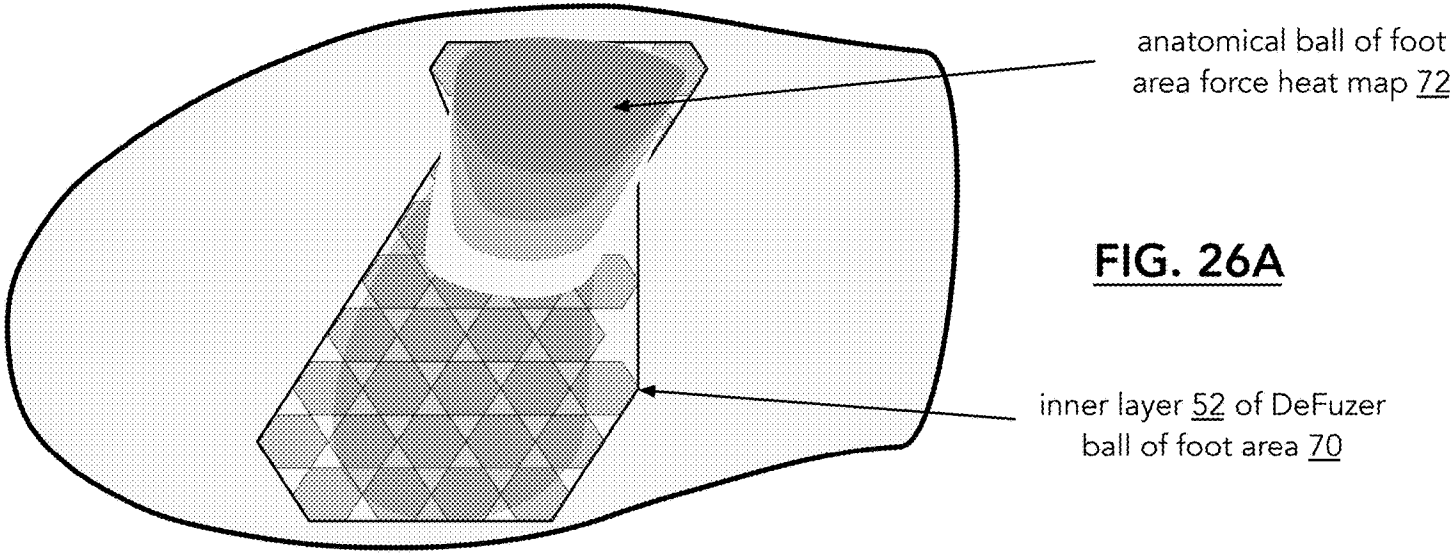
FIG. 26A is top section view of another example of a force heat map for a ball of foot section of a shoe.

FIG. 26A is top section view of another example of a force heat map for a ball of foot section 70 of a right shoe before the forces traverse through the DeFuzer ball of foot section. In this example, the foot is applying a majority of the force to the lateral edge of the shoe.

Figure 26B:
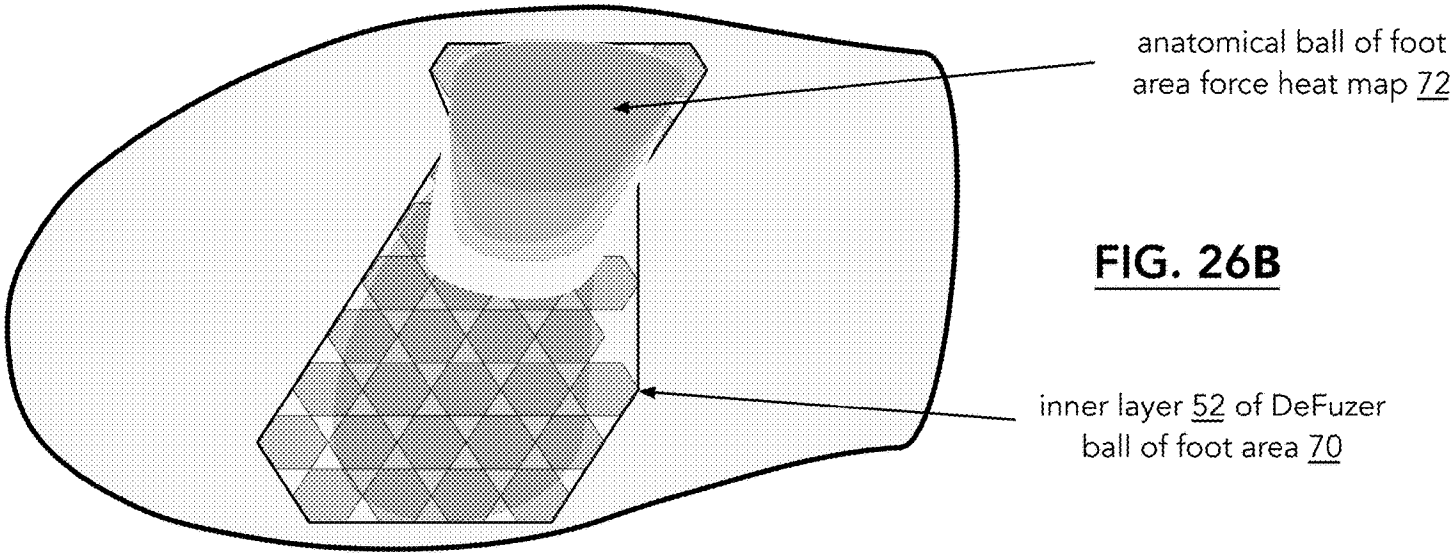
FIG. 26B is top section view of another example of a force heat map for a ball of foot section of a shoe.

FIG. 26B is top section view of another example of a force heat map for a ball of foot section 70 of a right shoe after the forces traverse through the DeFuzer ball of foot section.

Figure 27:
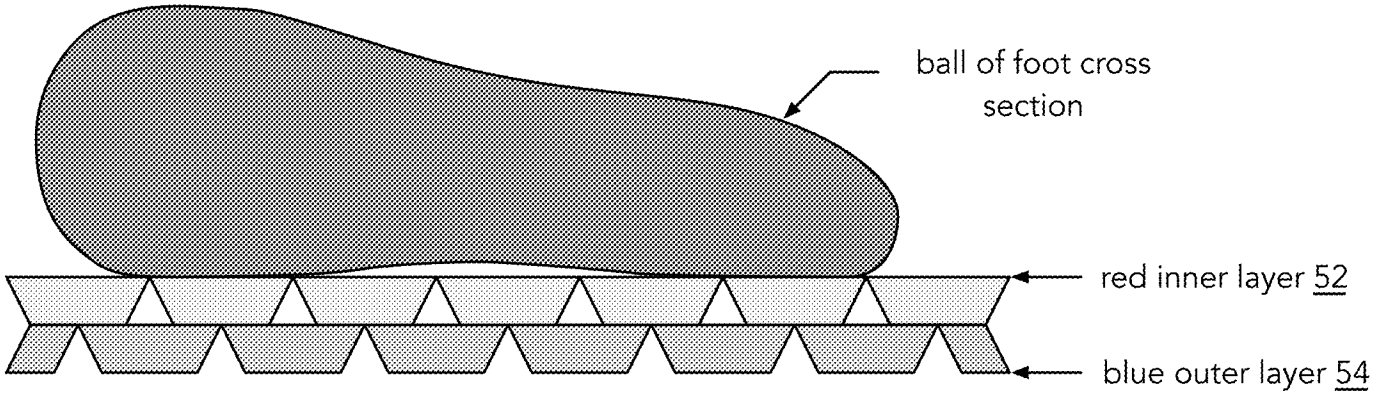
FIG. 27 is crosscut section view of an embodiment a ball of foot section of a shoe.

FIG. 27 is crosscut section view of an embodiment a ball of foot section of a left shoe from a front perspective. Thus, the left side of the figure is the medial side of a left shoe and the right side of the figure is the lateral side of the left shoe. As shown, the height of the DeFuzer section is substantially the same from the medial side to the lateral side of the shoe in the ball of foot area.

Figure 28:
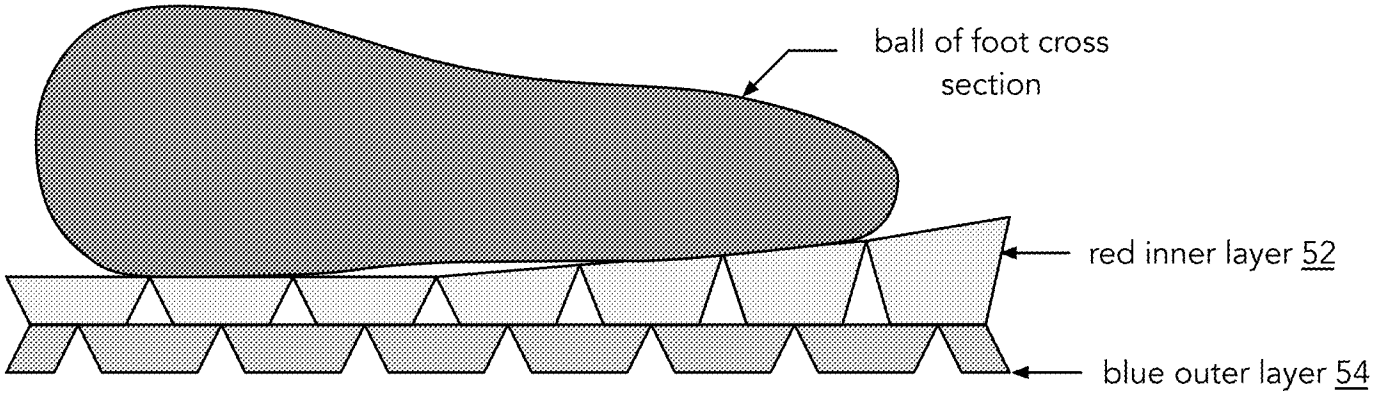
FIG. 28 is crosscut section view of another embodiment a ball of foot section of a shoe.

FIG. 28 is crosscut section view of another embodiment a ball of foot section of a left shoe from a front perspective. Thus, the left side of the figure is the medial side of a left shoe and the right side of the figure is the lateral side of the left shoe. As shown, the height of the DeFuzer section increases from the medial side to the lateral side of the shoe in the ball of foot area. The height of cells of the inner layer 52 near the medial edge may be substantially the same for 10 to 30 millimeters from medial to lateral edge before increasing. The rate of increase may be linear, increasing at an increasing rate, or increasing at a decreasing rate. The height of the cells of the outer layer 54 are of substantially the same height.

Figure 29:
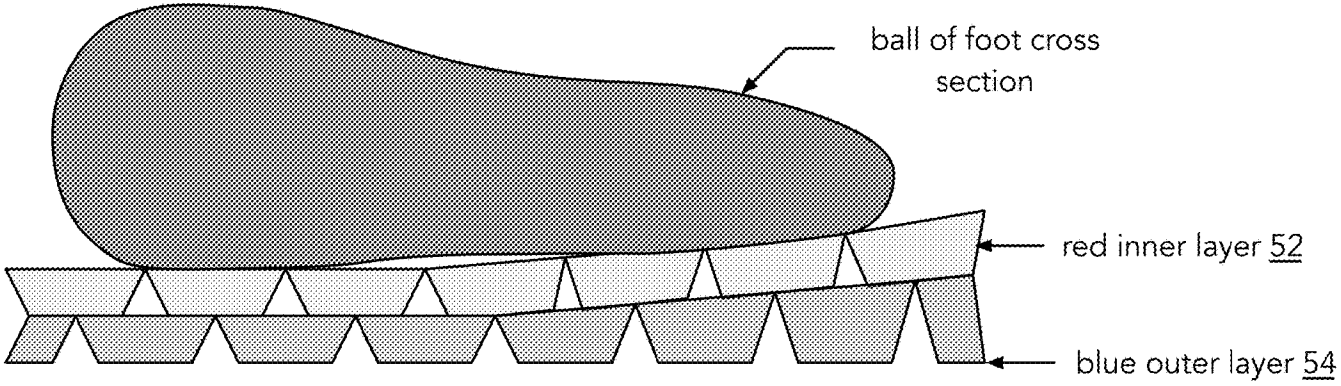
FIG. 29 is crosscut section view of another embodiment a ball of foot section of a shoe.

FIG. 29 is crosscut section view of another embodiment a ball of foot section of a shoe. This ball of foot section 70 includes the inner and outer DeFuzer layers 52 and 54 increasing from the medial edge to the lateral edge as described with reference to FIG. 28.

Figure 30:
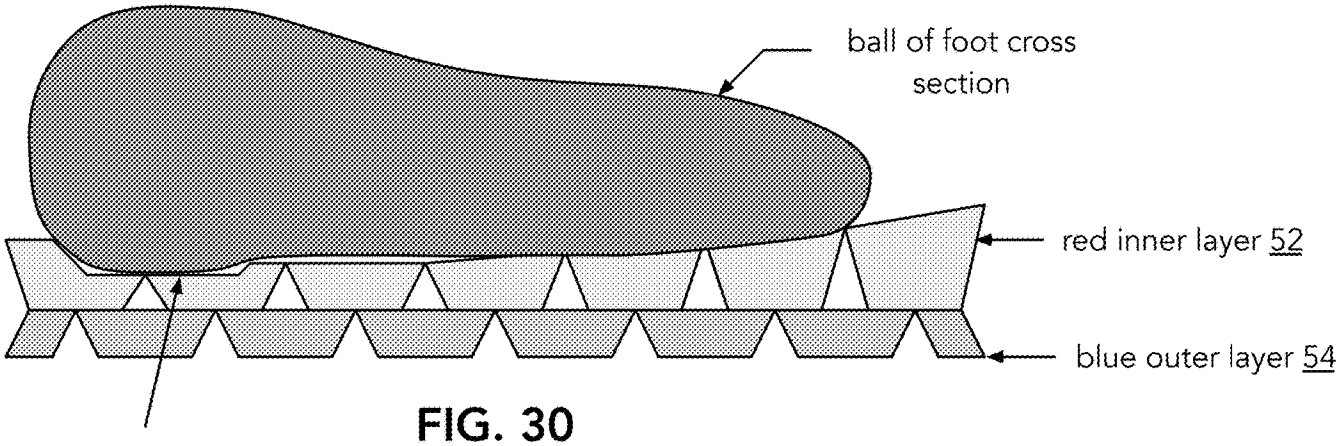
FIG. 30 is crosscut section view of another embodiment a ball of foot section of a shoe.

FIG. 30 is crosscut section view of another embodiment a ball of foot section of a shoe. This embodiment is similar to the embodiment of FIG. 28 with the addition of a ball of foot cup positioned proximal to the first metatarsi.

Figure 31:
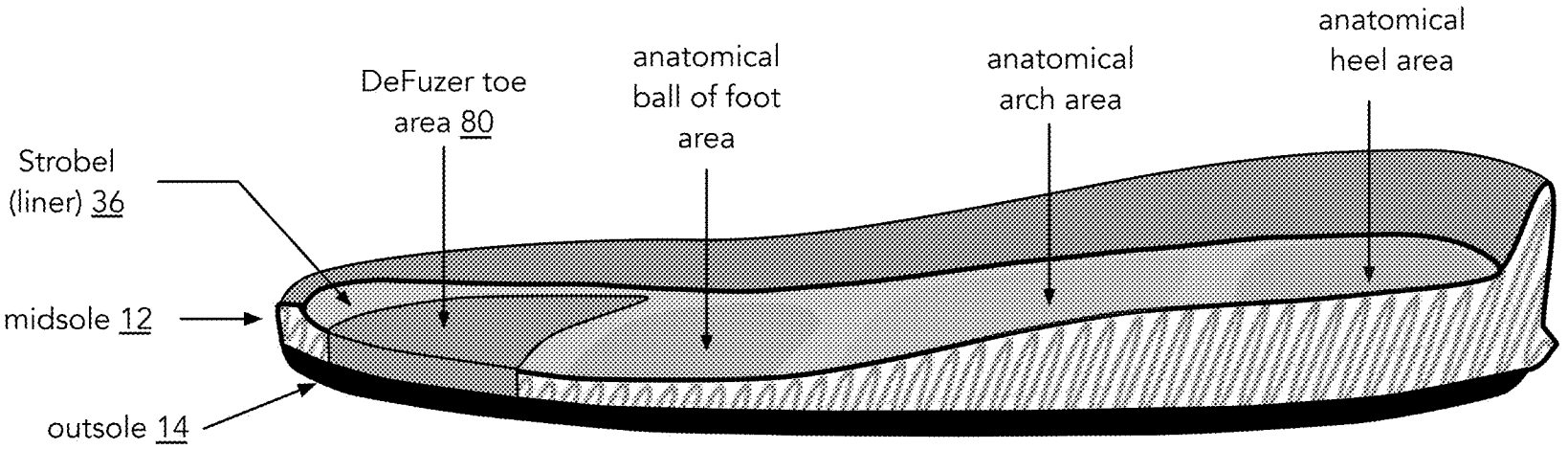
FIG. 31 is a crosscut section view of an embodiment of a toe section of a shoe.

FIG. 31 is a crosscut section view of an embodiment of a DeFuzer toe area 80 of a shoe. The DeFuzer toe area 0 may extend into the Strobel 36 and/or into the outsole 14.

Figure 32:
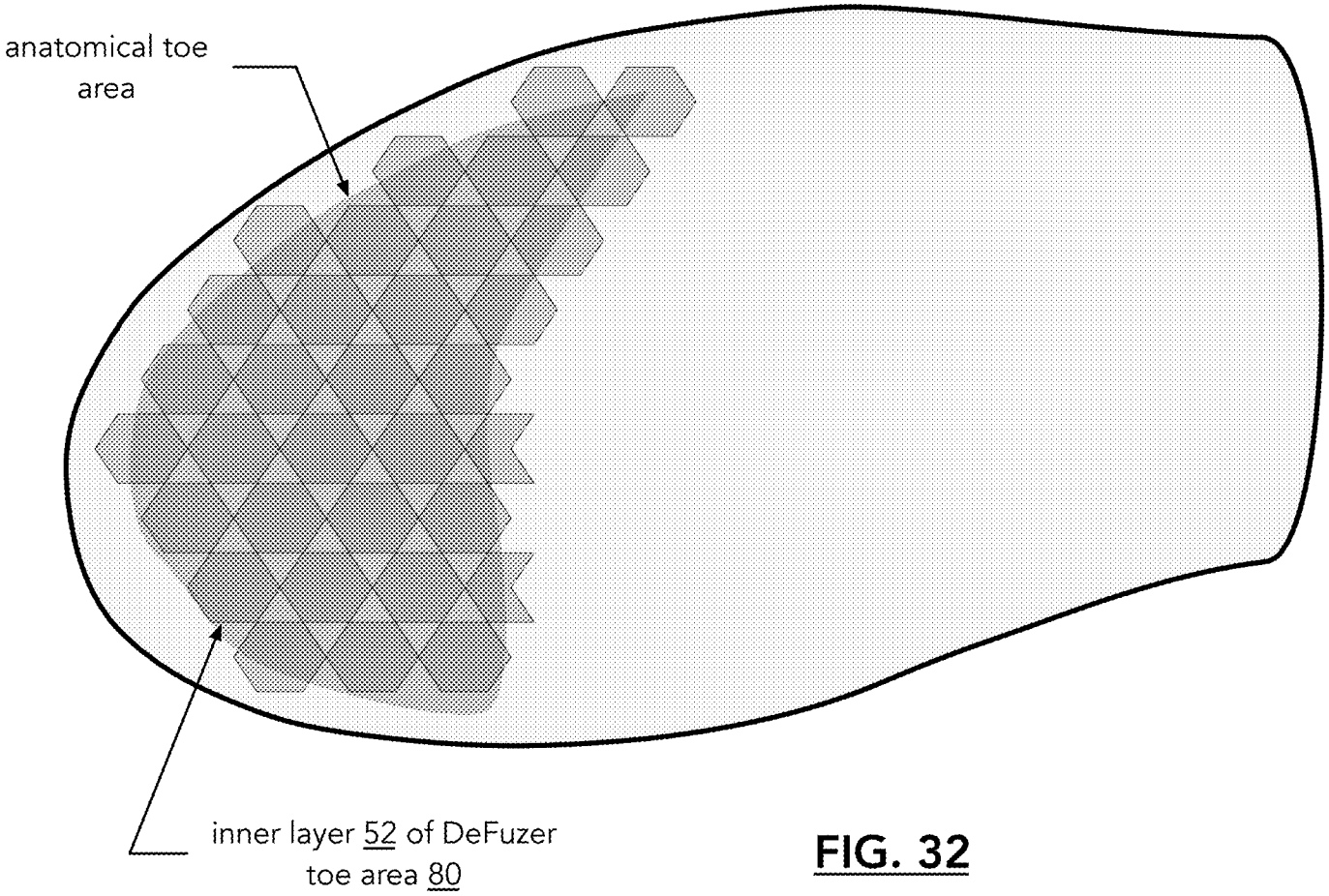
FIG. 32 is a top view of an embodiment of a toe section of a shoe.

FIG. 32 is a top view of an embodiment of a toe section 80 of a right shoe and the corresponding anatomical toe area. In this example, the inner layer includes hexagon shaped cells of equal size.

Figure 33:
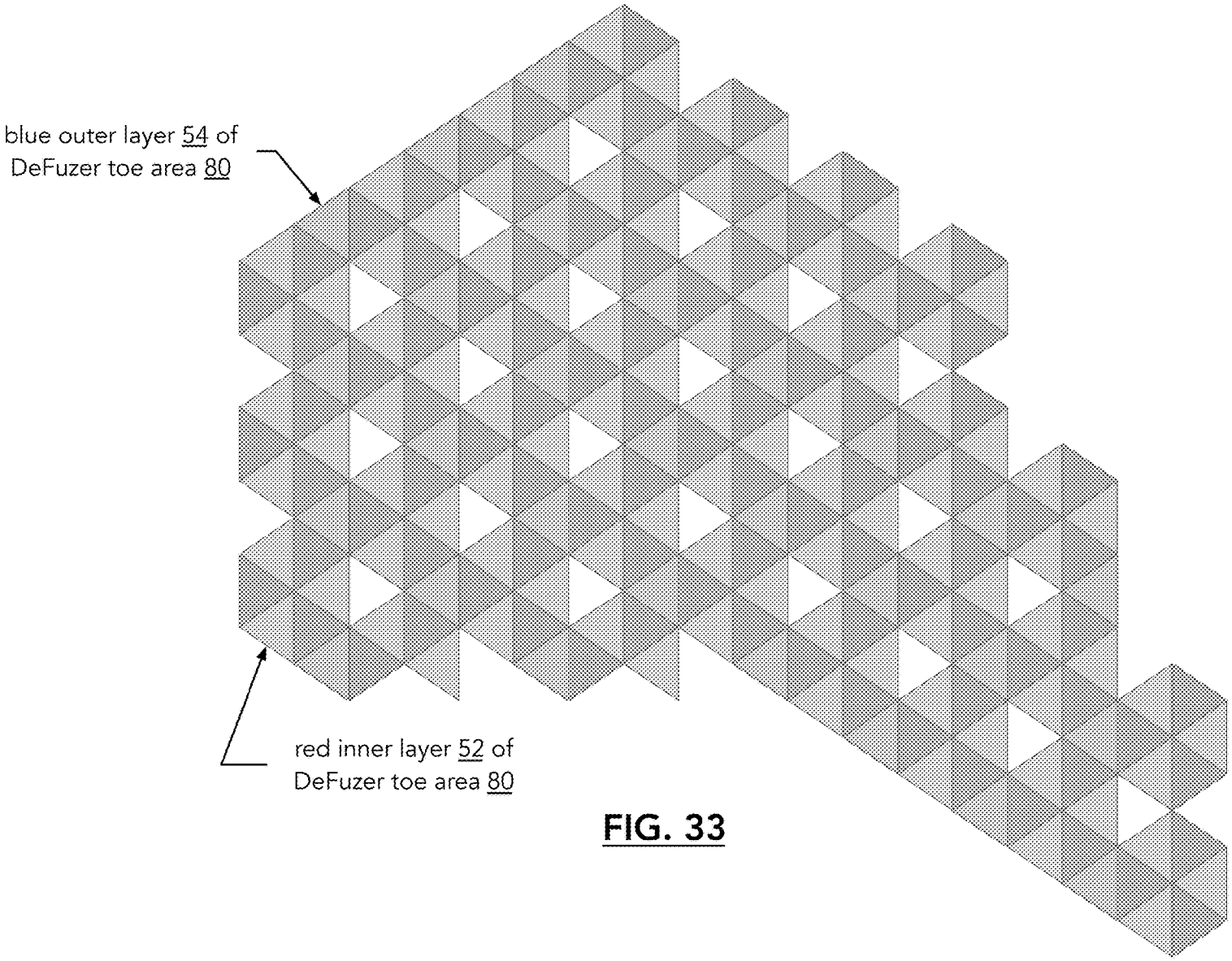
FIG. 33 is a diagram of an embodiment of a red inner layer and a blue outer layer of a DeFuzer toe section of a shoe.

FIG. 33 is a diagram of an embodiment of a red inner layer 52 and a blue outer layer of a DeFuzer toe section 54 of a left shoe from a bottom perspective. The cells of the inner layer are hexagons and the cells of the outer layer are triangles. The shape and size of the cells allows the toe pattern to conform to the anatomical toe area.

Figure 34:
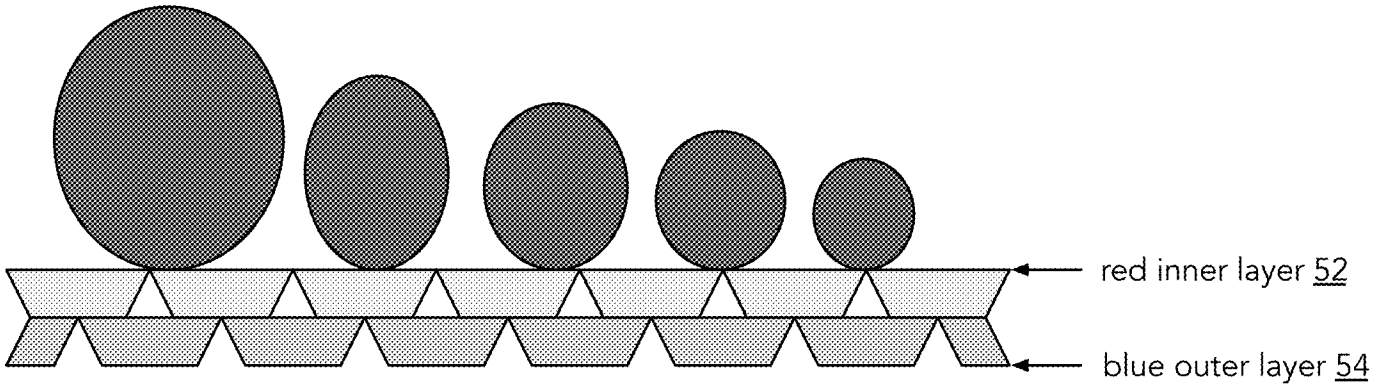
FIG. 34 is crosscut section view of an embodiment a toe section of a shoe.

FIG. 34 is crosscut section view of an embodiment a toe section of a left shoe from a front perspective. Thus, the left side of the figure is the medial side of a left shoe and the right side of the figure is the lateral side of the left shoe. As shown, the height of the DeFuzer section is substantially the same from the medial side to the lateral side of the shoe in the ball of foot area.

Figure 35:
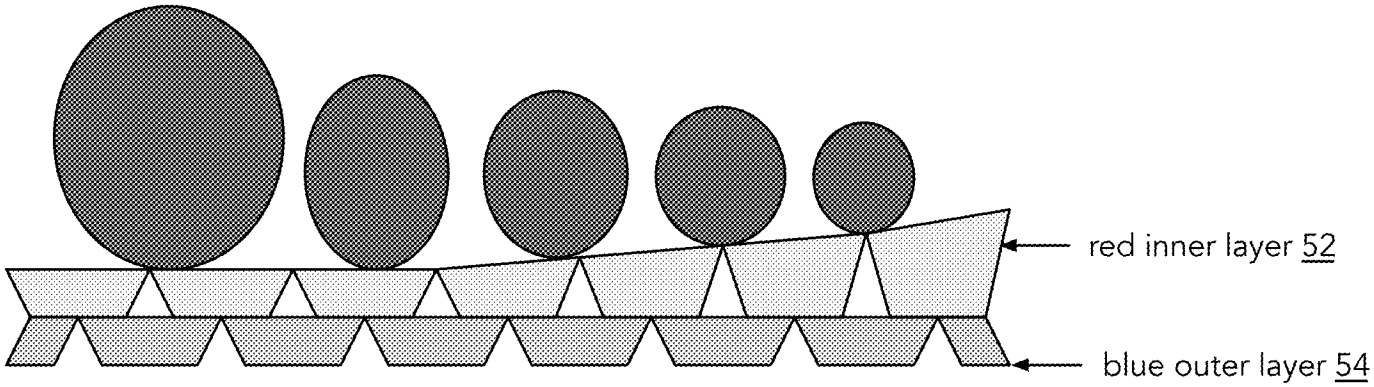
FIG. 35 is crosscut section view of another embodiment a toe section of a shoe.

FIG. 35 is crosscut section view of another embodiment a toe section of a left shoe from a front perspective. Thus, the left side of the figure is the medial side of a left shoe and the right side of the figure is the lateral side of the left shoe. As shown, the height of the DeFuzer section increases from the medial side to the lateral side of the shoe in the ball of foot area. The height of cells of the inner layer 52 near the medial edge may be substantially the same for 10 to 30 millimeters from medial to lateral edge before increasing. The rate of increase may be linear, increasing at an increasing rate, or increasing at a decreasing rate. The height of the cells of the outer layer 54 are of substantially the same height.

Figure 36:
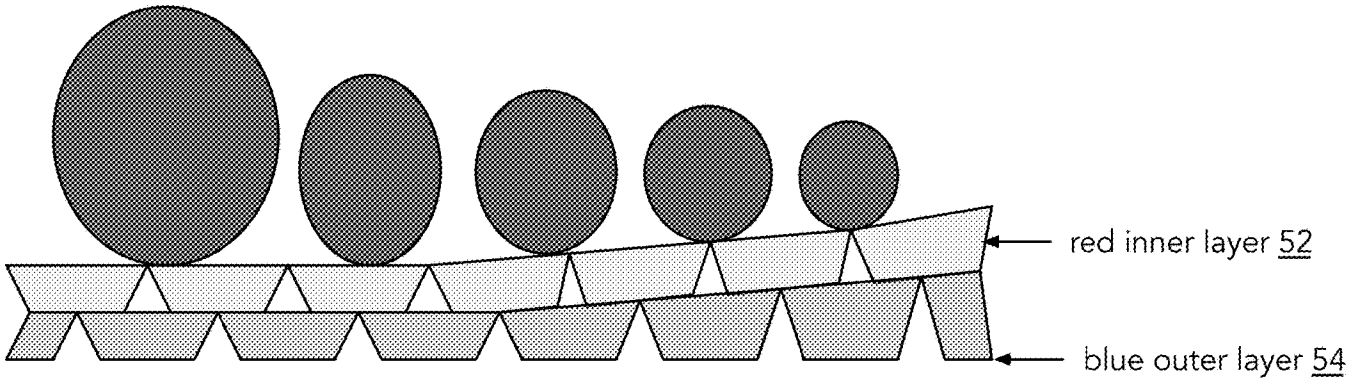
FIG. 36 is crosscut section view of another embodiment a toe section of a shoe.

FIG. 36 is crosscut section view of another embodiment a toe section of a shoe. This embodiment is similar to the embodiment of FIG. 35 with the exception that both layers have increasing heights from the medial edge to the lateral edge.

Figure 37:
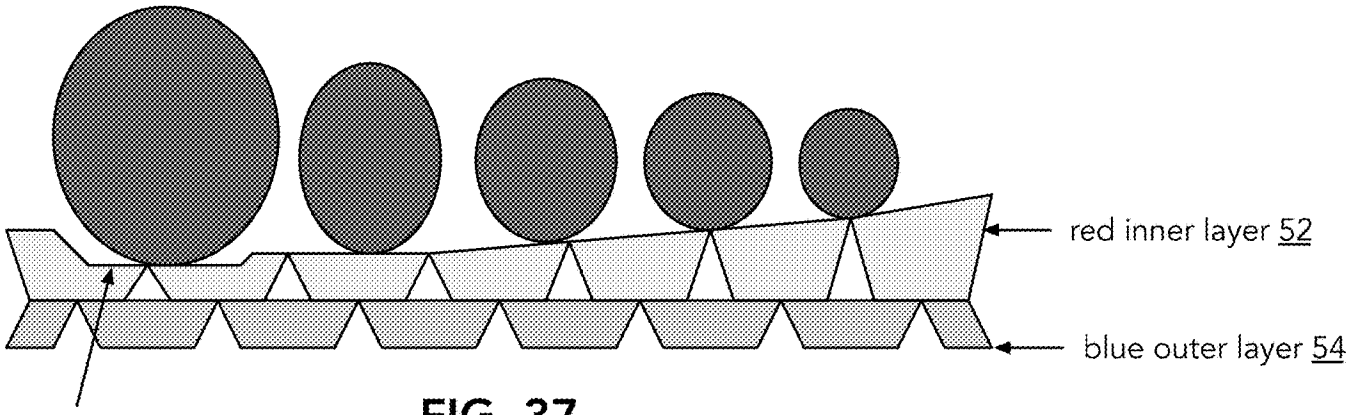
FIG. 37 is crosscut section view of another embodiment a toe section of a shoe.

FIG. 37 is crosscut section view of another embodiment a toe section of a shoe. This embodiment is similar to the embodiment of FIG. 35 with the addition of a big toe cup positioned proximal to the big toe, or first phalanges. The various slopes from medial to lateral side of a shoe, which provides optimal athletic positioning, is further described in U.S. Pat. No. 8,938,893.

Figure 38:
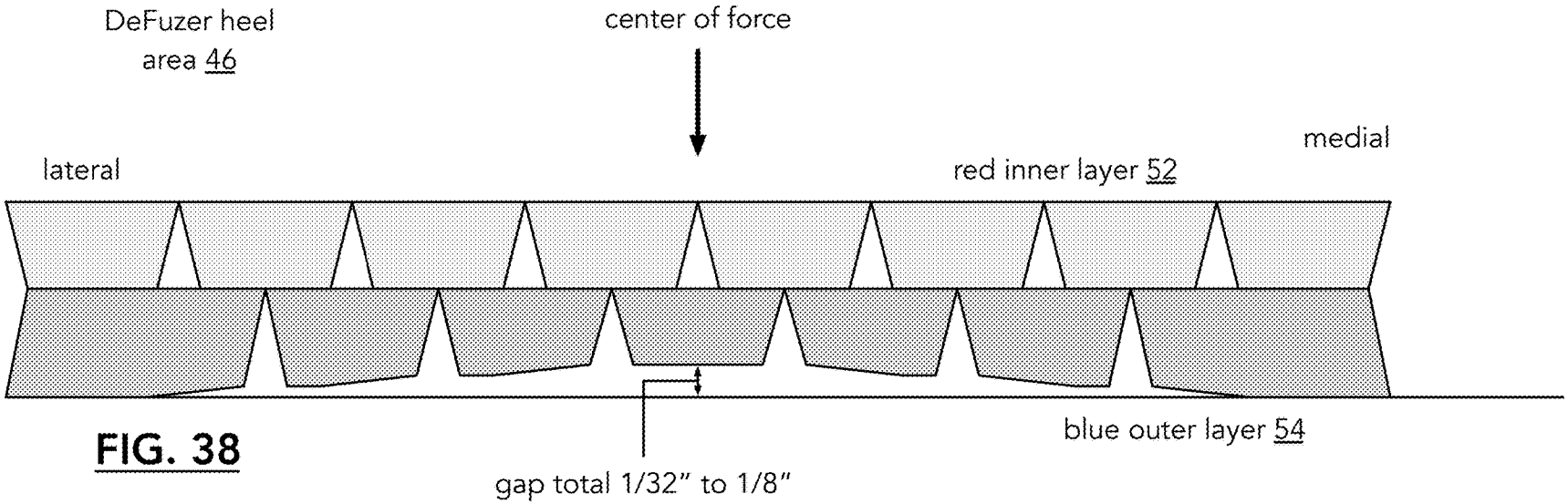
FIG. 38 is a diagram of an embodiment of a row of cells of a red inner layer and a row of cells of a blue outer layer of a DeFuzer section of a shoe.

FIG. 38 is a front view diagram (e.g., lateral to medial) of an embodiment of a row of cells of a red inner layer 52 and a row of cells of a blue outer layer 54 of a DeFuzer section of a shoe. This embodiment includes a gap near the center of forces, which is created by cells of the blue outer layer 54 having different heights as shown. The difference in height is in the range of a millimeter to 5 or more millimeters. As the force is applied, the gap is compressed, and the force is distributed by the cells outwardly from the center of force.

Figure 39:
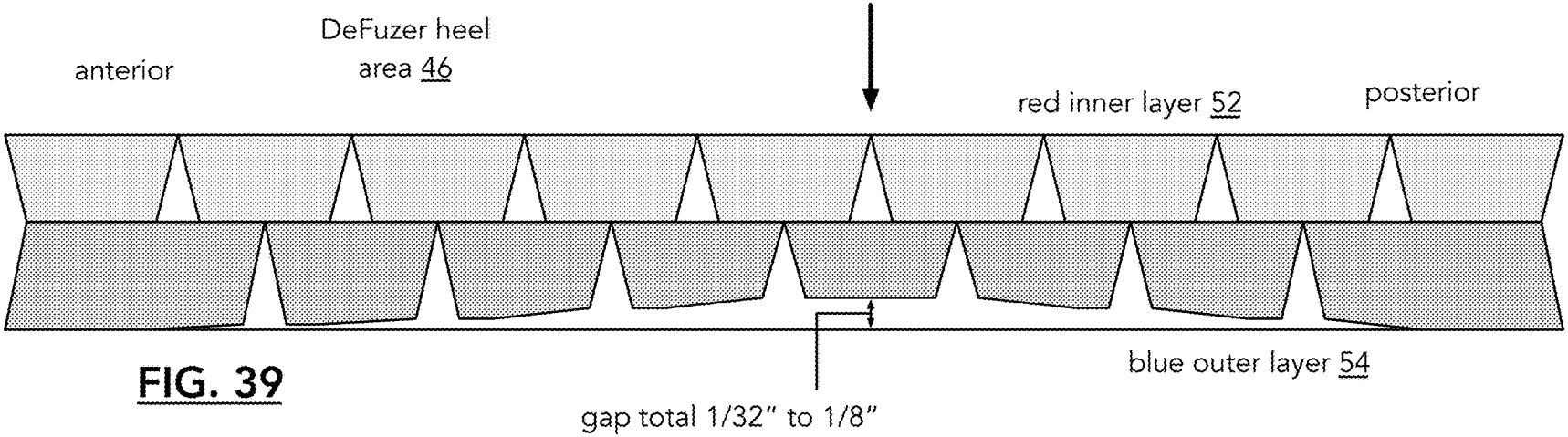
FIG. 39 is a diagram of an embodiment of a row of cells of a red inner layer and a row of cells of a blue outer layer of a DeFuzer section of a shoe.

FIG. 39 is a side view diagram (e.g., anterior to posterior) of an embodiment of a row of cells of a red inner layer 52 and a row of cells of a blue outer layer 54 of a DeFuzer section of the shoe of FIG. 38.

Figure 40:
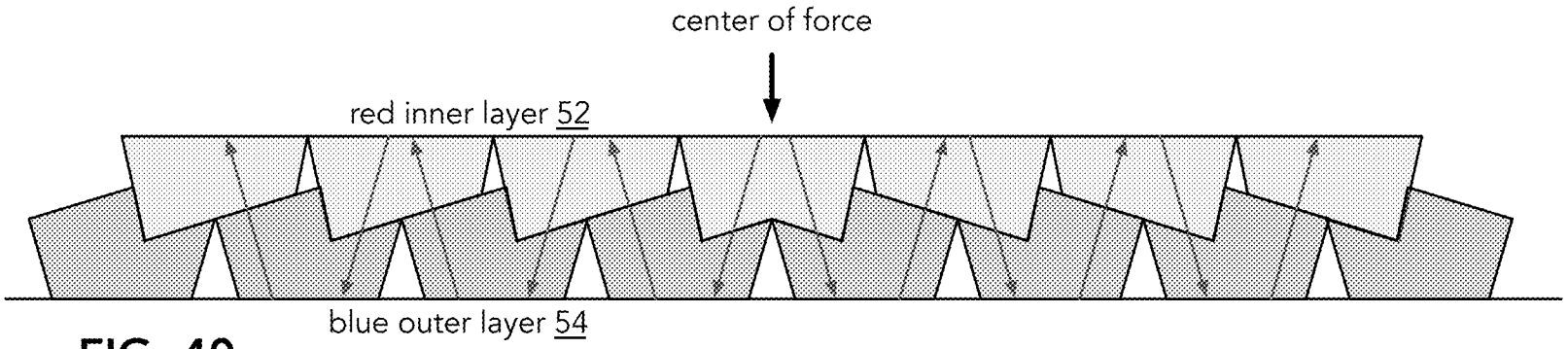
FIG. 40 is a diagram of another embodiment of a row of cells of a red inner layer and a row of cells of a blue outer layer of a DeFuzer section of a shoe.

FIG. 40 is a diagram of another embodiment of a row of cells of a red inner layer 52 and a row of cells of a blue outer layer 54 of a DeFuzer section of a shoe. The red lines illustrate the general distribution of forces as the body force and the ground reaction force are applied. With the sloped cell regions, the force (as illustrated by red lines) is directed more down the cell slope than up it. This creates a better and more even distribution of forces among the affected cells. A notch of a cell has a depth range from a fraction of a millimeter to one millimeter or more. The notching angle of a cell range from a fraction of a degree to 5 degrees or more.

Figure 41:
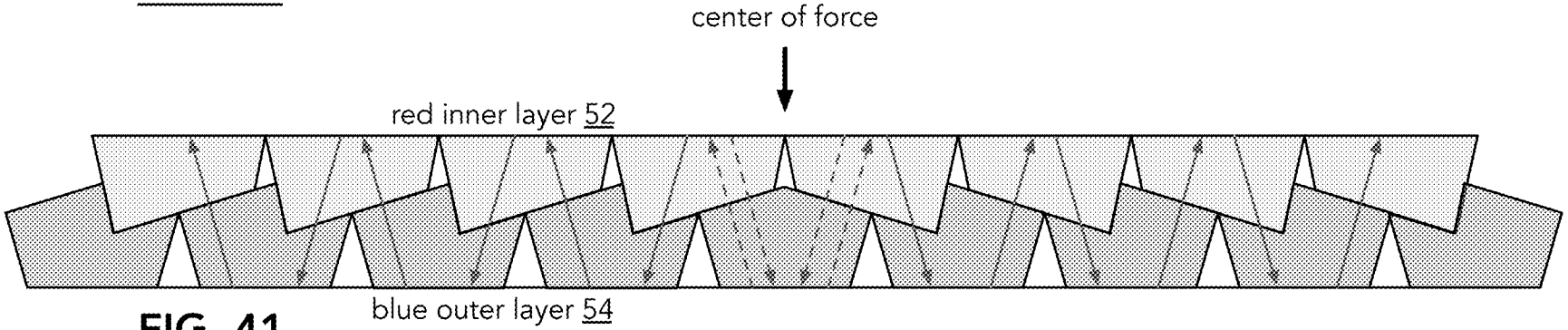
FIG. 41 is a diagram of an embodiment of a row of cells of a red inner layer and a row of cells of a blue outer layer of a DeFuzer section of a shoe.

FIG. 41 is a diagram of an embodiment of a row of cells of a red inner layer 52 and a row of cells of a blue outer layer 54 of a DeFuzer section of a shoe. The solid red lines illustrate the general distribution of forces as the body force and the dashed red lines illustrate the ground reaction force. With the sloped cell regions, the force is directed more down the cell slope than up it. This creates a better and more even distribution of forces among the affected cells. A notch of a cell has a depth range from a fraction of a millimeter to one millimeter or more. The notching angle of a cell range from a fraction of a degree to 5 degrees or more.

Figure 42:
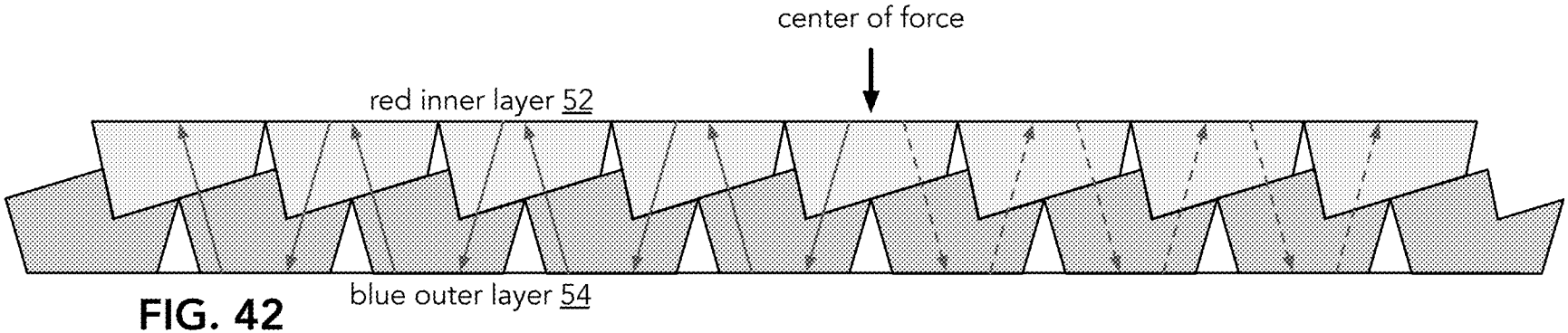
FIG. 42 is a diagram of an embodiment of a row of cells of a red inner layer and a row of cells of a blue outer layer of a DeFuzer section of a shoe.

FIG. 42 is a diagram of an embodiment of a row of cells of a red inner layer 52 and a row of cells of a blue outer layer 54 of a DeFuzer section of a shoe. In this embodiment, the solid red lines indicate a great force magnitude than the dashed red lines. As such, the force will propagate more to the left of center than to the right, where the solid red lines represent forces to propagating to the left and the dashed red lines represent forces propagating to the right. A notch of a cell has a depth range from a fraction of a millimeter to one millimeter or more. The notching angle of a cell range from a fraction of a degree to 5 degrees or more.

Figure 43:
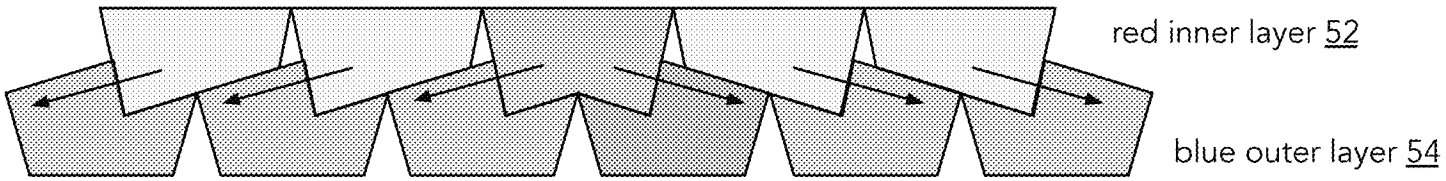
FIG. 43 is a diagram of an embodiment of a row of cells of a red inner layer and a row of cells of a blue outer layer of a DeFuzer section of a shoe.

FIG. 43 is a diagram of an embodiment of a row of cells of a red inner layer 52 and a row of cells of a blue outer layer 54 of a DeFuzer section of a shoe. This is a partial repeat of FIG. 40 to assist with the discussion of FIG. 44.

Figure 44:
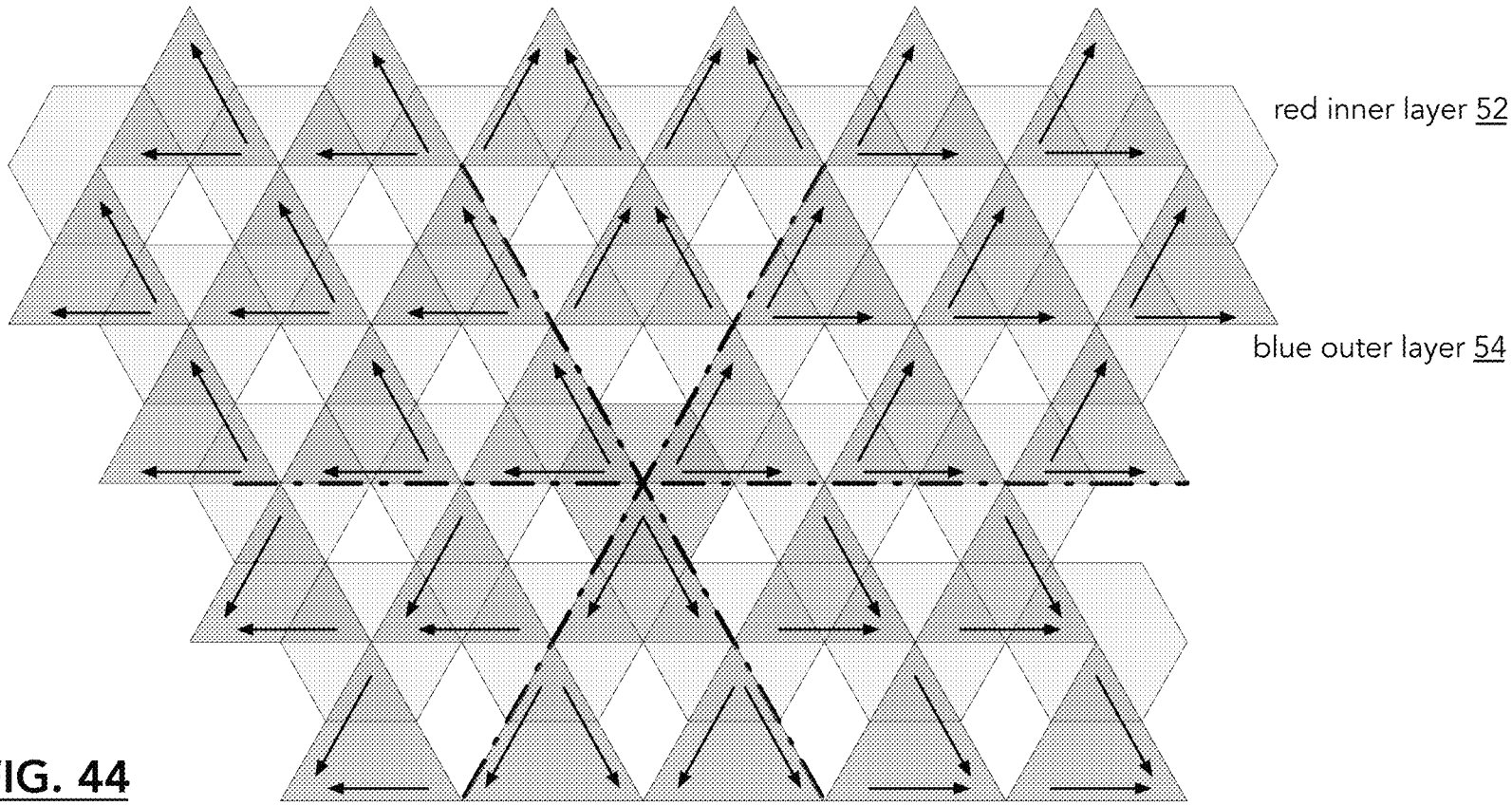
FIG. 44 is a top view diagram of an embodiment of a cells of a red inner layer overlaying cells of a blue outer layer of a DeFuzer section of a shoe.

FIG. 44 is a top view diagram of an embodiment of a cells of a red inner layer 52 overlaying cells of a blue outer layer 54 of a DeFuzer section of a shoe with respect to the cells of FIG. 43. In this figure, the arrows represent the direction of forces being traversed through the cells of both layers from a focal point of force as illustrated by the red hexagon. By distributing the force away from the highest pressure point(s), the pressure at this point is reduced, thereby providing comfort and mitigating loss of force through the shoes.

Figure 45A:
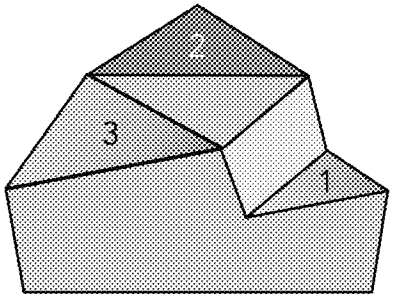
FIG. 45A is an isometric view of an embodiment of a cell of a blue outer layer of a DeFuzer section of a shoe.

FIG. 45A is an isometric view of an embodiment of a cell 90 of a blue outer layer 54 of a DeFuzer section of a shoe. This cell corresponds to an outer edge of FIG. 44. From a top perspective, it has an overall triangular shape. The top surface has three individual surfaces 1, 2, and 3 of a triangular shape and each are at an angle with respect to the bottom surface of the cell.

Figure 45B:
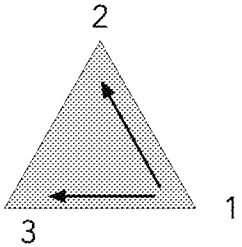
FIG. 45B is a diagram of an example of force direction for a cell of a blue outer layer of a DeFuzer section of FIG. 45A.

FIG. 45B is a diagram of an example of force direction for a cell 90 of a blue outer layer of a DeFuzer section of FIG. 45A. In this example, the force applied to surface 1 is propagated to the bottom layer under surfaces 2 and 3.

Figure 46:
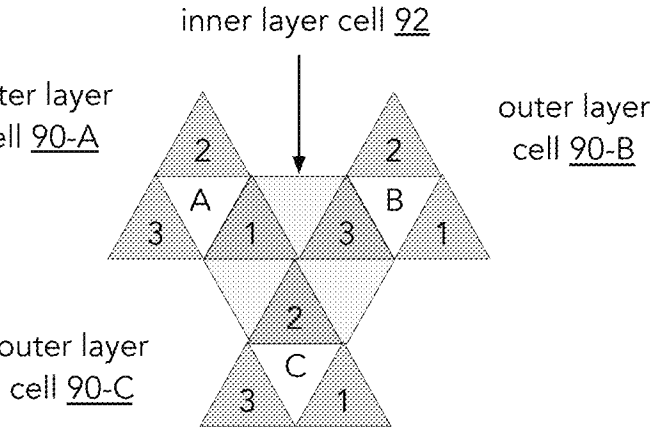
FIG. 46 is a diagram of an example of a cell of the red inner layer overlapping three cells a blue outer layer of a DeFuzer section of a shoe.

FIG. 46 is a diagram of an example of a cell of the red inner layer 52 overlapping three cells a blue outer layer 54 of a DeFuzer section of a shoe. The cells of the outer layer are triangular in shape and correspond to the cell of FIG. 45A. The cell of the red inner layer 52 has an overall shape from a top perspective of a hexagon. The top surface of the cell of the red inner layer 52 is substantially flat and substantially parallel to the substantially flat bottom surfaces of the cells of the blue outer layer 54.

The numbers indication the surfaces of the cells of the blue outer layer 54 to which the cell 92 of the red inner layer 52 is coupled. For example, cell 92 is coupled to surface 1 of outer layer cell 90-A, is coupled to surface 2 of outer layer cell 90-C, and to surface 3 of outer layer cell 90-B.

Figure 47A:
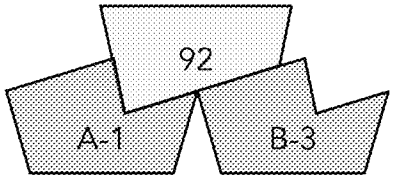
FIG. 47A is a first crosscut section view of an example a cell of the red inner layer overlapping two cells a blue outer layer of a DeFuzer section of FIG. 46.

FIG. 47A is a first crosscut section view of an example a cell 92 of the red inner layer 52 overlapping two cells 90 a blue outer layer 52 of a DeFuzer section of FIG. 46. As shown, cell 92 is coupled to surface 1 of outer cell 90-A and to surface 3 of outer cell 90-B.

Figure 47B:
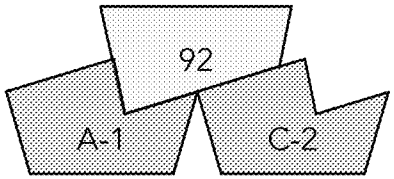
FIG. 47B is a first crosscut section view of an example a cell of the red inner layer overlapping two cells a blue outer layer of a DeFuzer section of FIG. 46.

FIG. 47B is a first crosscut section view of an example a cell 92 of the red inner layer 52 overlapping two cells 90 a blue outer layer 52 of a DeFuzer section of FIG. 46. As shown, cell 92 is coupled to surface 1 of outer cell 90-A and to surface 2 of outer cell 90-C.

Figure 47C:
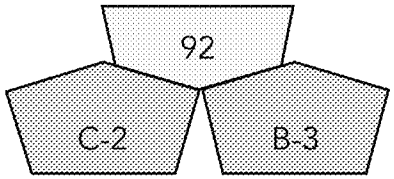
FIG. 47C is a third crosscut section view of an example a cell of the red inner layer overlapping two cells a blue outer layer of a DeFuzer section of FIG. 46.

FIG. 47C is a third crosscut section view of an example a cell 92 of the red inner layer 52 overlapping two cells 90 a blue outer layer 52 of a DeFuzer section of FIG. 46. As shown, cell 92 is coupled to surface 2 of outer cell 90-C and to surface 3 of outer cell 90-B.

Figure 48A:
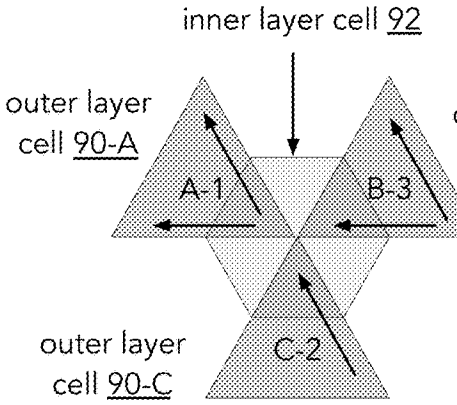
FIG. 48A is a diagram of an example a cell of the red inner layer overlapping three cells a blue outer layer of a DeFuzer section of a shoe.

FIG. 48A is a diagram of an example a cell 92 of the red inner layer 52 overlapping three cells 90A, B, and C of a blue outer layer 54 of a DeFuzer section of a shoe. The arrows indicate the propagation of forces through the cells.

Figure 48B:
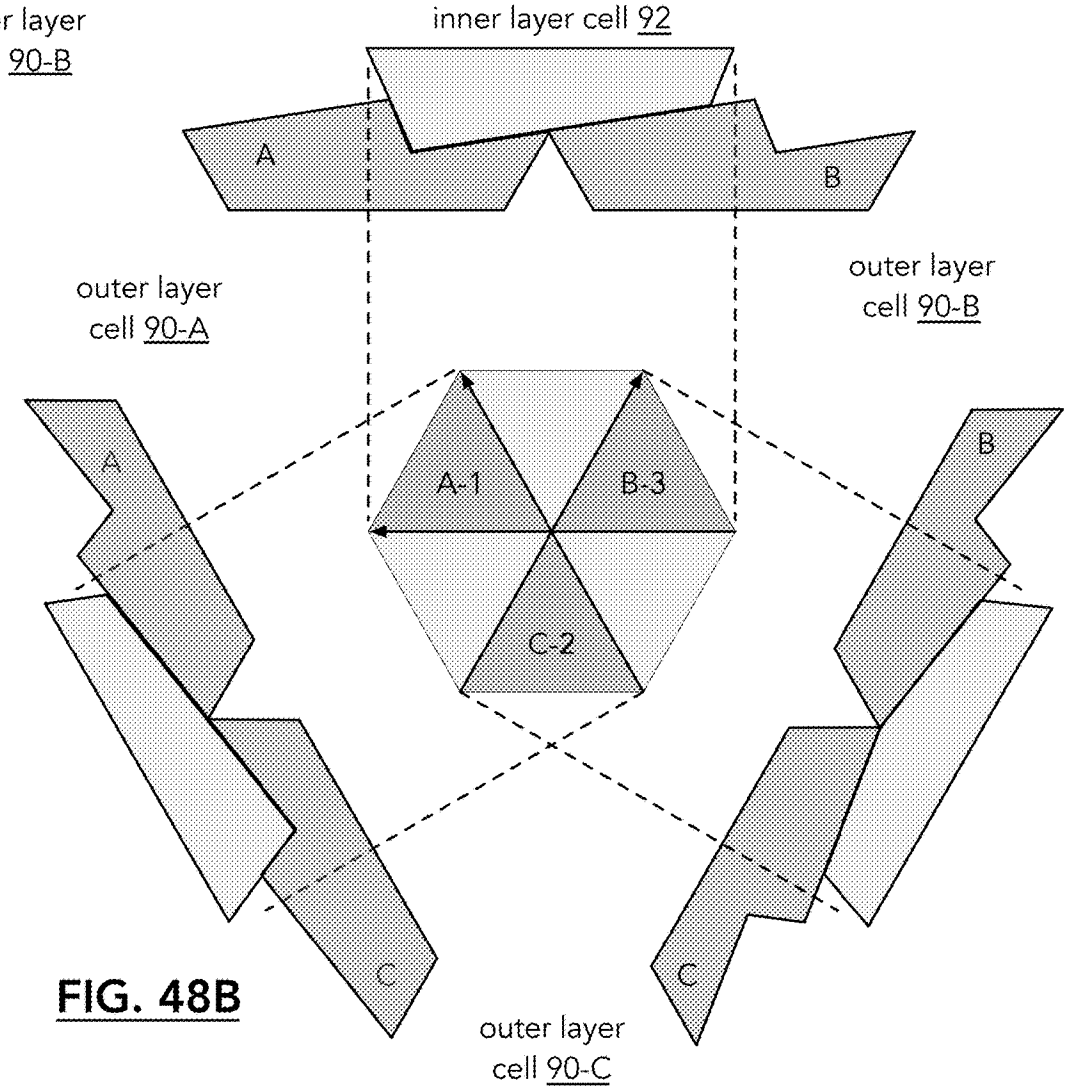
FIG. 48B is an exploded multiple side views of an example a cell of the red inner layer overlapping three cells a blue outer layer of a DeFuzer section of a shoe.

FIG. 48B is an exploded multiple side views of an example a cell 92 of the red inner layer 52 interconnected with cells 90A, B, and C of the blue outer layer 54 of a DeFuzer section of a shoe. As shown, the cell 92 has a substantially flat top surface with respect to the bottom surfaces of cells 90A, B, and C. The bottom surface of cell 92 is sloped downward (with respect to the bottom of cells 90A, B, and C) from cell 90C to cells 90A and 90B. The angle ranges from a fraction of a degree to five degrees or more.

Figure 49:
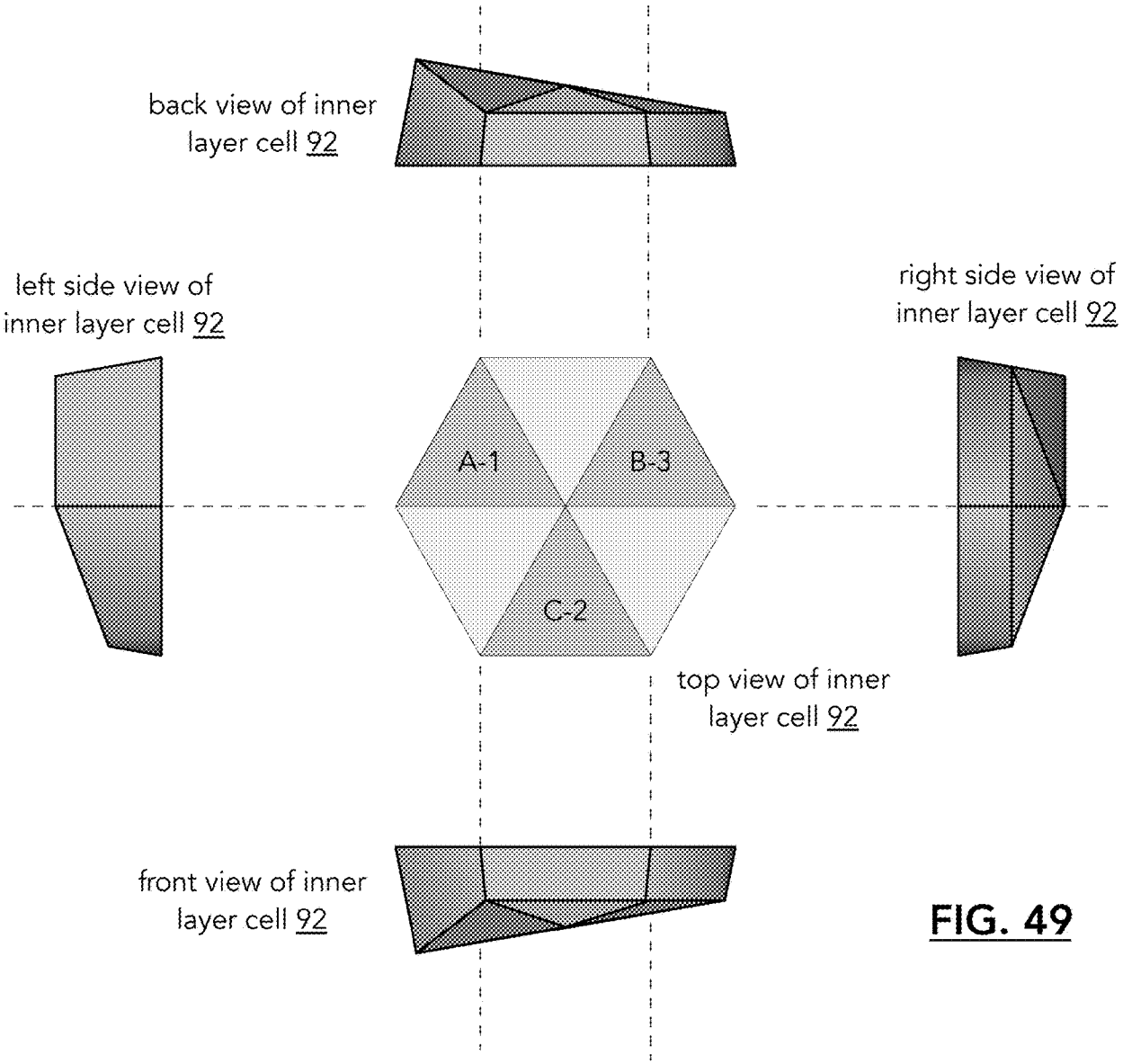
FIG. 49 is a top, front, bottom, left side, and right side view of an example a cell of the red inner layer of a DeFuzer section of a shoe.

FIG. 49 is a top, front, bottom, left side, and right side view of an example a cell 92 of the red inner layer 52 of a DeFuzer section of a shoe. As shown, the cell 92 has a substantially flat top surface with respect to the bottom surfaces of cells 90A, B, and C. The bottom surface of cell 92 includes several sloped surfaces to connect to the cells 90A, B, and C of the blue outer layer 54.

As shown in the front and back views, the bottom surface slopes upward from left to right of the cell 92. The left side view illustrates one flat bottom surface section and one sloped bottom surface section. The right side view illustrates one flat bottom surface section and several sloped bottom surface sections. The dimensions of the cell 92 are based on the shape and the overall size of a cell as discussed above. The dimensions of the sloped bottom surfaces are further based on the angle of the slopes.

FIG. 50A is an isometric view of an embodiment of a cell 94 of a blue outer layer 54 of a DeFuzer section of a shoe. This cell corresponds to an outer edge of FIG. 44. From a top perspective, it has an overall triangular shape. The top surface has three individual surfaces 1, 2, and 1 of a triangular shape and each are at an angle with respect to the bottom surface of the cell.

FIG. 50B is a diagram of an example of force direction for a cell 94 of a blue outer layer of a DeFuzer section of FIG. 45A. In this example, the force applied to the two surface is is propagated to the bottom layer under surface 2.

FIG. 51 is a diagram of an example of a cell 96 of the red inner layer 52 overlapping three cells 94A, B, and C a blue outer layer 54 of a DeFuzer section of a shoe. The cells of the outer layer are triangular in shape and correspond to the cell of FIG. 50A. The cell of the red inner layer 52 has an overall shape from a top perspective of a hexagon. The top surface of the cell of the red inner layer 52 is substantially flat and substantially parallel to the substantially flat bottom surfaces of the cells of the blue outer layer 54.

The numbers indication the surfaces of the cells of the blue outer layer 54 to which the cell 96 of the red inner layer 52 is coupled. For example, cell 96 is coupled to surface 1 of outer layer cell 94-A, is coupled to surface 2 of outer layer cell 94-C, and to surface 1 of outer layer cell 94-B.

FIG. 52A is a first crosscut section view of an example a cell 96 of the red inner layer 52 overlapping two cells 94 a blue outer layer 52 of a DeFuzer section of FIG. 51. As shown, cell 96 is coupled to surface 1 of outer cell 94-A and to surface 1 of outer cell 94-B.

FIG. 52B is a first crosscut section view of an example a cell 96 of the red inner layer 52 overlapping two cells 94 a blue outer layer 52 of a DeFuzer section of FIG. 51. As shown, cell 96 is coupled to surface 1 of outer cell 94-A and to surface 2 of outer cell 94-C.

FIG. 52C is a third crosscut section view of an example a cell 96 of the red inner layer 52 overlapping two cells 94 a blue outer layer 52 of a DeFuzer section of FIG. 51. As shown, cell 96 is coupled to surface 2 of outer cell 94-C and to surface 1 of outer cell 94-B.

Figure 53B:
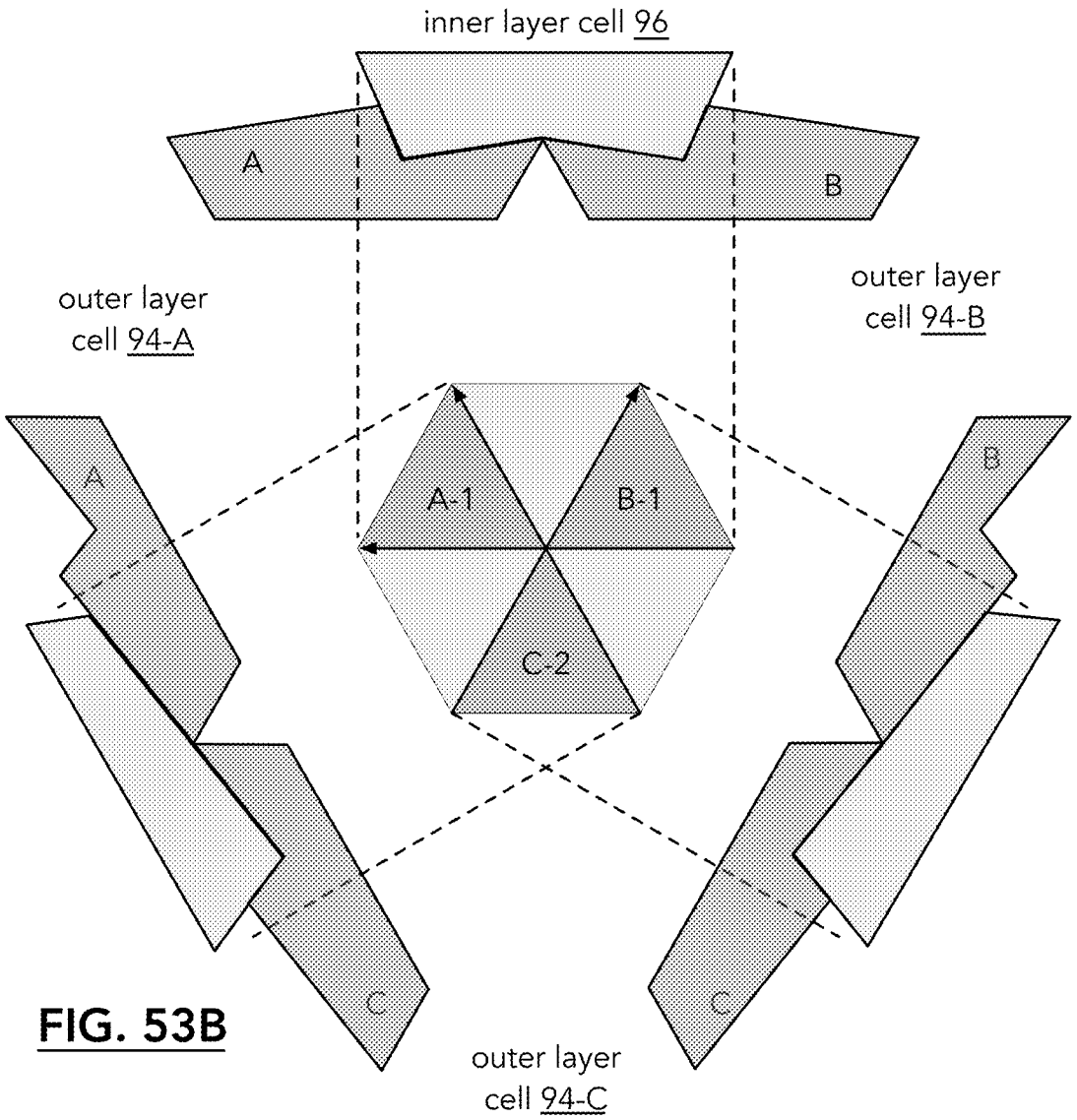
FIG. 53B is an exploded multiple side views of an example a cell of the red inner layer overlapping three cells a blue outer layer of a DeFuzer section of a shoe.
Figure 53A:
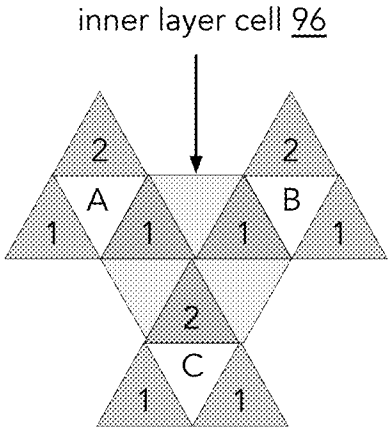
FIG. 53A is a diagram of an example a cell of the red inner layer overlapping three cells a blue outer layer of a DeFuzer section of a shoe.

FIG. 53A is a diagram of an example a cell 94 of the red inner layer 52 overlapping three cells 94A, B, and C of a blue outer layer 54 of a DeFuzer section of a shoe.

FIG. 53B is an exploded multiple side views of an example a cell 96 of the red inner layer 52 interconnected with cells 94A, B, and C of the blue outer layer 54 of a DeFuzer section of a shoe. As shown, the cell 96 has a substantially flat top surface with respect to the bottom surfaces of cells 94A, B, and C. The bottom surface of cell 96 is sloped downward (with respect to the bottom of cells 90A, B, and C) from cell 90C to cells 90A and 90B. The angle ranges from a fraction of a degree to five degrees or more.

Figure 54:
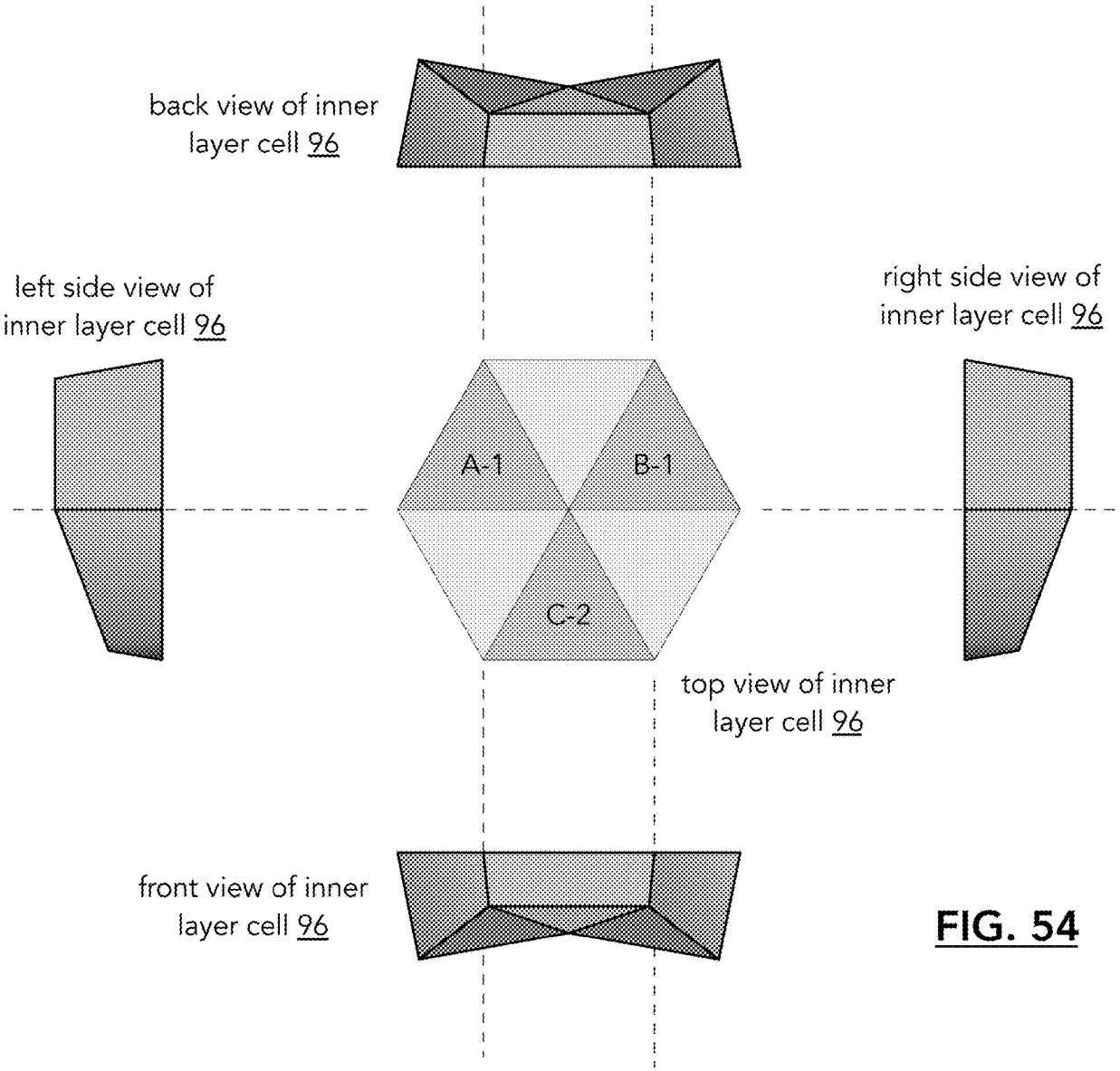
FIG. 54 is a top, front, bottom, left side, and right side view of another example a cell of the red inner layer of a DeFuzer section of a shoe.

FIG. 54 is a top, front, bottom, left side, and right side view of an example a cell 96 of the red inner layer 52 of a DeFuzer section of a shoe. As shown, the cell 96 has a substantially flat top surface with respect to the bottom surfaces of cells 94A, B, and C. The bottom surface of cell 96 includes several sloped surfaces to connect to the cells 94A, B, and C of the blue outer layer 54.

As shown in the front and back views, the bottom surface includes multiple slope surface areas. The left side view illustrates one flat bottom surface section and one sloped bottom surface section. The right side view illustrates one flat bottom surface section and one sloped bottom surface section. The dimensions of the cell 96 are based on the shape and the overall size of a cell as discussed above. The dimensions of the sloped bottom surfaces are further based on the angle of the slopes.

Figure 55A:
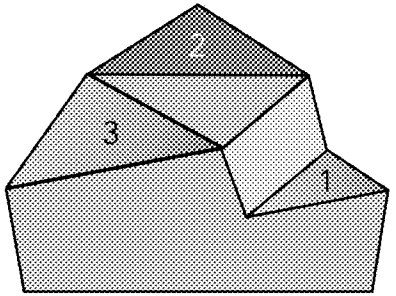
FIG. 55A is an isometric view of another embodiment of a cell of a blue outer layer of a DeFuzer section of a shoe.

FIG. 55A is an isometric view of an embodiment of a cell 90 of a blue outer layer 54 of a DeFuzer section of a shoe. This cell corresponds to an outer edge of FIG. 44. From a top perspective, it has an overall triangular shape. The top surface has three individual surfaces 1, 2, and 3 of a triangular shape and each are at an angle with respect to the bottom surface of the cell.

Figure 55B:
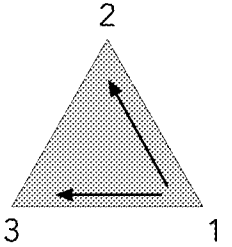
FIG. 55B is a diagram of another example of force direction for a cell of a blue outer layer of a DeFuzer section of FIG. 55A.

FIG. 55B is a diagram of an example of force direction for a cell 90 of a blue outer layer of a DeFuzer section of FIG. 55A. In this example, the force applied to surface 1 is propagated to the bottom layer under surfaces 2 and 3.

Figure 56B:
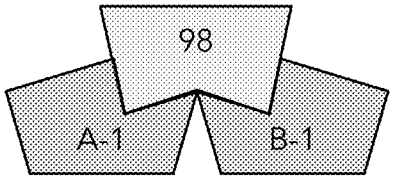
FIG. 56B is a first crosscut section view of an example a cell of the red inner layer overlapping two cells a blue outer layer of a DeFuzer section of FIG. 56A.
Figure 56C:
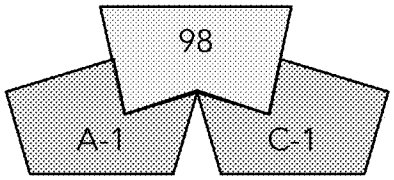
FIG. 56C is a first crosscut section view of an example a cell of the red inner layer overlapping two cells a blue outer layer of a DeFuzer section of FIG. 56A.
Figure 56D:
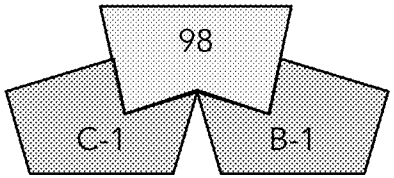
FIG. 56D is a third crosscut section view of an example a cell of the red inner layer overlapping two cells a blue outer layer of a DeFuzer section of FIG. 56A.
Figure 56A:
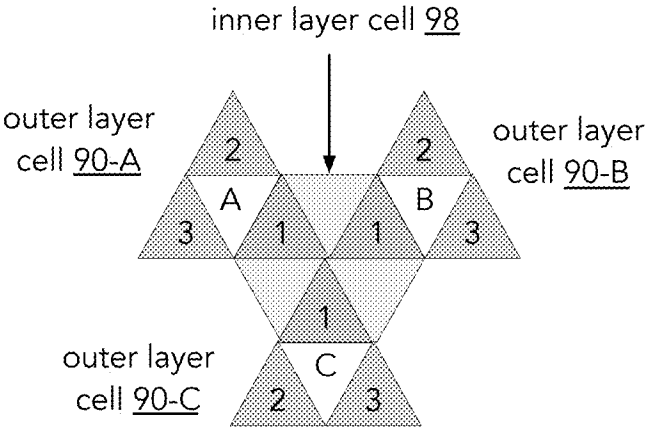
FIG. 56A is a diagram of another example of a cell of the red inner layer overlapping three cells a blue outer layer of a DeFuzer section of a shoe.

FIG. 56A is a diagram of an example of a cell 98 of the red inner layer 52 overlapping three cells a blue outer layer 54 of a DeFuzer section of a shoe. The cells of the outer layer are triangular in shape and correspond to the cell of FIG. 55A. The cell 98 of the red inner layer 52 has an overall shape from a top perspective of a hexagon. The top surface of the cell 98 of the red inner layer 52 is substantially flat and substantially parallel to the substantially flat bottom surfaces of the cells of the blue outer layer 54.

The numbers indication the surfaces of the cells of the blue outer layer 54 to which the cell 98 of the red inner layer 52 is coupled. For example, cell 98 is coupled to surface 1 of outer layer cell 90-A, is coupled to surface 1 of outer layer cell 90-C, and to surface 1 of outer layer cell 90-B.

FIG. 56B is a first crosscut section view of an example a cell 98 of the red inner layer 52 overlapping two cells 90 a blue outer layer 52 of a DeFuzer section of FIG. 56A. As shown, cell 98 is coupled to surface 1 of outer cell 90-A and to surface 1 of outer cell 90-B.

FIG. 56C is a first crosscut section view of an example a cell 98 of the red inner layer 52 overlapping two cells 90 a blue outer layer 52 of a DeFuzer section of FIG. 56A. As shown, cell 98 is coupled to surface 1 of outer cell 90-A and to surface 1 of outer cell 90-C.

FIG. 56D is a third crosscut section view of an example a cell 98 of the red inner layer 52 overlapping two cells 90 a blue outer layer 52 of a DeFuzer section of FIG. 56A. As shown, cell 98 is coupled to surface 2 of outer cell 90-C and to surface 3 of outer cell 90-B.

Figure 57B:
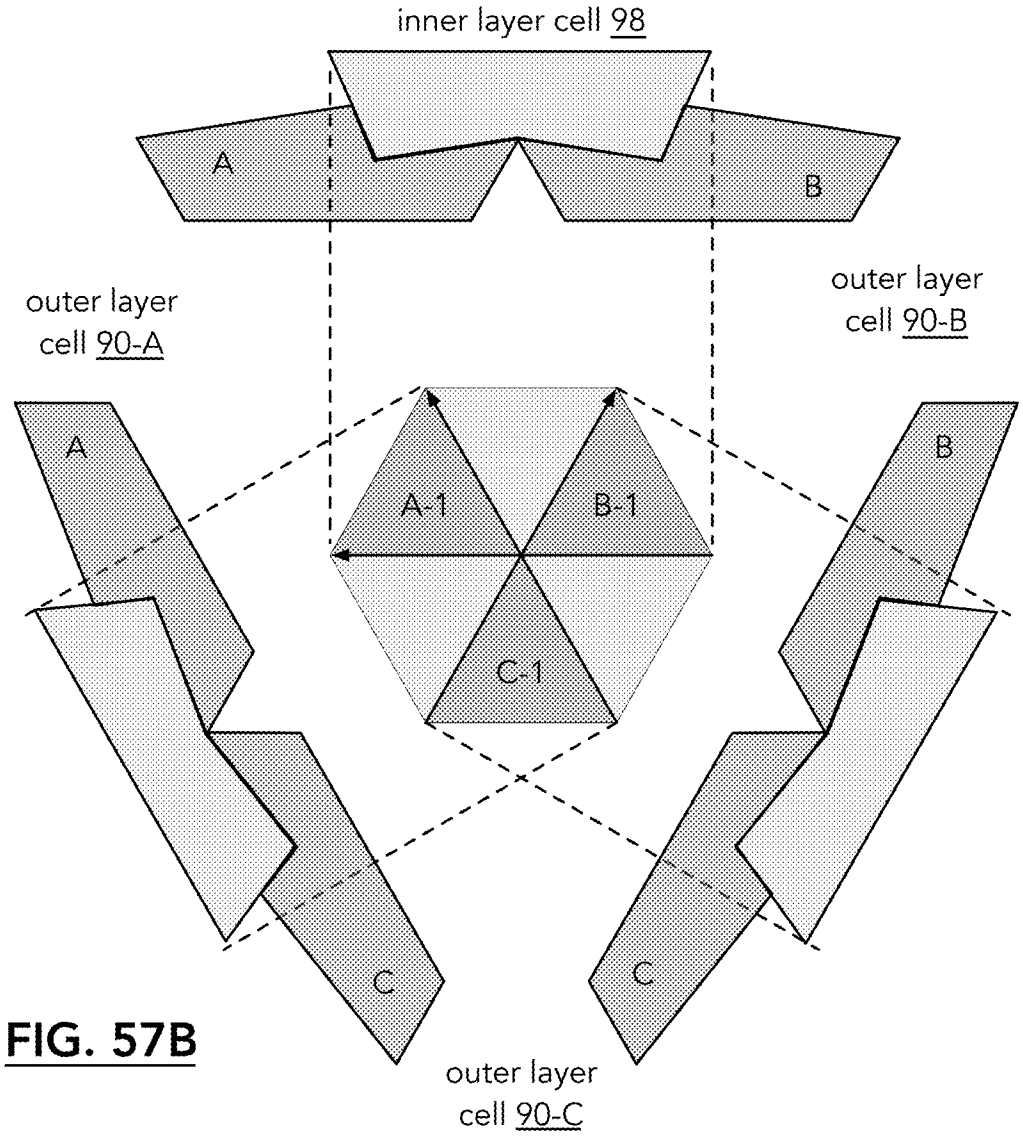
FIG. 57B is an exploded multiple side views of an example a cell of the red inner layer overlapping three cells a blue outer layer of a DeFuzer section of a shoe.
Figure 57A:
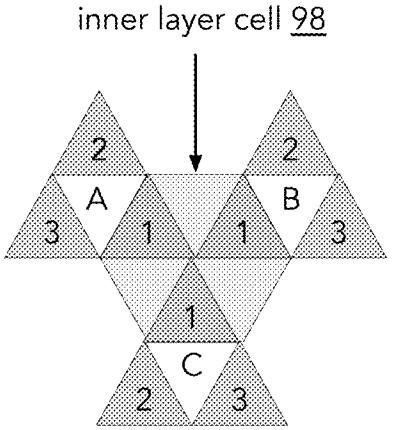
FIG. 57A is a diagram of an example a cell of the red inner layer overlapping three cells a blue outer layer of a DeFuzer section of a shoe.

FIG. 57A is a diagram of an example a cell 98 of the red inner layer 52 overlapping three cells 90A, B, and C of a blue outer layer 54 of a DeFuzer section of a shoe.

FIG. 57B is an exploded multiple side views of an example a cell 98 of the red inner layer 52 interconnected with cells 90A, B, and C of the blue outer layer 54 of a DeFuzer section of a shoe. As shown, the cell 98 has a substantially flat top surface with respect to the bottom surfaces of cells 90A, B, and C. The bottom surface of cell 98 is sloped downward (with respect to the bottom of cells 90A, B, and C) from the center of the cell. The angle ranges from a fraction of a degree to five degrees or more.

Figure 58:
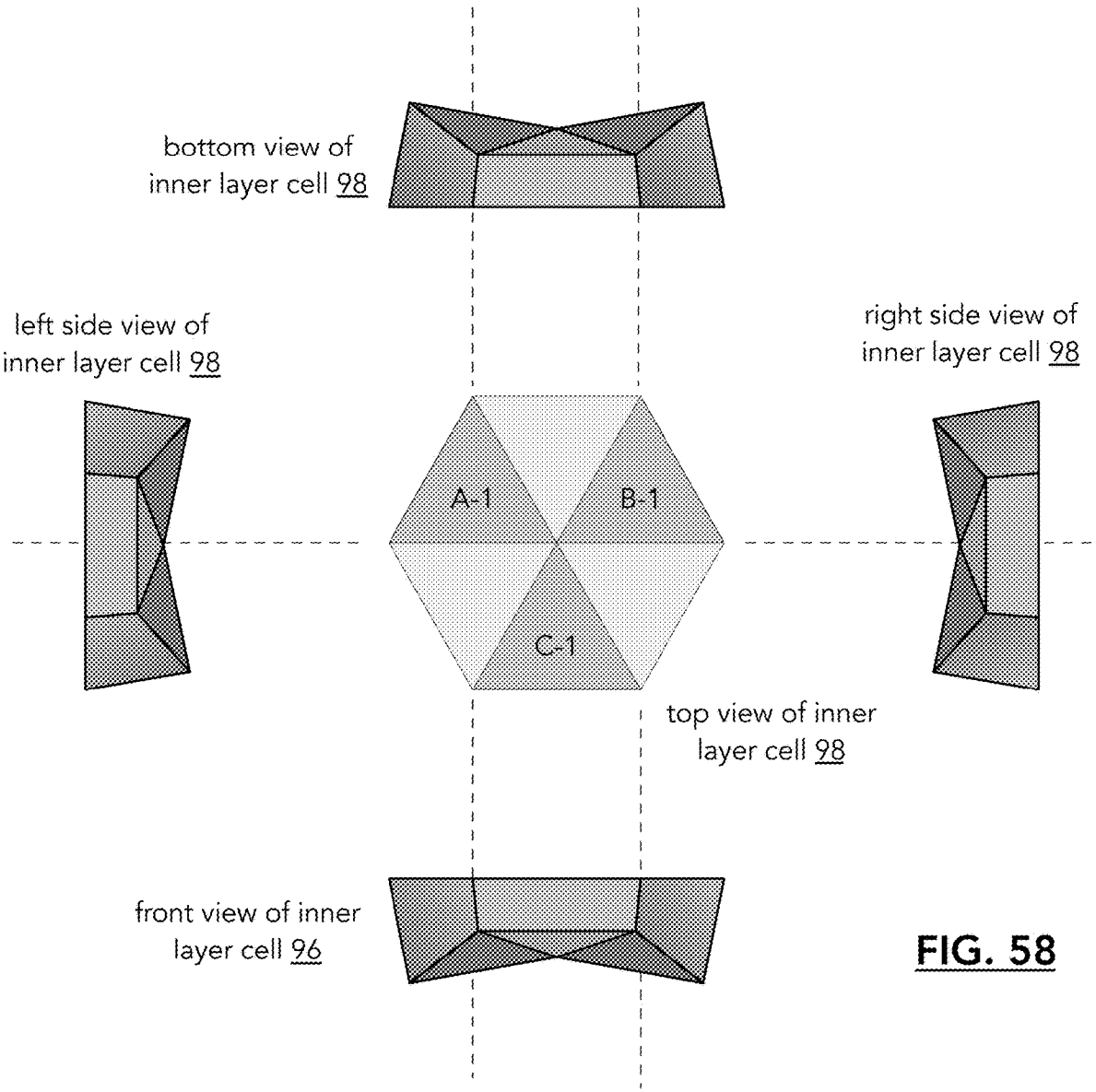
FIG. 58 is a top, front, bottom, left side, and right side view of another example a cell of the red inner layer of a DeFuzer section of a shoe.

FIG. 58 is a top, front, bottom, left side, and right side view of an example a cell 98 of the red inner layer 52 of a DeFuzer section of a shoe. As shown, the cell 98 has a substantially flat top surface with respect to the bottom surfaces of cells 90A, B, and C. The bottom surface of cell 98 includes several sloped surfaces to connect to the cells 90A, B, and C of the blue outer layer 54.

As shown in each of the views, the bottom surface includes multiple slope surface areas. The dimensions of the cell 98 are based on the shape and the overall size of a cell as discussed above. The dimensions of the sloped bottom surfaces are further based on the angle of the slopes.

Figure 59:
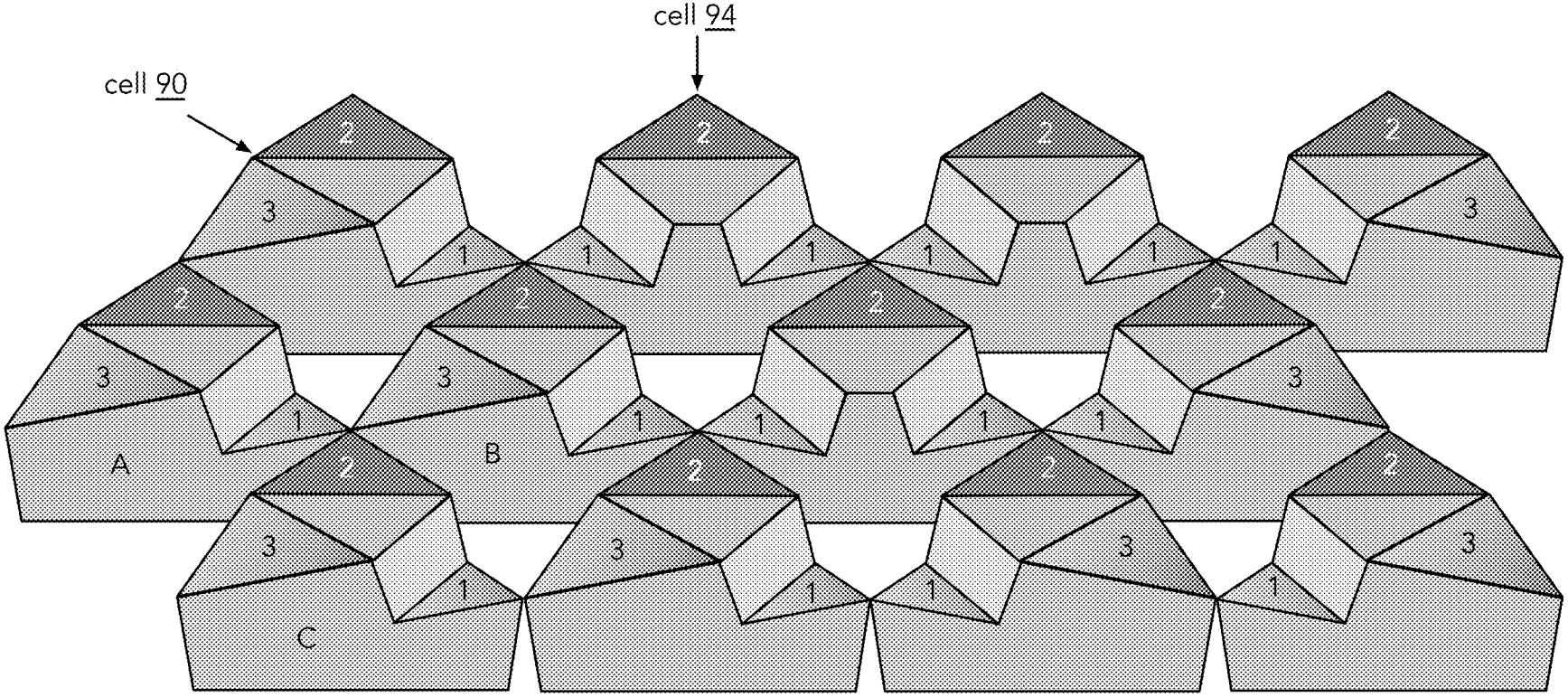
FIG. 59 is an isometric view of another embodiment of a blue outer layer of a DeFuzer section of a shoe.

FIG. 59 is an isometric view of another embodiment of a blue outer layer 54 of a DeFuzer section of a shoe that includes cells 90 and 94.

Figure 60:
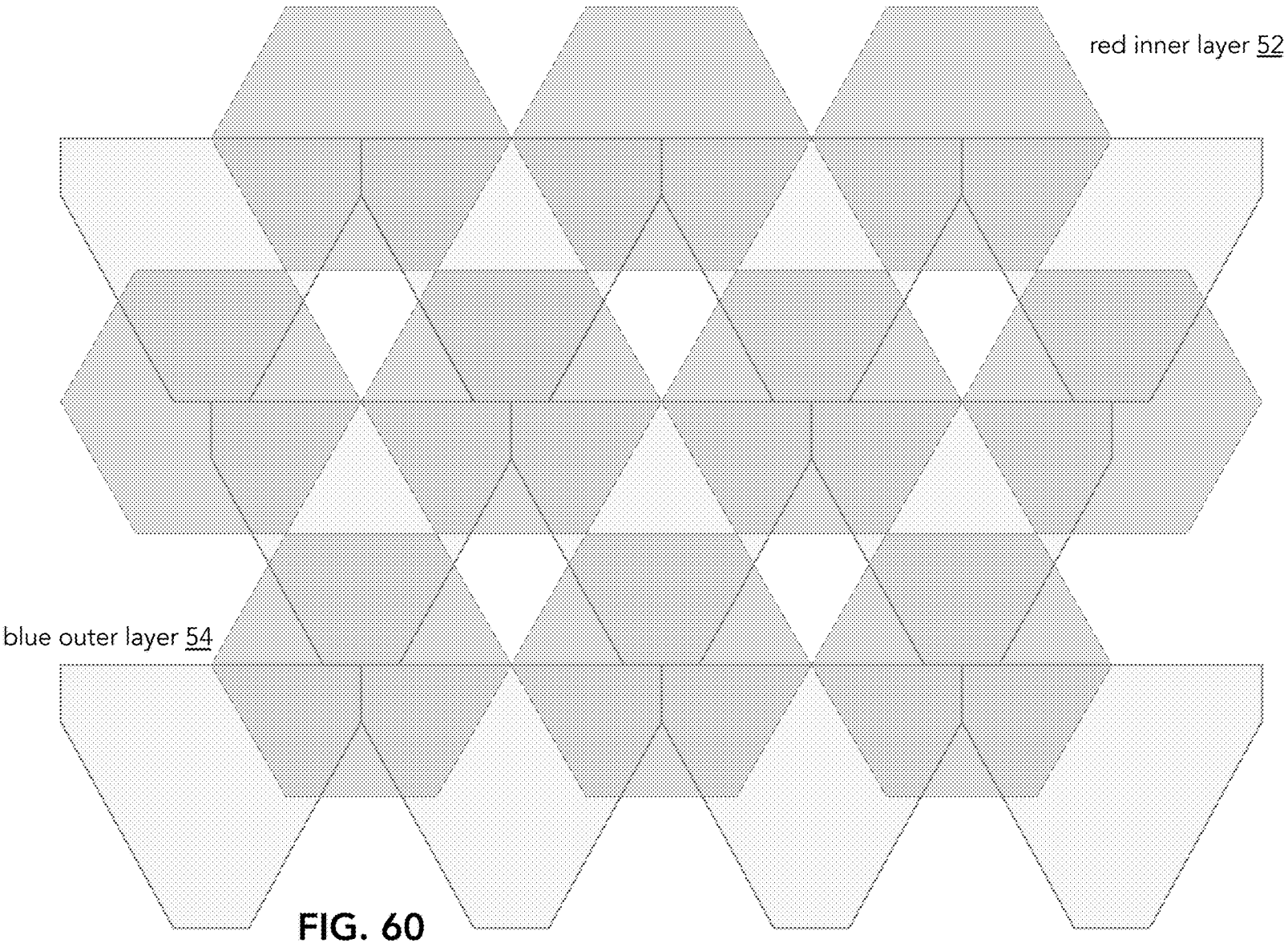
FIG. 60 is a diagram of another example of a red inner layer overlapping a blue outer layer of a DeFuzer section of a shoe.

FIG. 60 is a diagram of another example of a red inner layer 52 overlapping a blue outer layer 54 of a DeFuzer section of a shoe. In this example, the cells of the blue outer layer 54 have a substantially triangular shape with the ends point squared off. This creates move overlap with the cells of the inner layer 52.

Figure 61:
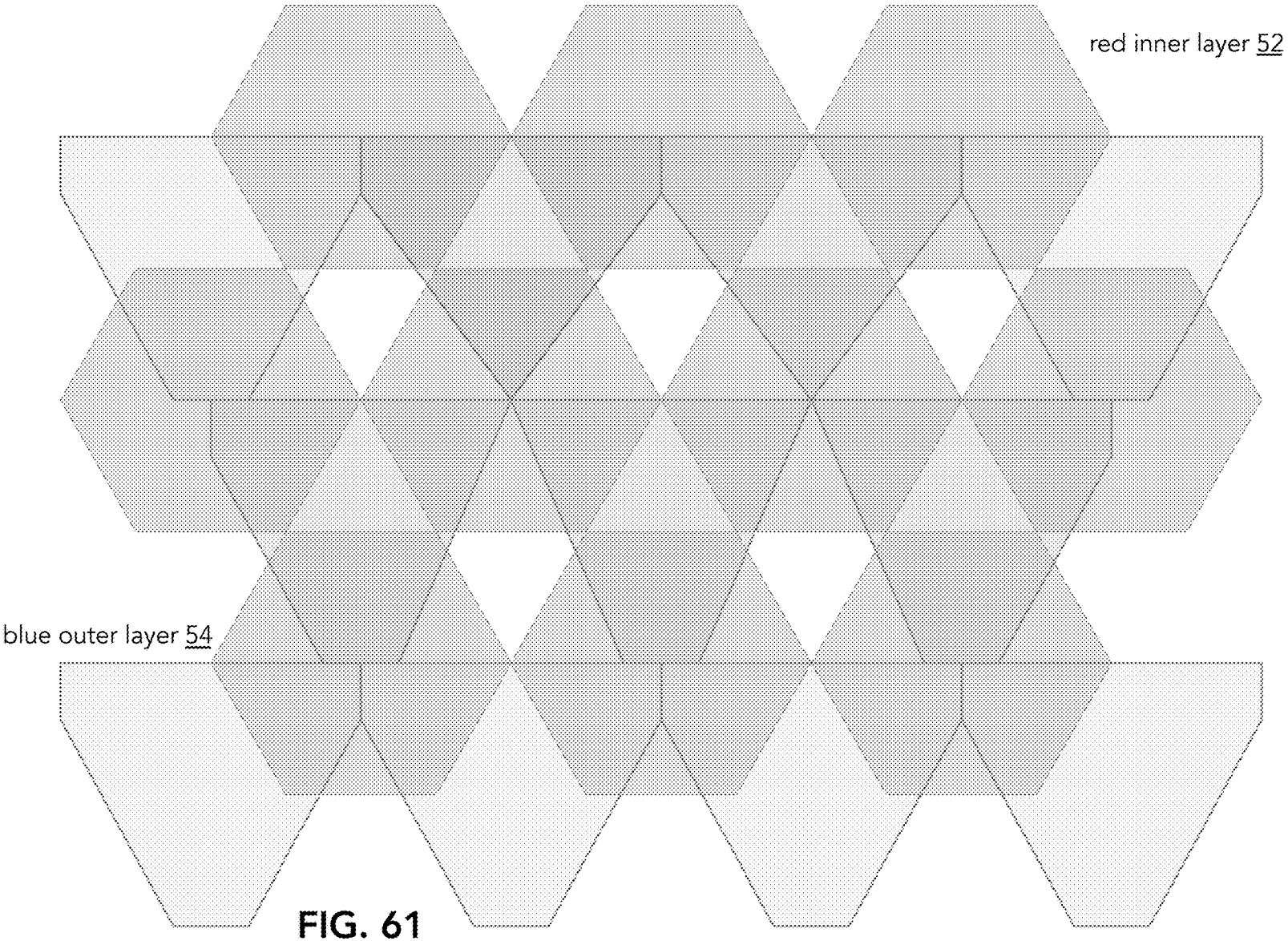
FIG. 61 is a diagram of another example of a red inner layer overlapping a blue outer layer of a DeFuzer section of a shoe.

FIG. 61 is a diagram of another example of a red inner layer 52 overlapping a blue outer layer 54 of a DeFuzer section of a shoe that is similar to FIG. 60. In this illustration, some of the cells of the blue outer layer 54 include two of its end points squared off and the other end point coming to a point. Further, some of the cells of the blue outer layer 54 include one of its end points squared off and the other two end points coming to a point.

Figure 62A:
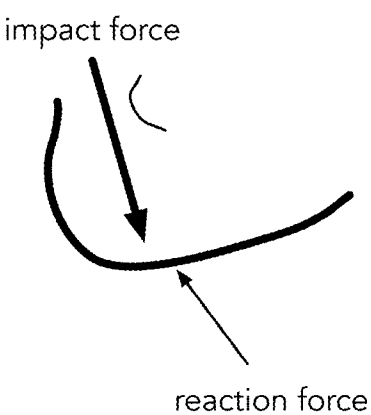
FIGS. 62A through 62D are diagrams of an example of impact force and reaction force of a shoe with a DeFuzer heel section.
Figure 62B:
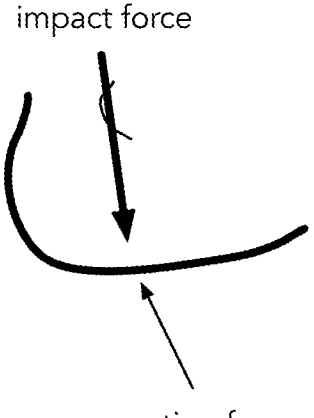
Figure 62C:
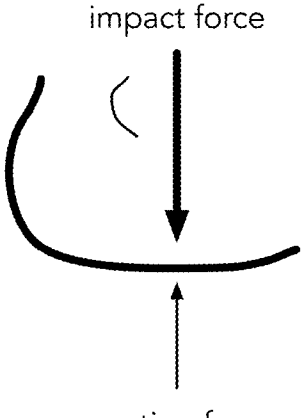
Figure 62D:
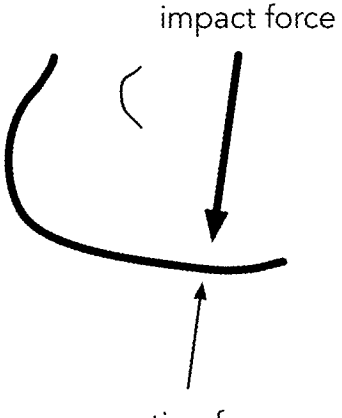

FIGS. 62A through 62D are diagrams of an example of impact force and reaction force of a shoe with a DeFuzer heel section. In FIG. 62A, as the heel is first striking the ground, the DeFuzer section of the heel shifts the angle of the reaction force towards the anterior portion of the shoe (e.g., a degree to 5 degrees or more). As the heel contract transitions for FIG. 62B to 62D, the DeFuzer heel sections gradually adjusts the angle of the reaction force to be equal and opposition of the impact force. By shifting the angle, the impact pressure of the impact force is reduced.

Figure 63A:
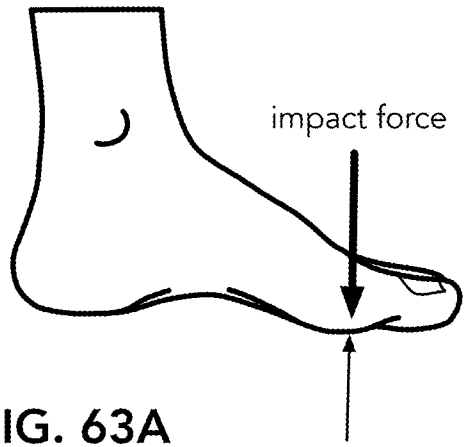
FIGS. 63A through 63C are diagrams of an example of impact force and reaction force of a shoe with a DeFuzer ball of foot section and/or a DeFuzer toe section.
Figure 63B:
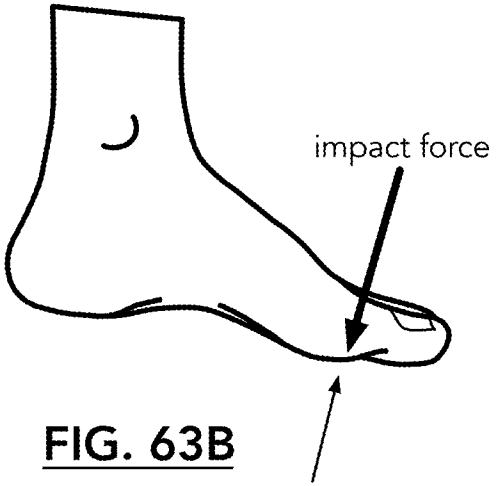
Figure 63C:
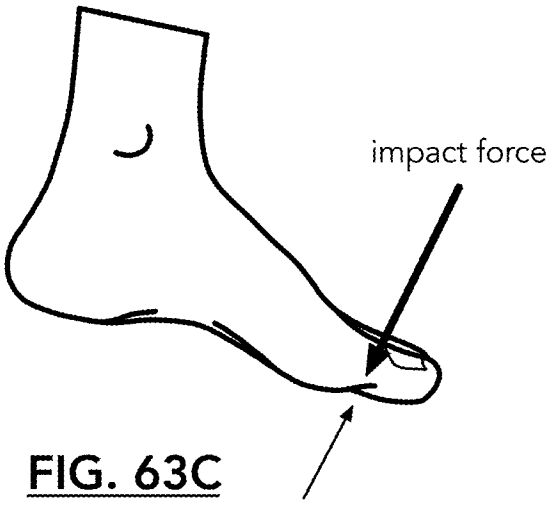

FIGS. 63A through 63C are diagrams of an example of impact force and reaction force of a shoe with a DeFuzer ball of foot section and/or a DeFuzer toe section. For the toe push off, the ball of foot and/or toe DeFuzer section(s) gradually adjusts the angle of the reaction force from being equal and opposition of the impact force to angling towards the posterior of the shoe (e.g., a degree to five or more degrees). By shifting the angle, the impact pressure of the impact force is reduced.

Figure 64B:
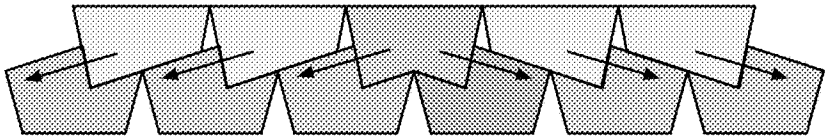
FIGS. 64A and 64B are a diagrams of another example of body force and a directional reaction force via a DeFuzer section of a shoe.
Figure 64A:
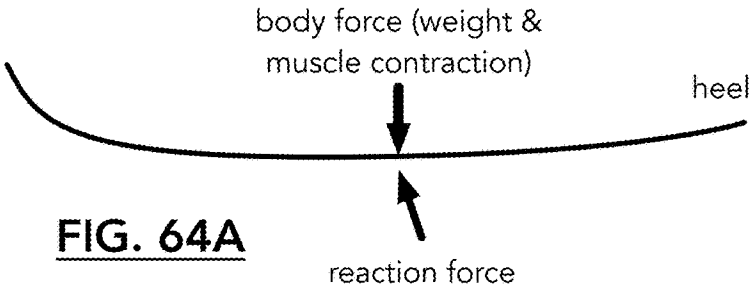

FIGS. 64A and 64B are diagrams of another example of body force and a directional reaction force via a DeFuzer section of a shoe with respect to the heel. The DeFuzer section of the heel shifts the angle of the reaction force towards the anterior portion of the shoe (e.g., a degree to 5 degrees or more). By shifting the angle, the impact pressure of the impact force is reduced.

Figure 65:
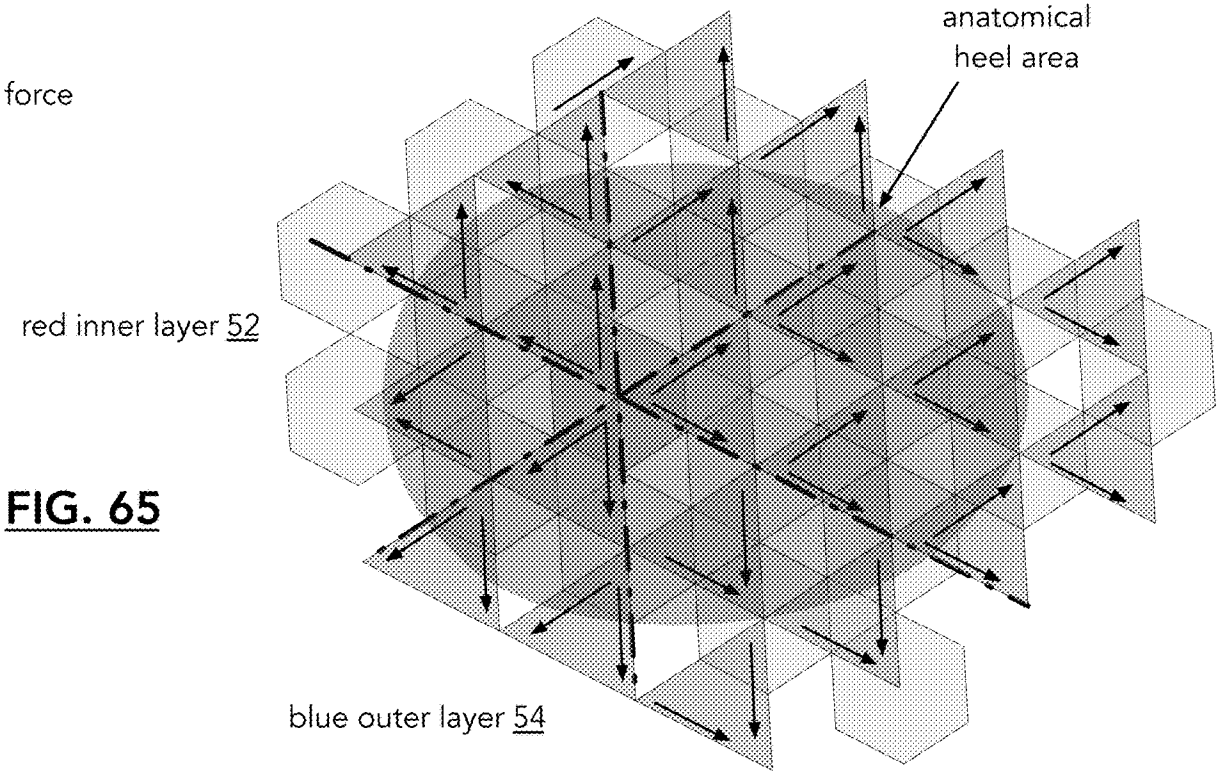
FIG. 65 is a diagram of another example of a red inner layer overlapping a blue outer layer of a DeFuzer heel section of a shoe to provide a directional reaction force.

FIG. 65 is a diagram of another example of a red inner layer 52 overlapping a blue outer layer 54 of a DeFuzer heel section of a shoe to provide a directional reaction force. With reference to FIG. 64B, FIG. 65 illustrates the direction of the forces between the cells which cause the angle of the reaction force to point towards the anterior of the shoe at heel strike.

The darker red cell of the red inner layer 52 is the initial point of contact. The cells of both layers to the right of the darker red inner layer cell has the force pointing to the right, which is the anterior direction of the shoe. In general, the cells around the dark red cell function to disperse the energy in directions away from the darker red cell. As such, by directing forces through the shoes as shown, the angle of the reaction force is adjusted towards the anterior of the shoe, which reduces impact pressure of the initial impact force in the heel.

Figure 66B:
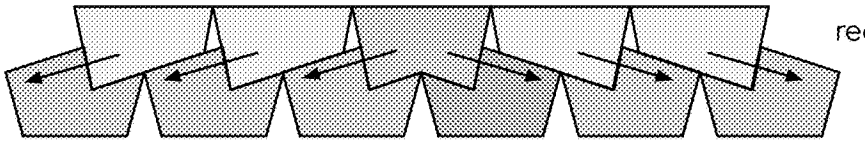
FIGS. 66A and 66B are diagrams of another example of a red inner layer overlapping a blue outer layer of a DeFuzer ball of foot section and a DeFuzer toe section of a shoe to provide a directional reaction force.
Figure 66A:
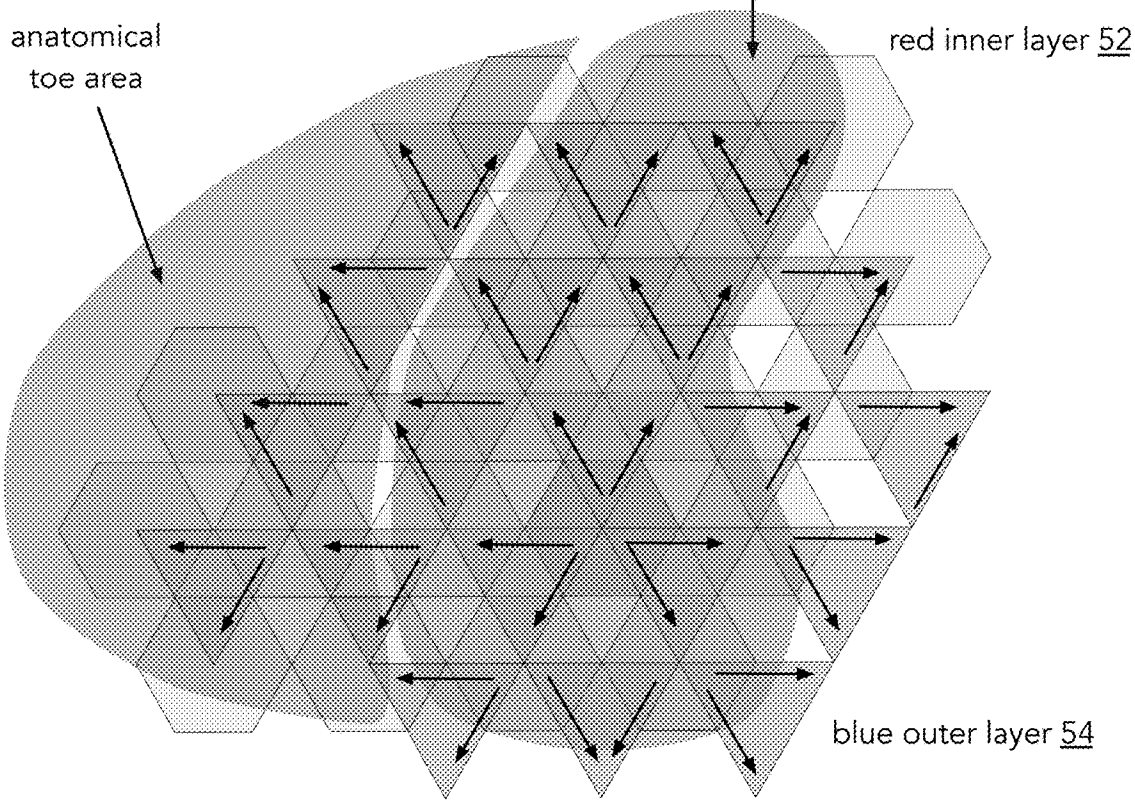

FIGS. 66A and 66B are diagrams of another example of a red inner layer 52 overlapping a blue outer layer 54 of a DeFuzer ball of foot section and a DeFuzer toe section of a shoe to provide a directional reaction force. With reference to FIG. 66B, FIG. 66A illustrates the direction of the forces between the cells which cause the angle of the reaction force to point towards the posterior of the shoe at toe push off.

The darker red cell of the red inner layer 52 is the initial point of contact. The cells of both layers to the right of the darker red inner layer cell has the force pointing to the right, which is the posterior direction of the shoe. In general, the cells around the dark red cell function to disperse the energy in directions away from the darker red cell. As such, by directing forces through the shoes as shown, the angle of the reaction force is adjusted towards the posterior of the shoe, which reduces impact pressure of the ball of foot and/or toe impact and/or push off.

Figure 67:
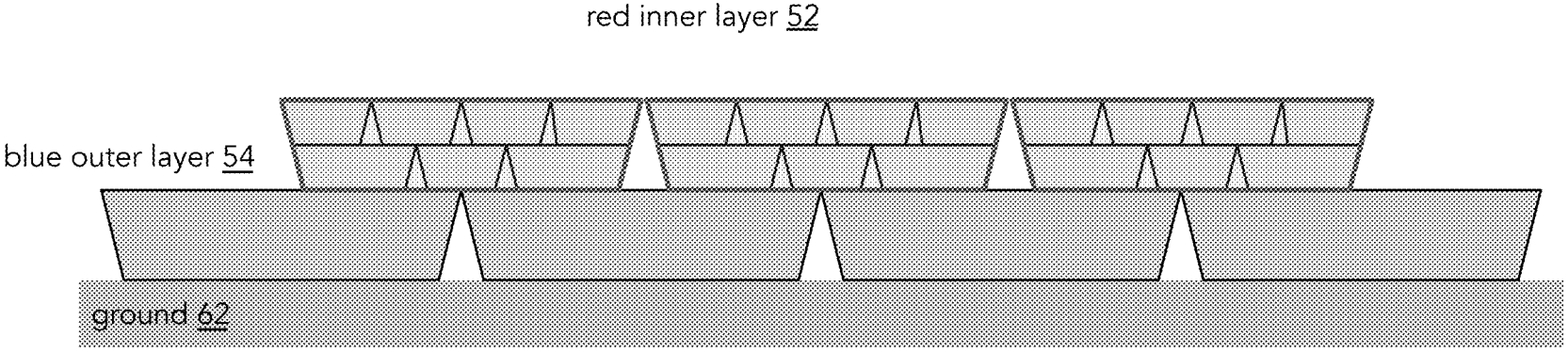
FIG. 67 is a diagram of another example of a row of cells of a red inner layer overlapping a row of cells of a blue outer layer of a DeFuzer section of a shoe wherein cells of the red inner layer include a plurality of smaller cells.

FIG. 67 is a diagram of another example of a row of cells of a red inner layer 52 overlapping a row of cells of a blue outer layer 54 of a DeFuzer section of a shoe wherein cells of the red inner layer include a plurality of smaller cells. By having cells within a cell, the forces are more evenly distributed on the top surface and the bottom surface as shown in FIG. 68.

Figure 68:
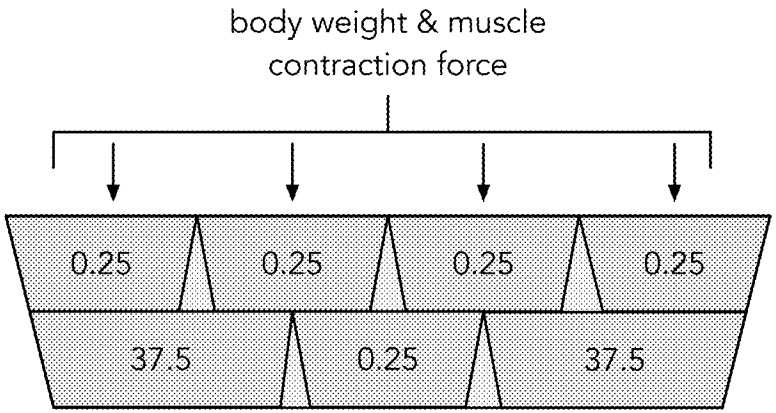
FIG. 68 is a diagram of an example of force distribution of a cell of a red inner layer that includes a plurality of small cells.

As shown in FIG. 68, a cell of a red inner layer 52 includes a plurality of small cells arranged in two layers. The upper layer includes 4 cells of equal size and the lower layer includes 3 cells. Of the three lower layer internal cells, the middle one is of the same size as the cells of the upper layer and the other two lower level internal cells are 50% bigger in width and of the same height and angle as the middle lower internal cell.

Figure 69A:
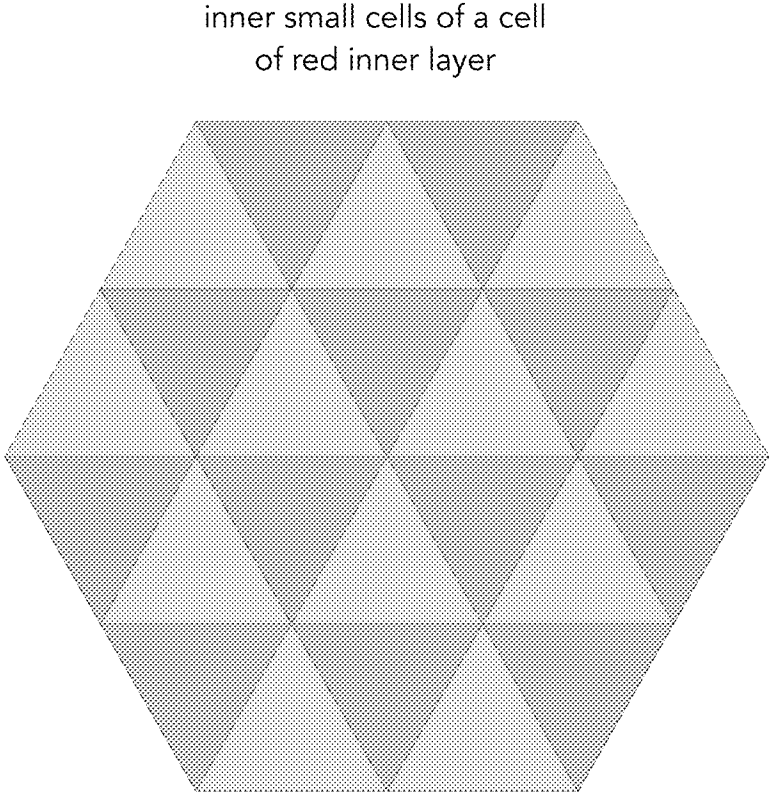
FIG. 69A is a top view diagram of an embodiment of inner smaller cells of a cell of a red inner layer.

FIG. 69A is a top view diagram of an embodiment of the upper layer internal cells of a cell of a red inner layer 52 of the cell of FIG. 68.

Figure 69B:
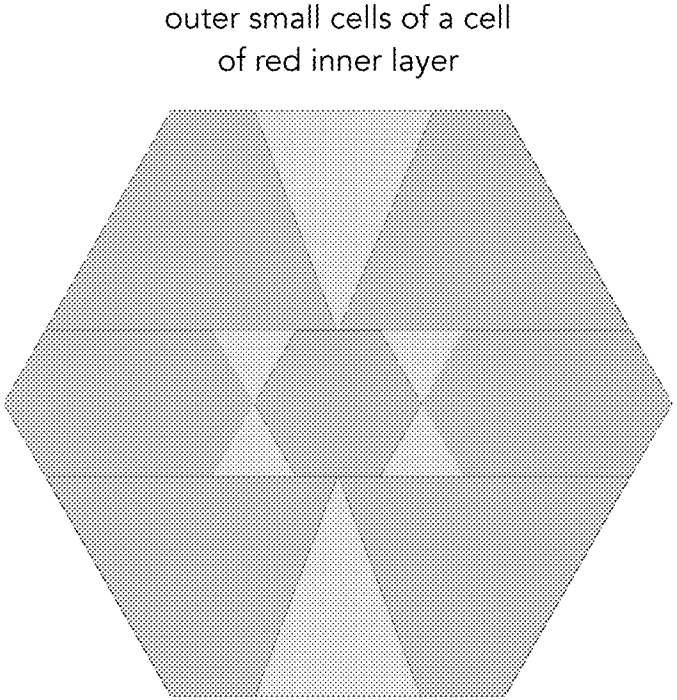
FIG. 69B is a top view diagram of an embodiment of outer smaller cells of a cell of a red inner layer.

FIG. 69B is a top view diagram of an embodiment of the lower level internal cells of a cell of a red inner layer 52 of the cell of FIG. 68.

Figure 69C:
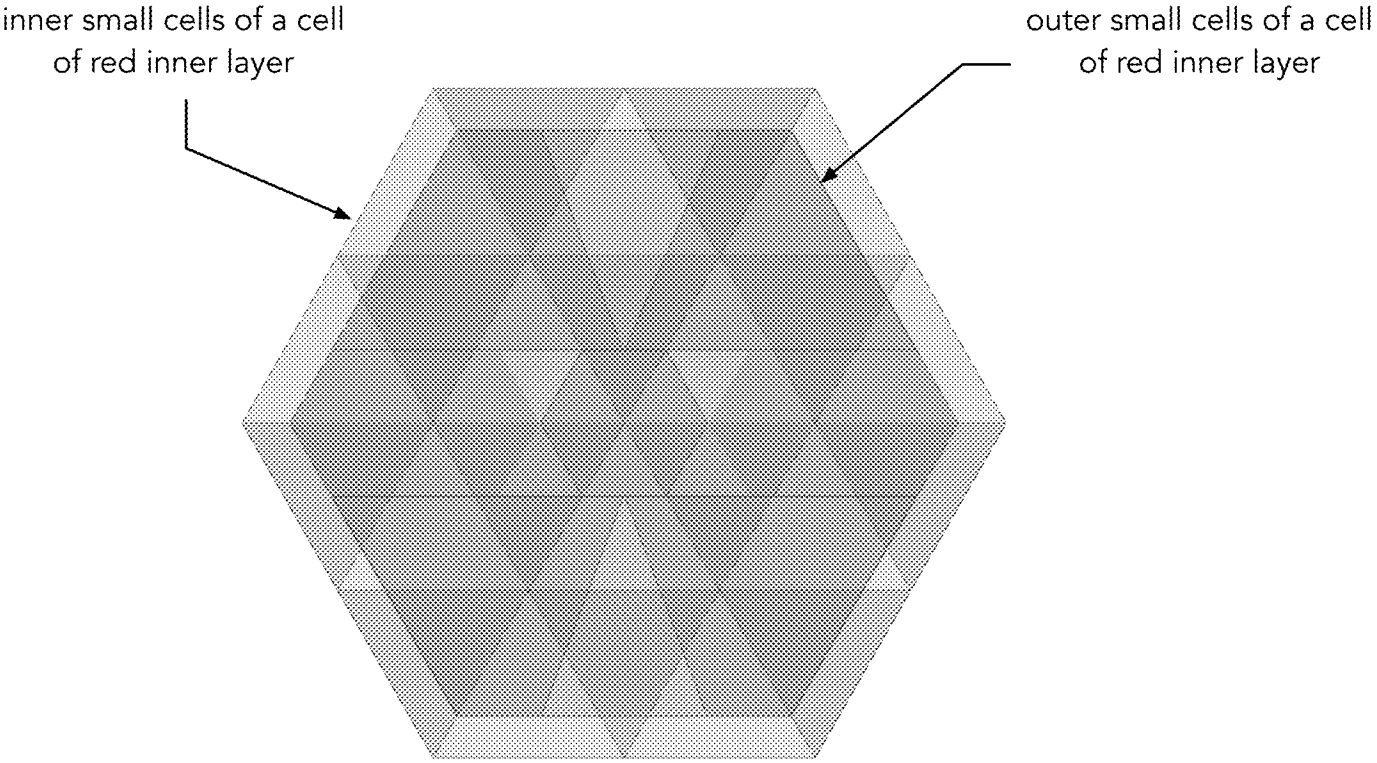
FIG. 69C is a top view diagram of an embodiment of inner smaller cells of a cell of a red inner layer overlaying outer smaller cells of the cell of a red inner layer.

FIG. 69C is a top view diagram of an embodiment of upper layer internal cells of a cell of a red inner layer 52 overlaying lower layer internal cells of the cell of a red inner layer 52 of the cell of FIG. 68.

Figure 70:
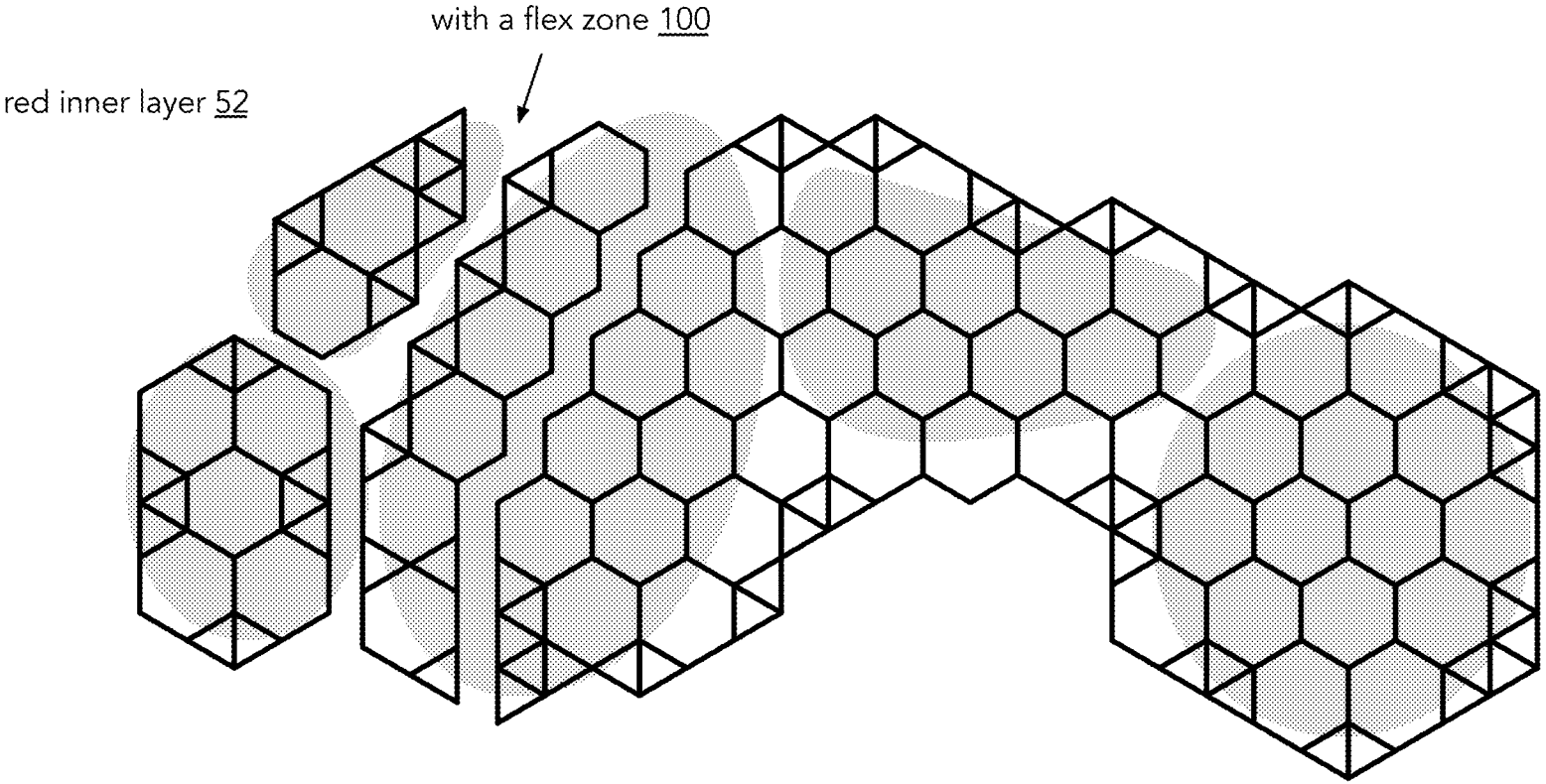
FIG. 70 is a top view diagram of an embodiment of an inner layer or outer layer of a midsole of a shoe.

FIG. 70 is a top view diagram of an embodiment of an inner layer or outer layer of a midsole of a shoe. In this embodiment, a DeFuzer pattern includes a big and second toe area, a remaining toe area, a ball of foot area, an arch area, and a heel area. Due to the size and shape of the DeFuzer cells, a variety of shapes can be made to conform to the shape of foot.

Figure 71:
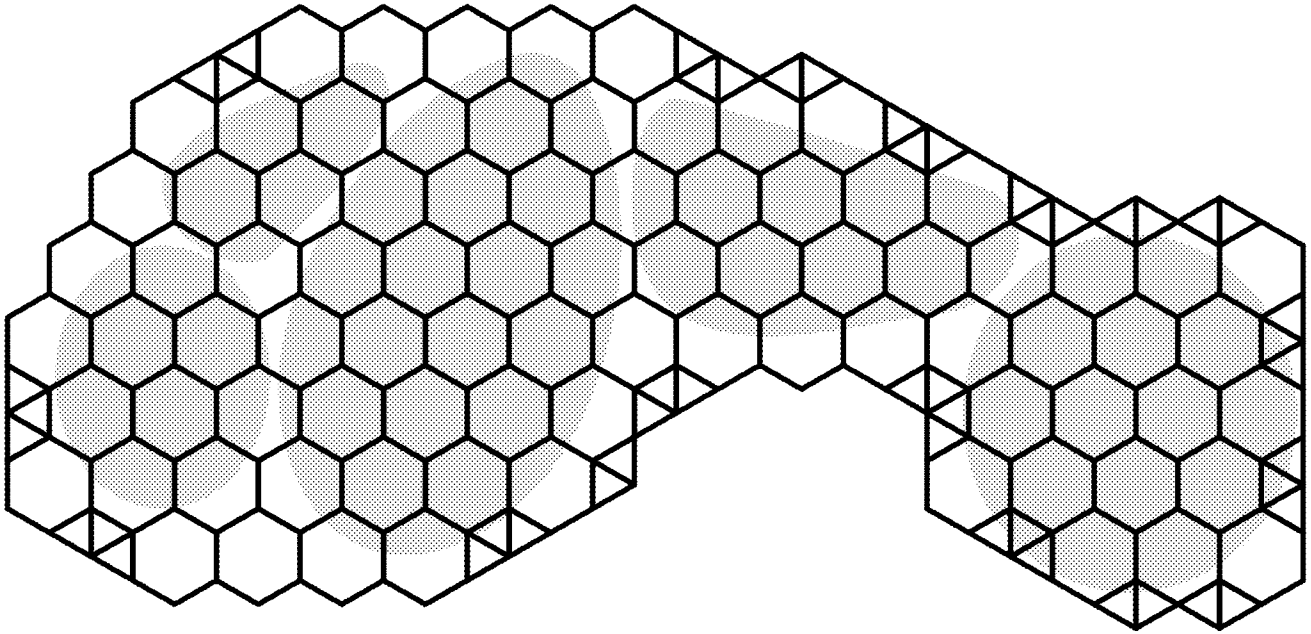
FIG. 71 is a top view diagram of another embodiment of an inner layer or outer layer of a midsole of a shoe.

FIG. 71 is a top view diagram of another embodiment of an inner layer or outer layer of a midsole of a shoe. The embodiment depicts another DeFuzer pattern for a shoe.

Figure 72:
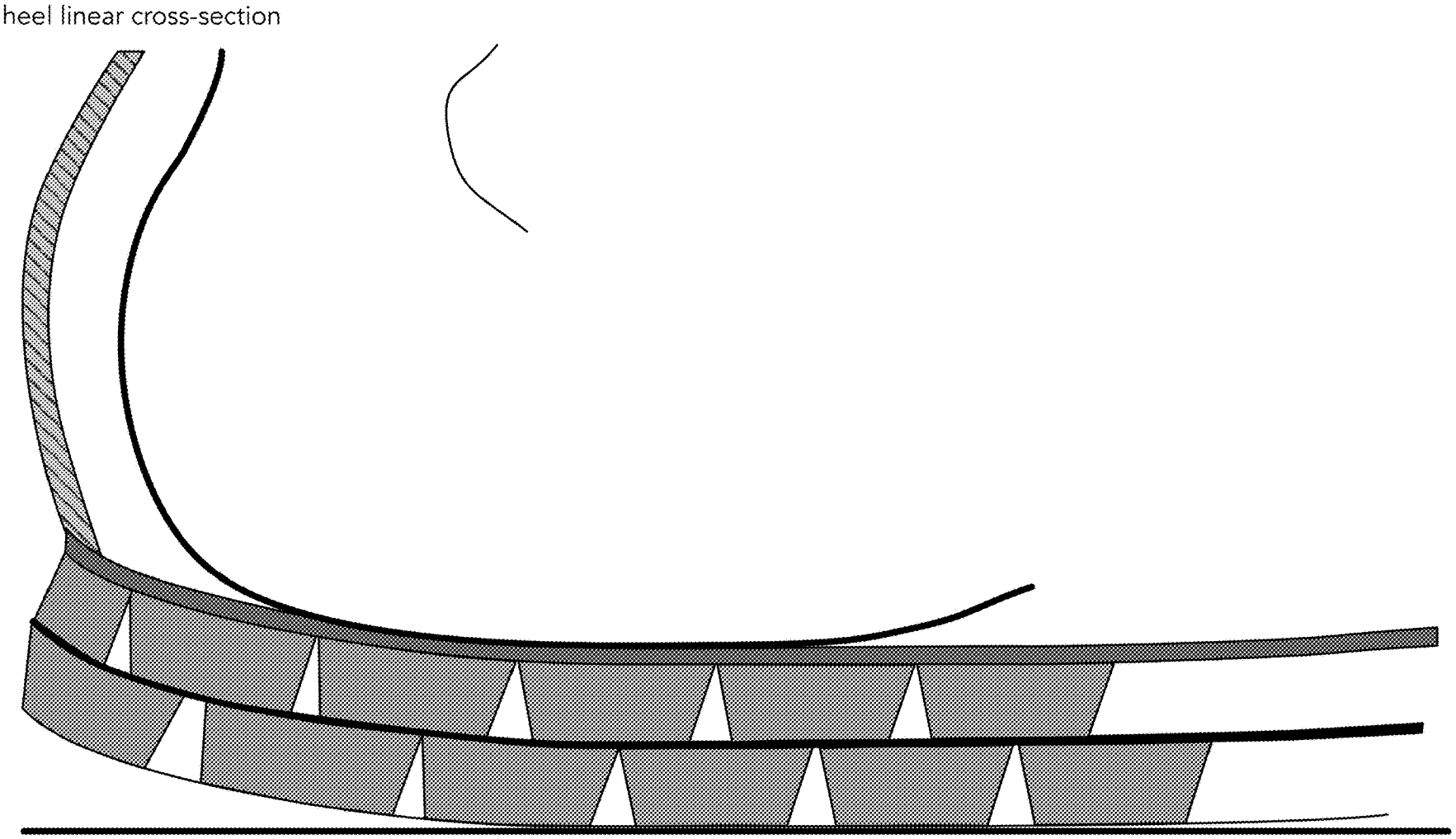
FIG. 72 is a medial side cross section view diagram of an embodiment of an inner layer or outer layer of a heel section of a shoe.

FIG. 72 is a medial side cross section view diagram of an embodiment of an inner layer or outer layer of a heel section of a shoe. In this embodiment, the heel section includes an arch to allow a smoother transition from heel strike to toe transition. The arch starts 10 to 40 millimeters from the posterior of the shoe and arches upward from the ground by 2 to 10 millimeters or more. The arch may follow a radius or it may be a non-linear arch (e.g., oval shaped versus circular shaped).

Figure 73:
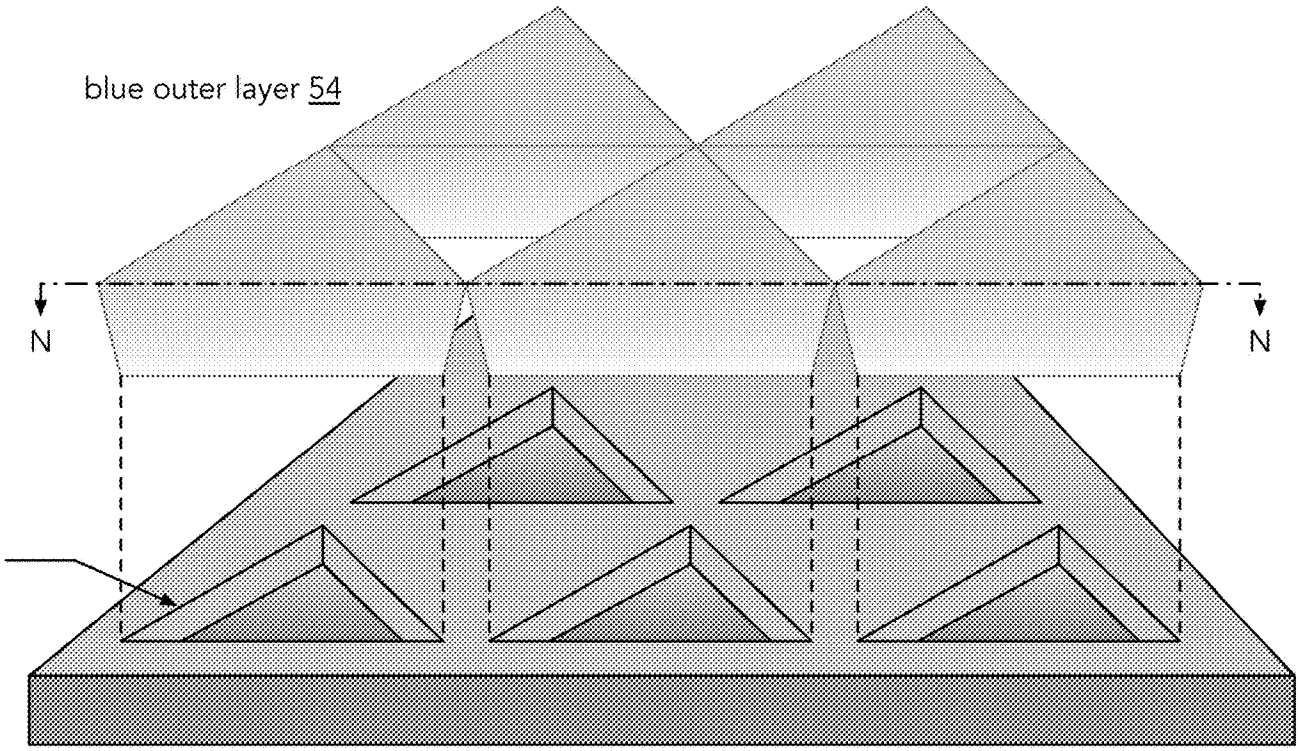
FIG. 73 is an exploded isometric view diagram of an embodiment of outer layer cells coupling to mounting receptacles of an outsole.

FIG. 73 is an exploded isometric view diagram of an embodiment of outer layer cells 54 coupling to mounting receptacles 55 of a midsole 12 or an outsole 14. The receptables are positioned proximal to the cells of the outer layer. The depths of the receptacles is in the range of a fraction of a millimeter to 2 or more millimeters. The other dimensions of the receptacles correspond to the dimensions of the bottom surface. In an embodiment, the blue outer layer of the cells 54 will be glued to the outsole 14. In another embodiment, the blue outer layer of the cells 54 will be pressure fit into the midsole 12, which allows the DeFuzer structures to be removed and used in other shoes. In this later embodiment, the midsole 12 would be glued to the outsole 14.

Figure 74:
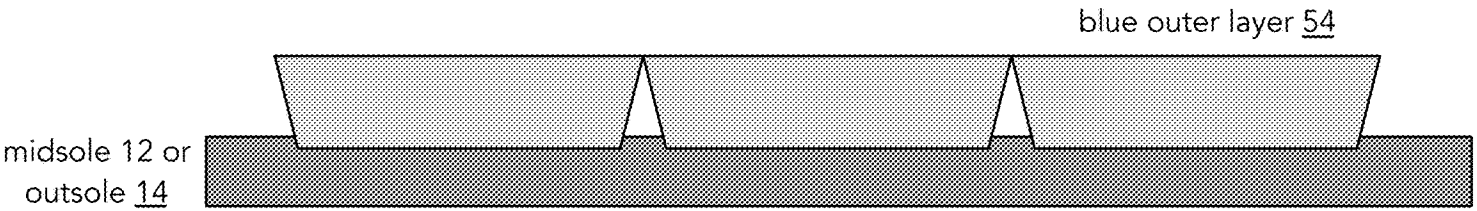
FIG. 74 is a cross section view diagram of an embodiment of outer layer cells coupling to mounting receptacles of an outsole.

FIG. 74 is a cross section view diagram of an embodiment of outer layer cells 54 coupling to mounting receptacles 55 of a midsole 12 or an outsole 14 of FIG. 73.

Figure 75:
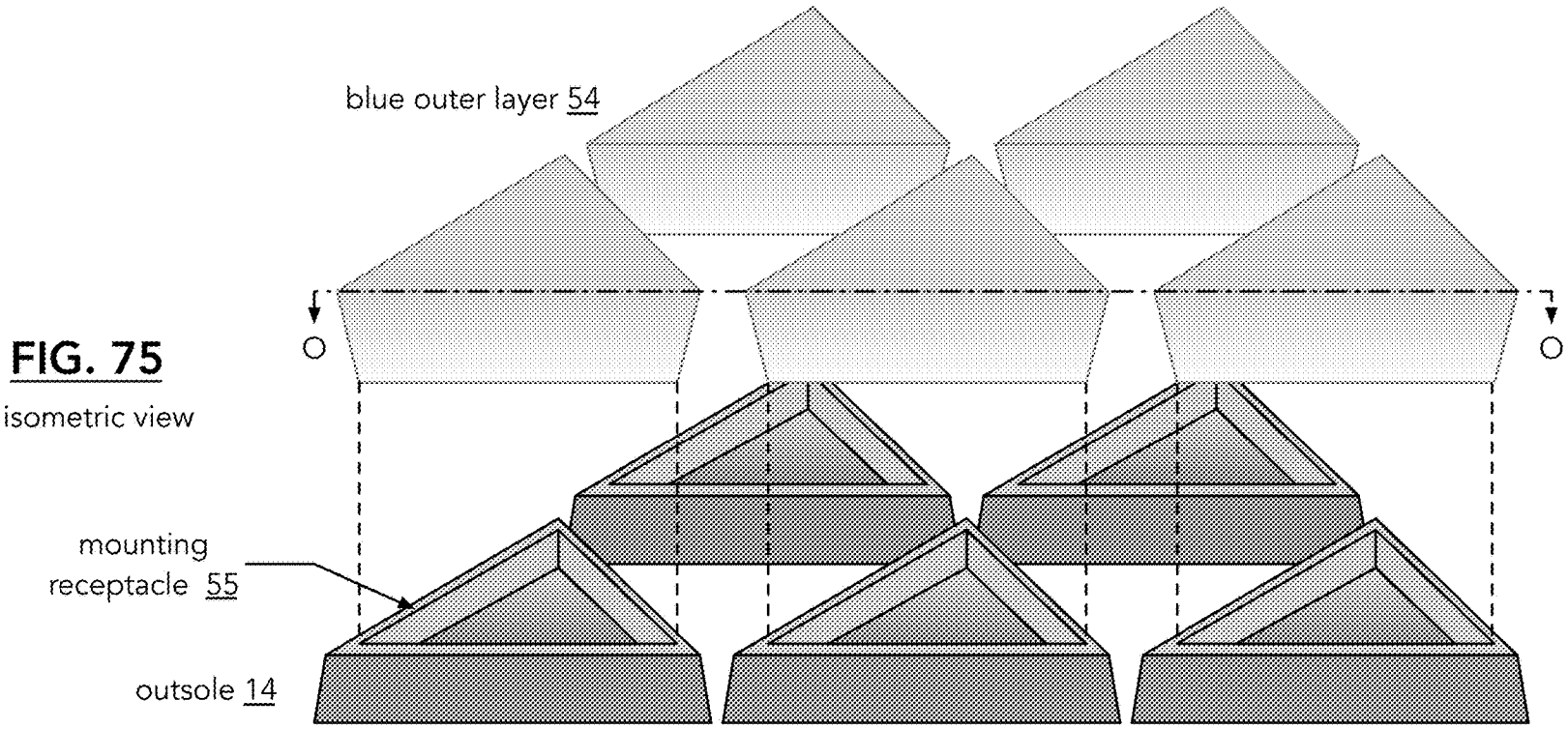
FIG. 75 is an exploded isometric view diagram of another embodiment of outer layer cells coupling to mounting receptacles of an outsole.

FIG. 75 is an exploded isometric view diagram of another an embodiment of outer layer cells 54 coupling to mounting receptacles 55 of an outsole 14, which includes a plurality of individual receptacles. The receptables are positioned proximal to the cells of the outer layer. The depths of the receptacles is in the range of a fraction of a millimeter to 2 or more millimeters. The other dimensions of the receptacles correspond to the dimensions of the bottom surface. In an embodiment, the blue outer layer of the cells 54 will be glued to the receptacles of the outsole 14.

Figure 76:
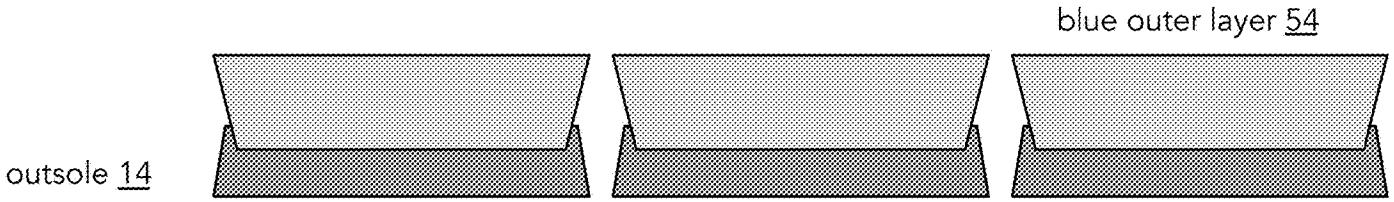
FIG. 76 is a cross section view diagram of another embodiment of outer layer cells coupling to mounting receptacles of an outsole.

FIG. 76 is a cross section view diagram of another embodiment of outer layer cells 54 coupling to mounting receptacles of an outsole of FIG. 75.

Figure 77:
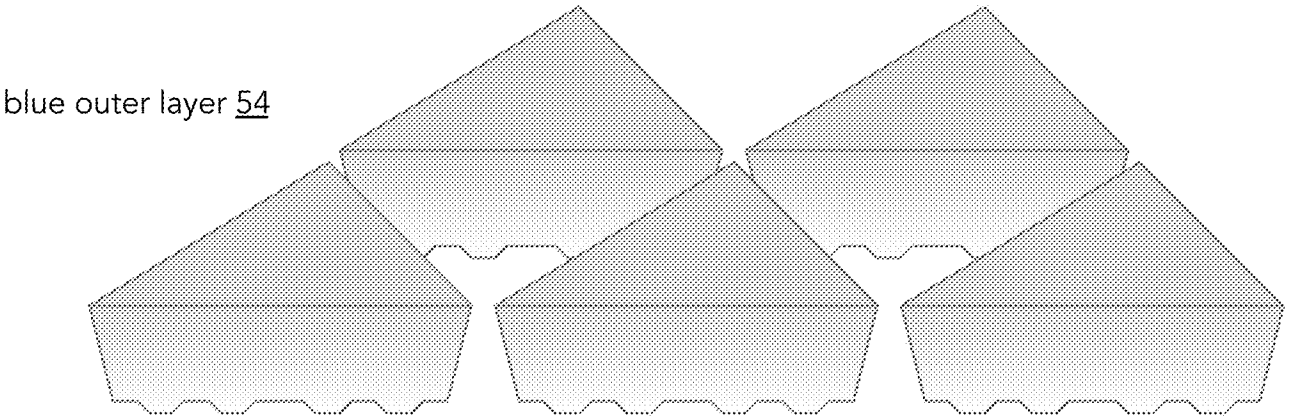
FIG. 77 is an exploded isometric view diagram of another embodiment of outer layer cells having an integrated outsole.

FIG. 77 is an exploded isometric view diagram of another embodiment of outer layer cells having an integrated outsole. In this embodiment, the DeFuzer cells of the outer layer 54 are formed to have an outsole pattern on the bottom surfaces of the cells. The outsole pattern includes nubs, tracks, grooves, etc. Note that a DeFuzer cell as discussed herein may be comprises of one or more of a plurality of materials. For example, a DeFuzer cell is constructed of one or more plastics. As another example, a DeFuzer cell is constructed of one or more rubbers. As another example, a DeFuzer cell is constructed of one or more metals. As another example, a DeFuzer cell is constructed of carbon fiber. As another example, a DeFuzer cell is constructed of a laminated fiberglass. As another example, a DeFuzer cell is constructed of Kevlar.

Figure 78:
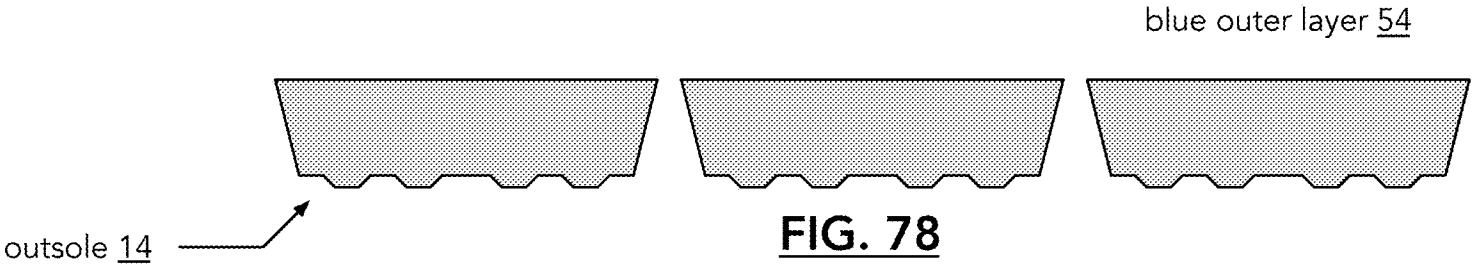
FIG. 78 is a cross section view diagram of another embodiment of outer layer cells having an integrated outsole.

FIG. 78 is a cross section view diagram of another embodiment of outer layer cells 54 having an integrated outsole of FIG. 77.

Figure 79:
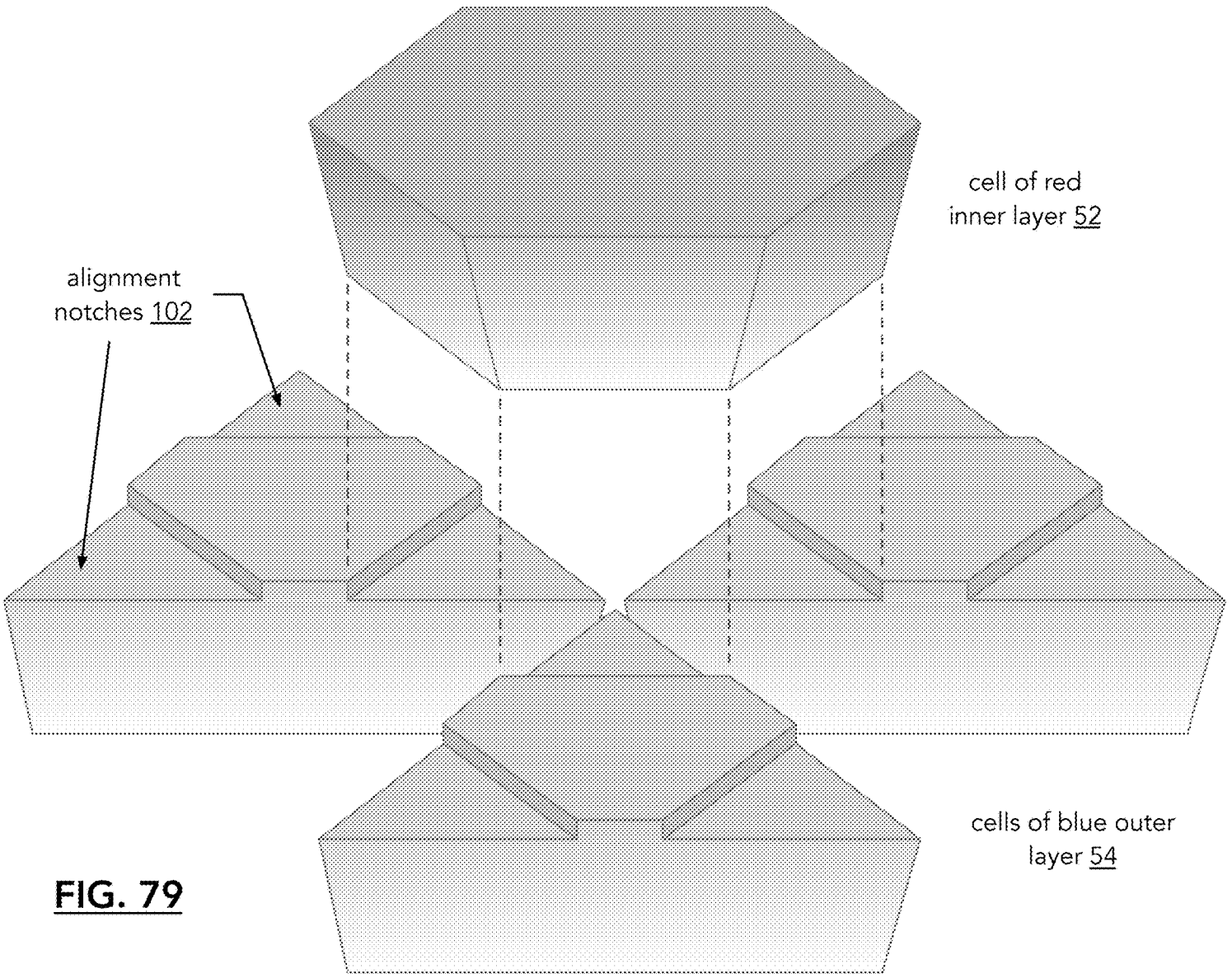
FIG. 79 is an exploded isometric view diagram of another embodiment of a cell of an inner layer aligning with three cells of an outer layer via alignment notches in the cells of the outer layer.

FIG. 79 is an exploded isometric view diagram of another embodiment of a cell of an inner layer 52 aligning with three cells of an outer layer 54 via alignment notches 102 in the cells of the outer layer 54. The dimensions of the alignment notches 102 depends the dimensions of the cells. In an embodiment, the depth of the notches 102 is about 5% to 10% of the height of an outer layer cell and should allow for 5% to 20% or more of an inner layer cell to sit on the outer layer cell.

Figure 80:
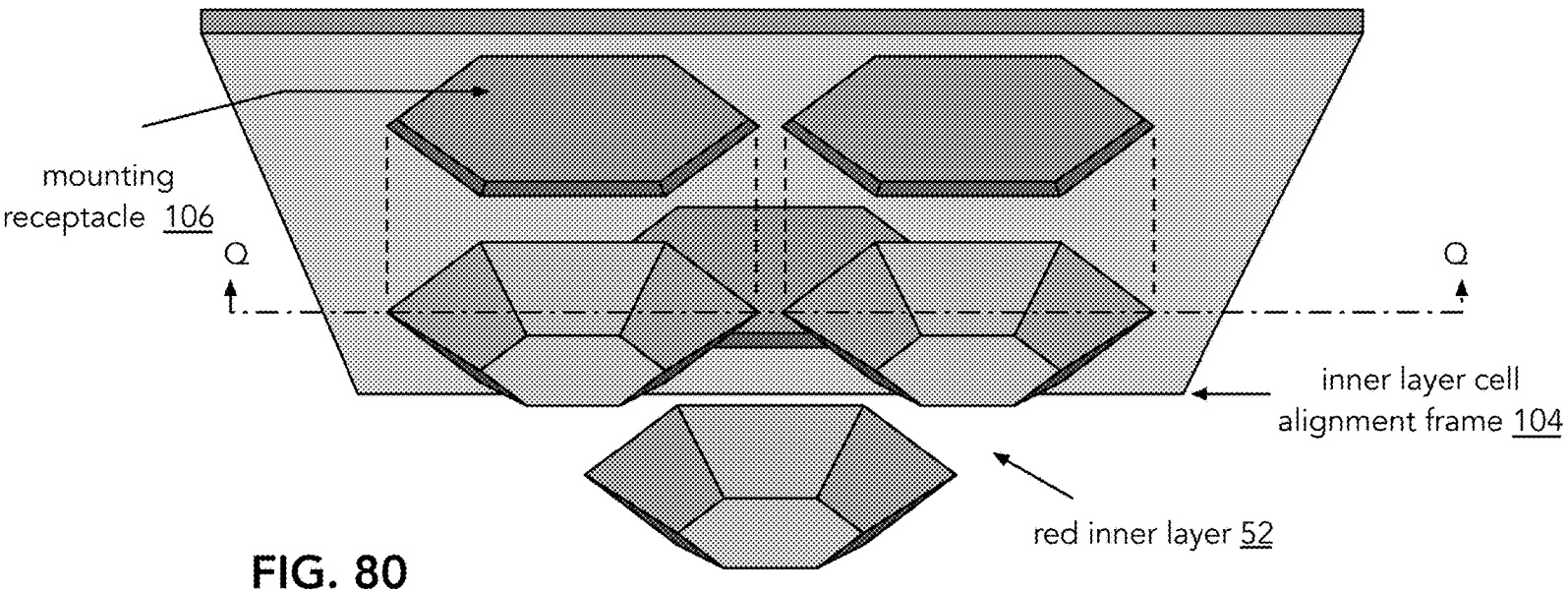
FIG. 80 is an exploded isometric view diagram of an embodiment of inner layer cells coupling to mounting receptacles of an inner layer cell alignment frame.

FIG. 80 is an exploded isometric view diagram of an embodiment of inner layer cells 52 coupling to mounting receptacles 106 of an inner layer cell alignment frame 104. The frame 104 is part of a DeFuzer structure (e.g., the heel structure) and comprises a flexible material such as a soft rubber, an EVA foam, leather, etc. The frame 104 allows inner layer cells to be positioned and held in place during assembly. In an embodiment, a cell is glued into a receptacle 106. In another embodiment, a cell is pressure fit into a receptacle 106.

Figure 81:
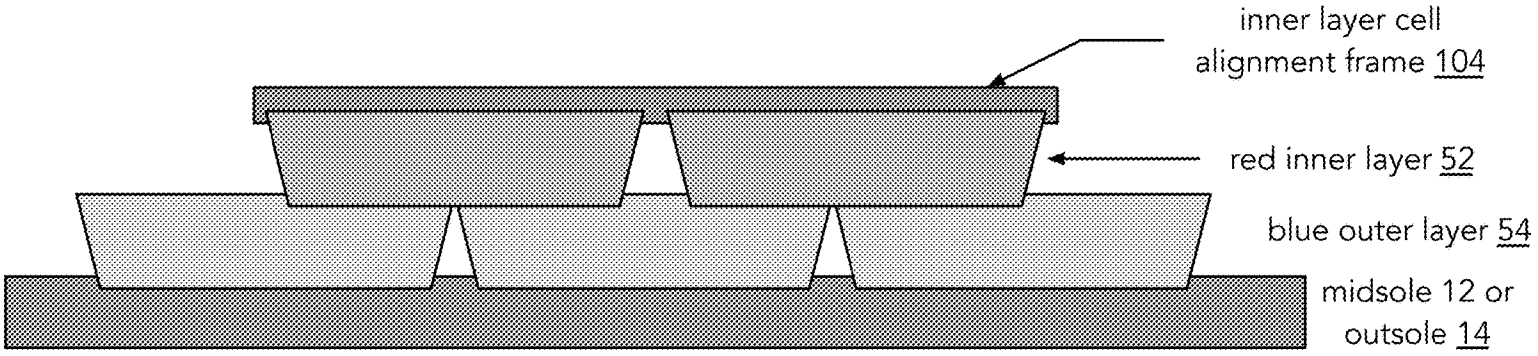
FIG. 81 is a cross section view diagram of an embodiment of inner layer cells coupling to mounting receptacles of an inner layer cell alignment frame.

FIG. 81 is a cross section view diagram of an embodiment of inner layer cells 52 coupling to mounting receptacles 104 of an inner layer cell alignment frame 104. The red inner layer cells 52 are coupled to the blue outer layer cells 54 as previously described. The outer layer cells 54 are attached to the midsole 12 or the outsole as previously discussed.

Figure 82:
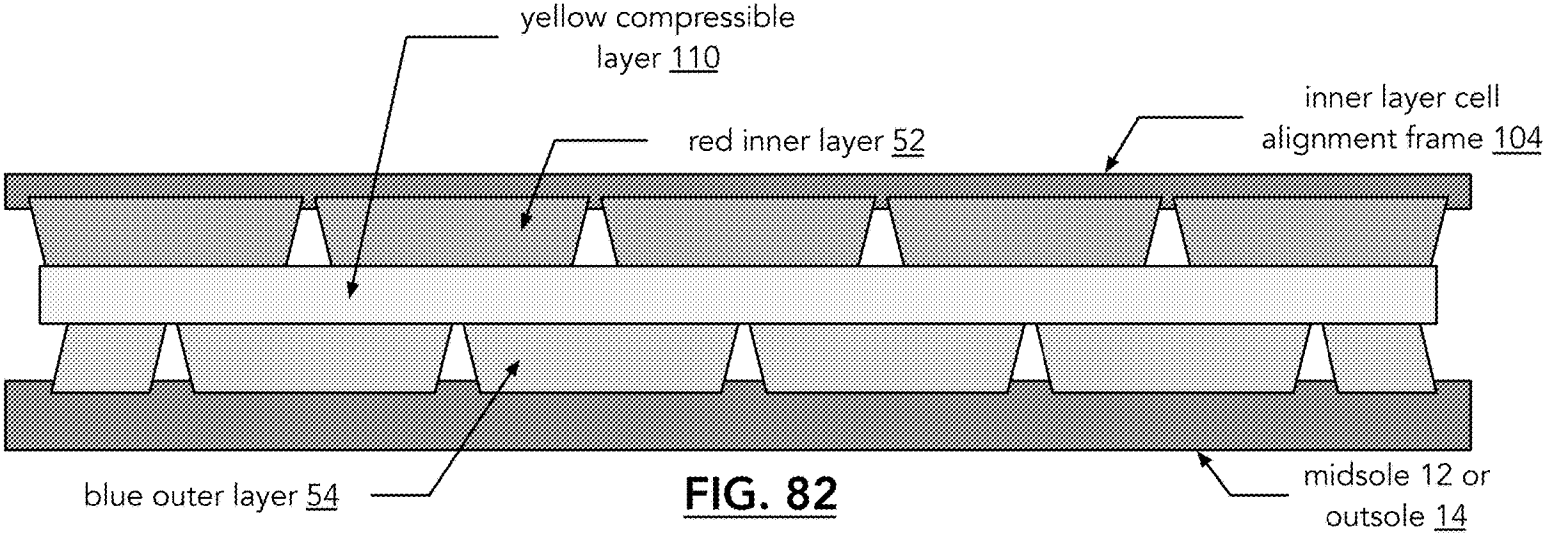
FIG. 82 is a cross section view diagram of an embodiment of inner layer cells and outer layer cells with a compression layer therebetween with no weight applied.

FIG. 82 is a cross section view diagram of an embodiment of inner layer cells 52 and outer layer cells 54 with a yellow compression layer 110 therebetween with no weight applied. The compression layer 110 may be comprised of one or more compressible materials. For example, the compression layer 110 includes one or more of a soft rubber, an EVA foam, etc. The thickness of the compression layer 110 is in the range of 2% to 10% or more of the height of an outer layer cell 54.

The red inner layer cells 52 are coupled to the frame 104. The blue outer cells 54 are coupled to the midsole 12 or the outsole 14.

Figure 83:
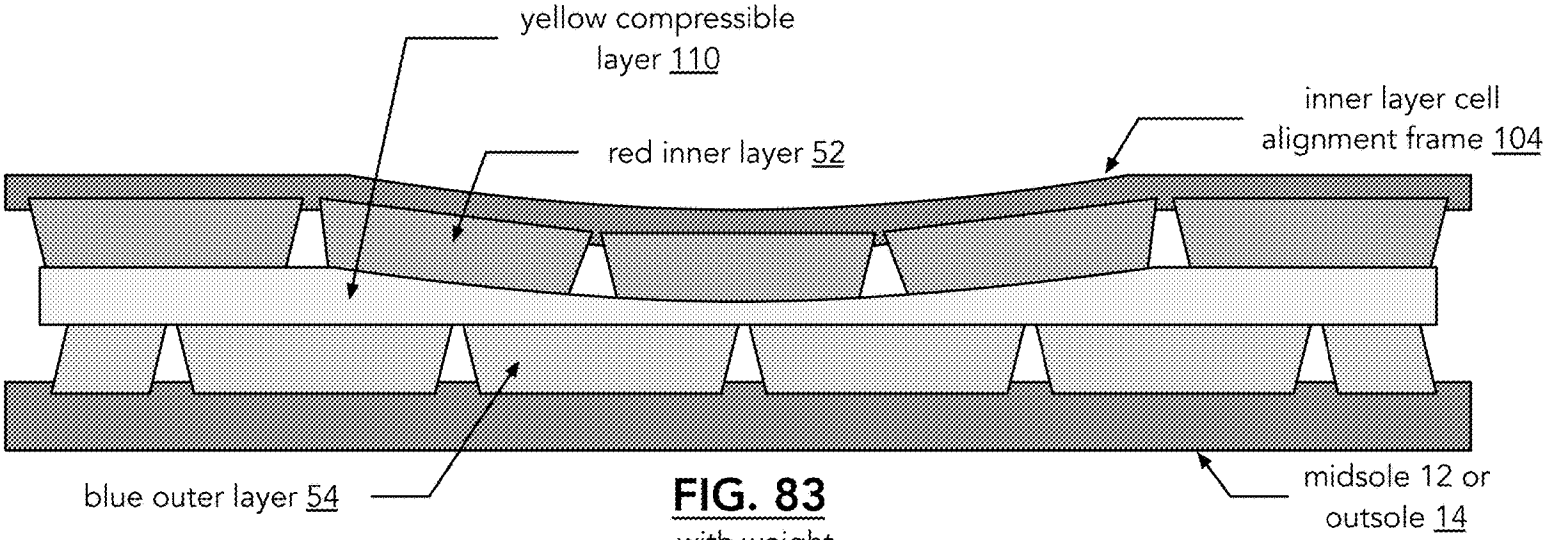
FIG. 83 is a cross section view diagram of an embodiment of inner layer cells and outer layer cells with a compression layer therebetween with weight applied.

FIG. 83 is a cross section view diagram of the embodiment of FIG. 82, which includes inner layer cells 54, outer layer cells 54 and a compression layer 110 therebetween, with weight applied. As the weight is applied the compressible layer 110 compresses forming a cup shape.

It is noted that terminologies as may be used herein such as bit stream, stream, signal sequence, etc. (or their equivalents) have been used interchangeably to describe digital information whose content corresponds to any of a number of desired types (e.g., data, video, speech, text, graphics, audio, etc. any of which may generally be referred to as 'data').

As may be used herein, the terms "substantially" and "approximately" provide an industry-accepted tolerance for its corresponding term and/or relativity between items. For some industries, an industry-accepted tolerance is less than one percent and, for other industries, the industry-accepted tolerance is 10 percent or more. Other examples of industry-accepted tolerance range from less than one percent to fifty percent. Industry-accepted tolerances correspond to, but are not limited to, component values, integrated circuit process variations, temperature variations, rise and fall times, thermal noise, dimensions, signaling errors, dropped packets, temperatures, pressures, material compositions, and/or performance metrics. Within an industry, tolerance variances of accepted tolerances may be more or less than a percentage level (e.g., dimension tolerance of less than +/−1%). Some relativity between items may range from a difference of less than a percentage level to a few percent. Other relativity between items may range from a difference of a few percent to magnitude of differences.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1. As may be used herein, the term "compares unfavorably", indicates that a comparison between two or more items, signals, etc., fails to provide the desired relationship.

As may be used herein, one or more claims may include, in a specific form of this generic form, the phrase "at least one of a, b, and C" or of this generic form "at least one of a, b, or c", with more or less elements than "a", "b", and "c". In either phrasing, the phrases are to be interpreted identically. In particular, "at least one of a, b, and c" is equivalent to "at least one of a, b, or c" and shall mean a, b, and/or c. As an example, it means: "a" only, "b" only, "c" only, "a" and "b", "a" and "c", "b" and "c", and/or "a", "b", and "c".

One or more embodiments have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims.

To the extent used, the flow diagram block boundaries and sequence could have been defined otherwise and still perform the certain significant functionality. Such alternate definitions of both functional building blocks and flow diagram blocks and sequences are thus within the scope and spirit of the claims. One of average skill in the art will also recognize that the functional building blocks, and other illustrative blocks, modules and components herein, can be implemented as illustrated or by discrete components, application specific integrated circuits, processors executing appropriate software and the like or any combination thereof.

In addition, a flow diagram may include a "start" and/or "continue" indication. The "start" and "continue" indications reflect that the steps presented can optionally be incorporated in or otherwise used in conjunction with one or more other routines. In addition, a flow diagram may include an "end" and/or "continue" indication. The "end" and/or "continue" indications reflect that the steps presented can end as described and shown or optionally be incorporated in or otherwise used in conjunction with one or more other routines. In this context, "start" indicates the beginning of the first step presented and may be preceded by other activities not specifically shown. Further, the "continue" indication reflects that the steps presented may be performed multiple times and/or may be succeeded by other activities not specifically shown. Further, while a flow diagram indicates a particular ordering of steps, other orderings are likewise possible provided that the principles of causality are maintained.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. An apparatus for a shoe, wherein the apparatus comprises:

an inner layer of a first plurality of defusing cells, wherein the inner layer is towards a foot when the shoe is worn, wherein a first defusing cell of the first plurality of defusing cells has a top hexagon shape and a bottom hexagon shape, wherein the top hexagon shape is larger than the bottom hexagon shape, wherein the top hexagon shape is affixed to the bottom hexagon shape by six tapered walls such that the top hexagon shape is separated from the bottom hexagon shape by a distance, wherein, when force is applied to the first defusing cell, the distance between the top and bottom hexagon shapes remains substantially unchanged; and an outer layer of a second plurality of defusing cells, wherein the outer layer is towards ground when the shoe is worn and the wearer is standing, wherein a second defusing cell of the second plurality of defusing cells has a top triangular shape and a bottom triangular shape, wherein the top triangular shape is larger than the bottom triangular shape, wherein the top triangular shape is affixed to the bottom triangular shape by three tapered walls such that the top triangular shape is separated from the bottom triangular shape by a distance, wherein, when force is applied to the second defusing cell, the distance between the top and bottom triangular shapes remains substantially unchanged;

wherein the first defusing cell of the inner layer is aligned with three defusing cells of the second plurality of defusing cells as part of aligning the inner and outer layers, wherein the aligned inner and outer layers of defusing cells function to reduce impact pressure of a ground impact force.

2. The apparatus of claim 1 further comprises:

a frame that couples to the inner layer of defusing cells.

3. The apparatus of claim 1, wherein the first defusing cell further comprises:

the six tapered walls have a side wall angle, wherein perimeter of the hexagon top shape is larger than perimeter of the hexagon bottom shape based on the height of the six tapered walls and the side wall angle.

4. The apparatus of claim 1, wherein the second defusing cell further comprises:

the three tapered walls have a side wall angle, wherein perimeter of the triangular top shape is larger than perimeter of the triangular bottom shape based on the height of the three tapered walls and the side wall angle.

5. The apparatus of claim 1 further comprises:

a compression layer between the inner layer of defusing cells and the outer layer of defusing cells.

6. A shoe comprises:

an upper section; and a midsole coupled to the upper section, wherein the midsole includes a defusing section, wherein the defusing section includes:

an inner layer of a first plurality of defusing cells, wherein the inner layer is towards a foot when the shoe is worn, wherein a first defusing cell of the first plurality of defusing cells has a top hexagon shape and a bottom hexagon shape, wherein the top hexagon shape is larger than the bottom hexagon shape, wherein the top hexagon shape is affixed to the bottom hexagon shape by six tapered walls such that the top hexagon shape is separated from the bottom hexagon shape by a distance, wherein, when force is applied to the first defusing cell, the distance between the top and bottom hexagon shapes remains substantially unchanged; and an outer layer of a second plurality of defusing cells, wherein the outer layer is towards ground when the shoe is worn and the wearer is standing, wherein a second defusing cell of the second plurality of defusing cells has a top triangular shape and a bottom triangular shape, wherein the top triangular shape is larger than the bottom triangular shape, wherein the top triangular shape is affixed to the bottom triangular shape by three tapered walls such that the top triangular shape is separated from the bottom triangular shape by a distance, wherein, when force is applied to the second defusing cell, the distance between the top and bottom triangular shapes remains substantially unchanged;

wherein the first defusing cell of the inner layer is aligned with three defusing cells of the second plurality of defusing cells as part of aligning the inner and outer layers, wherein the aligned inner and outer layers of defusing cells function to reduce impact pressure of a ground impact force.

7. The shoe of claim 6 further comprises:

an outsole coupled to the midsole.

8. The shoe of claim 6, wherein the midsole further comprises:

a hollow section that functions as a receptacle for the defusing section.

9. The shoe of claim 6, wherein the defusing section comprises:

a heel defusing section.

10. The shoe of claim 6, wherein the defusing section comprises:

a ball of foot defusing section.

11. The shoe of claim 6, wherein the defusing section comprises:

a toe defusing section.

12. The shoe of claim 6, wherein the defusing structure comprises:

a frame that couples to the inner layer of defusing cells.

13. The shoe of claim 6, wherein the first defusing cell further comprises:

the six tapered walls have a side wall angle, wherein perimeter of the hexagon top shape is larger than perimeter of the hexagon bottom shape based on the height of the six tapered walls and the side wall angle.

14. The shoe of claim 6, wherein the second defusing cell further comprises:

the three tapered walls have a side wall angle, wherein perimeter of the triangular top shape is larger than perimeter of the triangular bottom shape based on the height of the three tapered walls and the side wall angle.

15. The shoe of claim 6, wherein the defusing structure comprises:

a compression layer between the inner layer of defusing cells and the outer layer of defusing cells.

* * * * *